US007692619B2

(12) United States Patent
Shin

(10) Patent No.: US 7,692,619 B2
(45) Date of Patent: Apr. 6, 2010

(54) SCAN DRIVER AND ORGANIC LIGHT EMITTING DISPLAY FOR SELECTIVELY PERFORMING PROGRESSIVE SCANNING AND INTERLACED SCANNING

(75) Inventor: Dong-Yong Shin, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1150 days.

(21) Appl. No.: 11/284,835

(22) Filed: Nov. 23, 2005

(65) Prior Publication Data

US 2006/0156118 A1 Jul. 13, 2006

(30) Foreign Application Priority Data

Nov. 26, 2004 (KR) ..... 10-2004-0098245
Jan. 5, 2005 (KR) ..... 10-2005-0000923

(51) Int. Cl.
*G09G 3/36* (2006.01)

(52) U.S. Cl. ..... 345/100; 345/98; 345/204

(58) Field of Classification Search ..... 345/82
See application file for complete search history.

(56) References Cited

U.S. PATENT DOCUMENTS 5,381,182 A 1/1995 Miller et al.
5,568,163 A * 10/1996 Okumura ..... 345/100
5,644,332 A 7/1997 Matsuzaki et al.
5,818,413 A * 10/1998 Hayashi et al. ..... 345/100
5,850,216 A * 12/1998 Kwon ..... 345/204
6,724,351 B1 * 4/2004 Boger ..... 345/3.2
2003/0178947 A1 * 9/2003 Shin et al. ..... 315/169.3
2003/0231152 A1 * 12/2003 Shin ..... 345/83

FOREIGN PATENT DOCUMENTS

EP 0416550 3/1991
EP 0607778 7/1994
EP 0 730 258 A1 9/1996
JP 03-132274 6/1991
JP 03132274 A * 6/1991
JP 05307166 A * 11/1993
JP 2001-312243 11/2001

* cited by examiner

*Primary Examiner*—Richard Hjerpe
*Assistant Examiner*—Dorothy Webb
(74) *Attorney, Agent, or Firm*—H.C. Park & Associates, PLC

(57) ABSTRACT

A scan driver and an organic light emitting display (OLED) for selectively performing progressive scanning and interlaced scanning. The scan driver includes a plurality of scan units. A scan unit generates an odd-number scan signal or an even-number scan signal and includes a flip-flop and a scan signal generator. The scan signal generator performs a logical operation on output signals from the flip-flop and a mode selection signal, and outputs a signal. A logical operation can be performed on the output signal of the scan unit and an impulse signal to form a scan signal and an emission control signal. The OLED, which selectively performs the progressive scanning and the interlaced scanning in response to a mode selection signal, includes an emission driver for outputting an emission control signal and a program driver for outputting a scan signal and a boost signal.

28 Claims, 42 Drawing Sheets

SCAN DRIVER AND ORGANIC LIGHT EMITTING DISPLAY FOR SELECTIVELY PERFORMING PROGRESSIVE SCANNING AND INTERLACED SCANNING

CROSS REFERENCE TO RELATED APPLICATIONS

This application claims priority to and the benefit of Korean Patent Application No. 10-2004-0098245, filed Nov. 26, 2004 and Korean Patent Application No. 10-2005-0000923, filed Jan. 5, 2005, which are hereby incorporated by reference for all purposes as if fully set forth herein.

BACKGROUND OF THE INVENTION

1. Field of the Invention

The present invention relates to a scan driver for a flat panel display (FPD) and, more particularly, to a scan driver and organic light emitting display (OLED) that selectively perform progressive scanning and interlaced scanning.

2. Discussion of the Background

A scan driver is a circuit in a flat panel display (FPD) that is used to drive a plurality of pixels arranged on a flat panel in rows and columns. The scan driver allows pixels arranged in a selected row to emit light by inputting data to the selected pixels.

In general, the formation of an image frame requires a vertical synchronous signal, which defines a period for displaying the image frame, and a horizontal synchronous signal, which selects respective lines of a plurality of pixel lines that form the image frame. While the horizontal synchronous signal is being activated, image data is input to pixels arranged in the line to which the horizontal synchronous signal is transmitted.

In a passive matrix (PM) display, pixels start to emit light at the same time that image data is input. However, in an active matrix (AM) display, when input image data is stored, pixels arranged in a line can emit light after a predetermined period of time.

In a liquid crystal display (LCD), an organic light emitting display (OLED), and a plasma display panel (PDP), the horizontal synchronous signal is referred to as a scan signal, and will be referred to as such hereinafter.

A circuit that transmits the scan signal to a panel in which pixels are arranged is a scan driver. Specifically, the scan driver transmits the scan signal to the lines along which rows of pixels are disposed. The selection and activation of the respective lines using the transmission of the scan signal may be typically performed in two manners: progressive scanning and interlaced scanning.

In the progressive scan method, a scan signal is sequentially transmitted to scan lines coupled with rows of pixels in a panel, beginning with the first row and sequentially proceeding to the last row.

In the interlaced scan method, a scan signal is first sequentially transmitted to all odd-numbered lines in a first process, and then the scan signal is sequentially transmitted to all even-numbered lines. Thus, through the first half of a frame display cycle, the odd-numbered lines receive the scan signal. Through the second half of a frame display cycle, the even-numbered lines receive the scan signal.

A conventional FPD performs either the progressive scan method or the interlaced scan method to display image data, but cannot selectively perform both methods.

SUMMARY OF THE INVENTION

This invention provides a scan driver that can selectively perform progressive scanning and interlaced scanning.

The present invention also provides an organic light emitting display (OLED) that can selectively perform progressive scanning and interlaced scanning.

Additional features of the invention will be set forth in the description which follows, and in part will be apparent from the description, or may be learned by practice of the invention.

The present invention discloses a scan driver for selectively performing progressive scanning and interlaced scanning, which includes a first signal generator for receiving a first start pulse, the first signal generator comprising a plurality of first scan units for generating a plurality of first signals in response to a mode selection signal, and a second signal generator for receiving a second start pulse, the second signal generator comprising a plurality of second scan units for generating a plurality of second signals in response to the mode selection signal. Further, the plurality of first signals are generated in a first half of a frame cycle and the plurality of second signals are generated in a second half of a frame cycle when the mode selection signal is at a low level, and the plurality of first signals are generated alternately with the plurality of second signals when the mode selection signal is at a high level.

The present invention also discloses an OLED for selectively performing progressive scanning and interlaced scanning, which includes a pixel array portion having a plurality of pixels arranged in rows and columns, an emission driver for supplying an emission control signal to the pixel array portion in response to a mode selection signal, a program driver for supplying a plurality of first scan signals, a plurality of second scan signals, and a plurality of boost signals to the pixel array portion in response to the mode selection signal, and a data driver for supplying a data signal to a pixel selected by the scan signal. Further, the program driver supplies the plurality of first scan signals in a first half of a frame cycle and the plurality of second scan signals in a second half of a frame cycle when the mode selection signal is at a low level, and the program driver supplies the plurality of first scan signals alternately with the plurality of second scan signals when the mode selection signal is at a high level.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
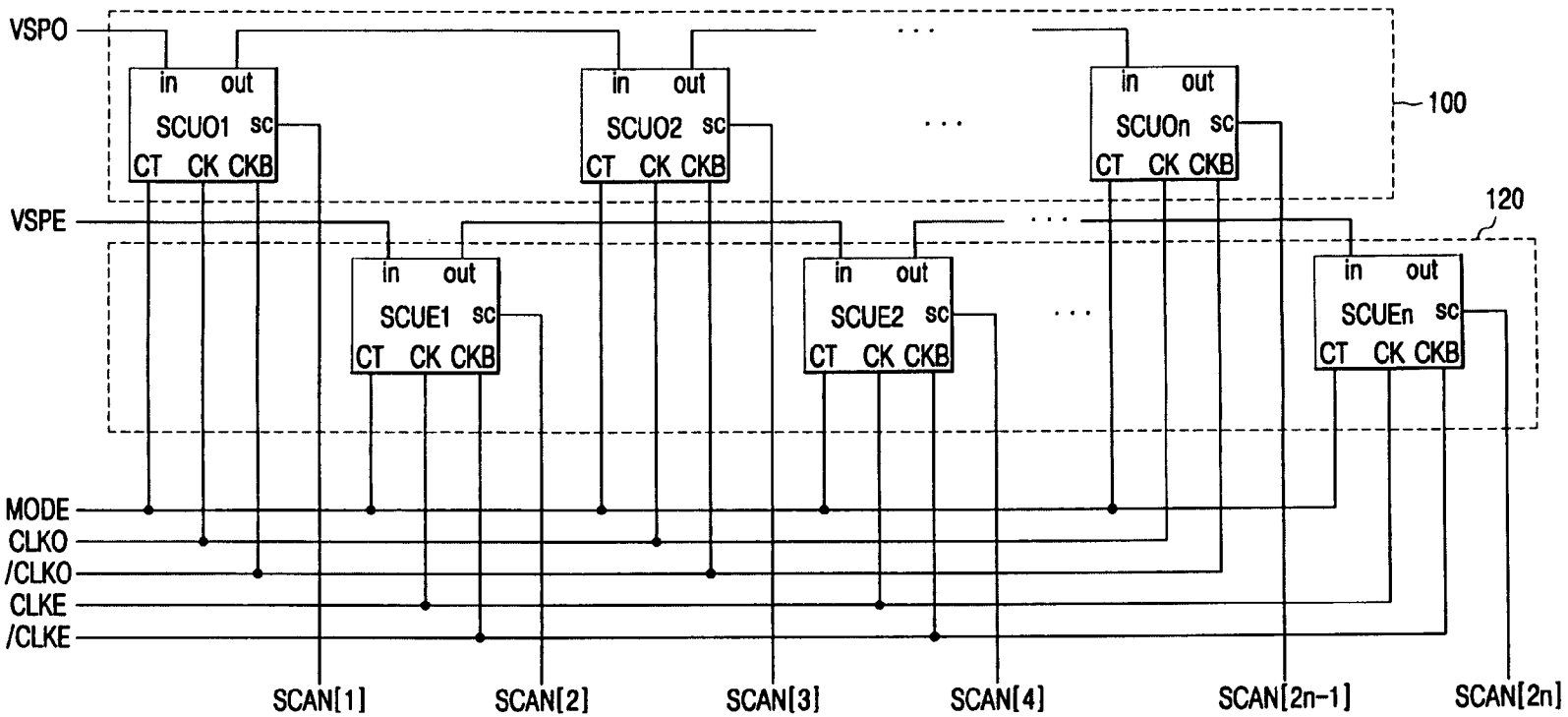
FIG. 1 shows a block diagram of a scan driver that selectively performs progressive scanning and interlaced scanning according to a first exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity.

It will be understood that when an element such as a layer, film, region or substrate is referred to as being "on" another element, it can be directly on the other element or intervening elements may also be present.

Embodiment 1

FIG. 1 shows a block diagram of a scan driver that selectively performs progressive scanning and interlaced scanning according to a first exemplary embodiment of the present invention.

Referring to FIG. 1, the scan driver of the present embodiment includes an odd-number scan signal generator 100 and an even-number scan signal generator 120.

The odd-number scan signal generator 100 includes a plurality of odd-number scan signal units, SCUO1, SCUO2, . . . SCUOn, which are coupled in series. Each odd-number scan signal unit has a flip-flop structure. Thus, the odd-number scan signal generator 100 is a shift register that outputs shifted data in response to an input clock signal for each cycle.

A first odd-number scan unit SCUO1 receives an odd-number start pulse VSPO, input into terminal in. Also, a mode selection signal MODE is input to a control terminal CT, and an inverse odd-number clock signal /CLKO is input to a terminal CKB. The first odd-number scan unit SCUO1 samples an input signal on a rising edge of an odd-number clock signal CLKO, input to clock terminal CK, and outputs a first scan signal SCAN[1] through a logical operation. Also, the sampled data is output via an output terminal OUT on a falling edge that is one-half of a clock cycle later than when the odd-number start pulse VSPO is sampled as an input signal. Accordingly, the input data, which is sampled on the rising edge of the odd-number clock signal CLKO, is output on the subsequent falling edge of the odd-number clock signal CLKO from terminal out. The data, which is output on the falling edge of the odd-number clock signal CLKO, is then input to a second odd-number scan unit SCUO2.

The above-described operations and connections are sequentially applied from the first odd-number scan unit SCUO1 to an n-th odd-number scan unit SCUOn. The mode selection signal MODE and the odd-number clock signal CLKO are input in parallel to all the odd-number scan units of the odd-number scan signal generator 100, and the odd-number scan units are coupled in series to adjacent odd-number scan units. Accordingly, the odd-number scan units output odd-number scan signals SCAN[1,3, . . . ,2*n*−1] from terminals SC at intervals of one cycle of the odd-number clock signal CLKO.

The even-number scan signal generator 120 includes a plurality of even-number scan signal units, SCUE1, SCUE2, . . . SCUEn, which are coupled in series. Each even-number scan signal unit has a flip-flop structure. Thus, the even-number scan signal generator 120 is a shift register that outputs shifted data in response to an input clock signal for each cycle.

A first even-number scan unit SCUE1 receives an even-number start pulse VSPE at terminal in. During progressive scanning, there may be a phase difference of ½ a clock cycle between the even-number start pulse VSPE and the odd-number start pulse VSPO. Also, during interlaced scanning, the even-number start pulse VSPE may be delayed by ½ a frame cycle after the VSPO start pulse.

A mode selection signal MODE is input to a control terminal CT of the first even-number scan unit SCUE1, an even-number clock signal CLKE is input to terminal CK, and an inverse even-number clock signal /CLKE is input to terminal CKB. The first even-number scan unit SCUE1 samples the even-number start pulse VSPE on a rising edge of an even-number clock signal CLKE and outputs a second scan signal SCAN[2] from terminal SC through a logical operation. Also, the sampled data is output via an output terminal out on a falling edge of the even-number clock signal CLKE that is one-half of a clock cycle later than when the even-number start pulse VSPE is sampled as an input signal. Accordingly, the input data, which is sampled on the rising edge of the even-number clock signal CLKE, is output on the subsequent falling edge of the even-number clock signal CLKE. The data, which is output on the falling edge of the even-number clock signal CLKE, is then input to a second even-number scan unit SCUE2.

The above-described operations are sequentially applied from the first even-number scan unit SCUE1 to an n-th even-number scan unit SCUEn. The mode selection signal MODE and the even-number clock signal CLKE are input in parallel to all the even-number scan units of the even-number scan signal generator 120, and the even-number scan units are coupled in series to adjacent even-number scan units. Accordingly, the even-number scan units output even-number scan signals SCAN[2,4, . . . ,2*n*] from terminals SC at intervals of one cycle of the even-number clock signal CLKE.

Figure 2:
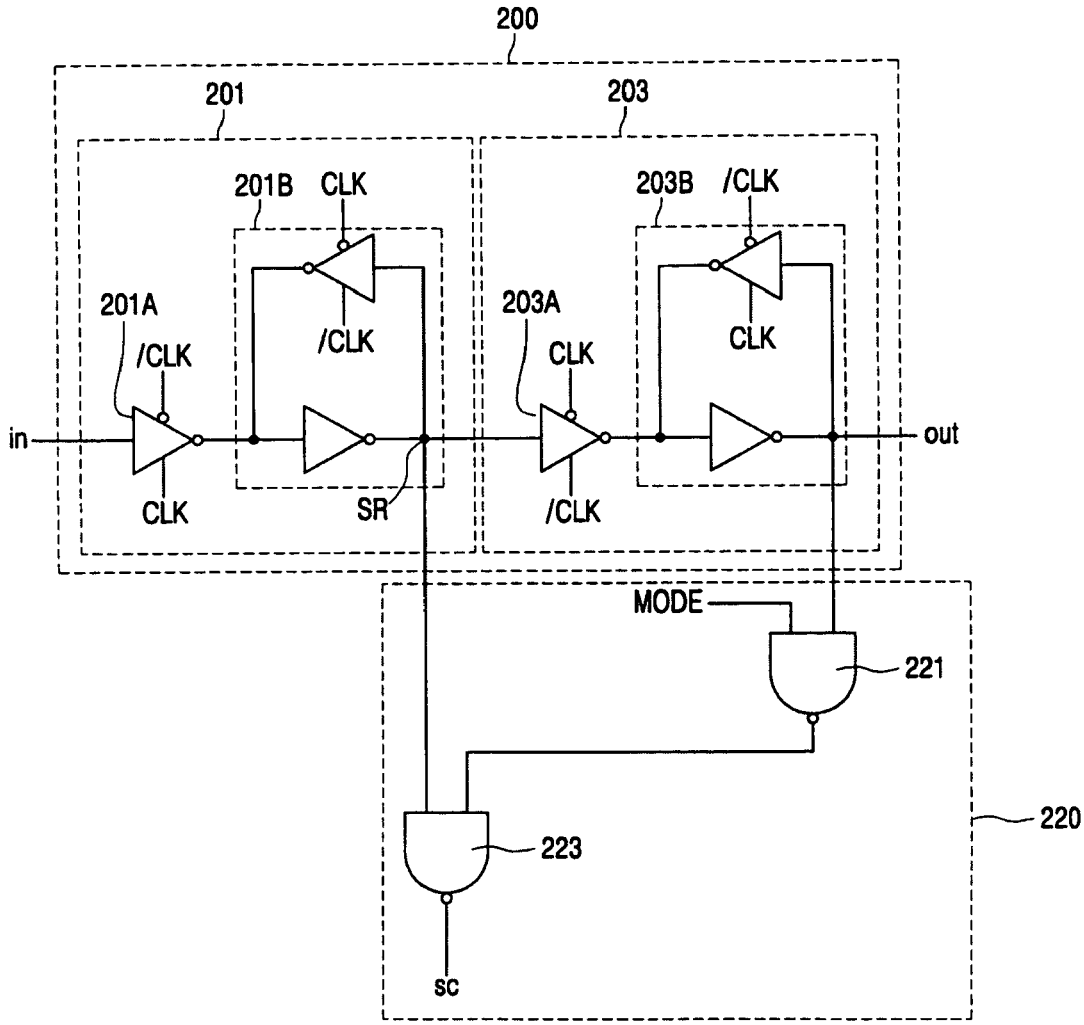
FIG. 2 shows a circuit diagram of an odd-number scan unit or an even-number scan unit according to the first exemplary embodiment of the present invention.

FIG. 2 shows a circuit diagram of an odd-number scan unit or an even-number scan unit according to the first exemplary embodiment of the present invention.

Because odd-number scan units have equivalent structure and operation as even-number scan units in the present first exemplary embodiment of the invention, in FIG. 2, clock signal CLK refers to either the odd-number clock signal CLKO or the even-number clock signal CLKE.

Referring to FIG. 2, the scan unit includes a flip-flop 200 and a scan signal former 220.

The flip-flop 200 samples data on a rising edge of a clock signal CLK and outputs data on a falling edge that is delayed by ½ a clock cycle after sampling. For this operation, the flip-flop 200 includes a first latch 201 and a second latch 203, which are coupled in series.

The first latch 201 includes a first sampler 201A and a first holder 201B. The first sampler 201A samples an input signal on a rising edge of a clock signal CLK and outputs the input signal in a high-level period of a clock signal CLK. The input of the input signal is terminated on a falling edge of the clock signal CLK. The first holder 201B samples the input signal on the falling edge of the clock signal CLK, and stores and outputs the input signal during a subsequent low-level period of the clock signal CLK.

The second latch 203 includes a second sampler 203A and a second holder 203B. The second sampler 203A samples the output signal SR from the first latch 201 on the falling edge of the clock cycle CLK, and outputs the output signal out in the low-level period of the clock signal CLK. The input of the output signal SR is terminated on a rising edge of the clock signal CLK. The second holder 203B samples the output signal out in the rising edge of the clock signal CLK, and stores and outputs the output signal SR in a subsequent high-level period of the clock signal CLK.

The scan signal former 220 includes a first NAND gate 221 and a second NAND gate 223. The first NAND gate 221 receives the mode selection signal MODE and an output signal out of the second latch 203.

When the mode selection signal MODE is at a low level, the first NAND gate 221 outputs a high-level signal irrespective of the output signal of the second latch 203. When the mode selection signal MODE is at a high level, the first NAND gate 221 inverts the output signal of the second latch 203 and outputs the inverted signal.

The second NAND gate 223 receives the output signal SR of the first latch 201 and the output signal of the first NAND gate 221. When the first NAND gate 221 outputs a high-level signal, the second NAND gate 223 inverts the output signal SR of the first latch 201 and outputs the inverted signal. Therefore, second NAND gate 223 outputs a low-level signal when output signal SR is a high-level signal.

When the mode selection signal MODE is at a high level, the second NAND gate 223 performs a NAND operation on the inverted output signal of the second latch 203 and the output signal SR of the first latch 201. Accordingly, the second NAND gate 223 outputs a low-level signal via an output terminal SC when the mode selection signal MODE is a high-level signal, the second latch 203 outputs a low-level signal, and the first latch 201 outputs a high-level signal.

Figure 3A:
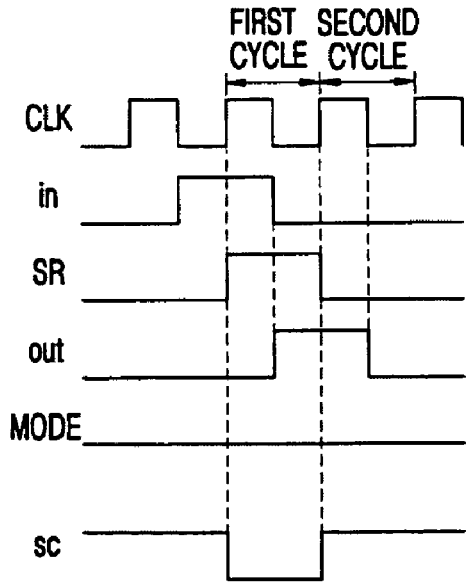
FIG. 3A shows a timing diagram illustrating operation of the scan unit shown in FIG. 2 when the mode selection signal input is low.

FIG. 3A shows a timing diagram illustrating operation of the scan unit shown in FIG. 2 when the mode selection signal input is low.

Figure 3B:
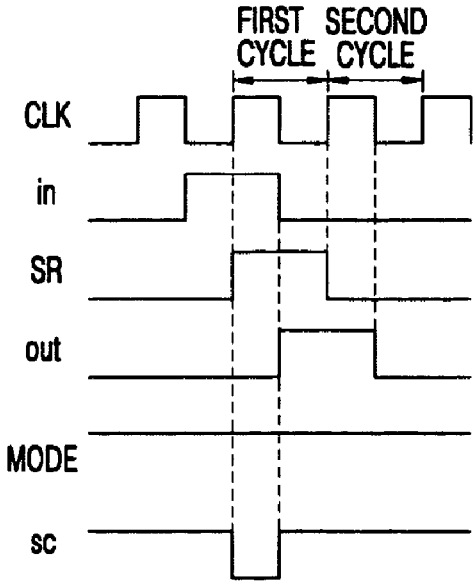
FIG. 3B shows a timing diagram illustrating operation of the scan unit shown in FIG. 2 when the mode selection signal input is high.

FIG. 3B shows a timing diagram illustrating operation of the scan unit shown in FIG. 2 when the mode selection signal input is high.

Referring to FIG. 3A, an input signal in is sampled and output by the first latch 201 on a rising edge of a first cycle of a clock signal CLK. Since the input signal in is at a high level on the rising edge of the first cycle of the clock signal CLK, output signal SR from the first latch 201 is a high-level signal. Also, since the sampled output signal is stored and output by first holder 201B in a low-level period of the first cycle of the clock signal CLK, the output signal SR of the first latch 201 remains at a high level in the low-level period of the first cycle of the clock signal CLK.

The input signal in is sampled and output by the first latch 201 on a rising edge of a second cycle of the clock signal CLK. Since the input signal in is at a low level on the rising edge of the second cycle of the clock signal CLK, the output signal SR of the first latch 201 is a low-level signal.

The output signal SR of the first latch 201 is sampled and output via the second latch 203 on a falling edge of the clock signal CLK. Since the output signal SR is at a high level on the falling edge of the first cycle of the clock signal CLK, a high-level signal out is output via an output terminal out of the second latch 203. Also, since the output signal SR is at a low level on a falling edge of a second cycle of the clock signal CLK, a low-level signal out is output via the output terminal out of the second latch 203.

Since the mode selection signal MODE is at a low level, the first NAND gate 221 outputs a high-level signal irrespective of the level of the output signal of the second latch 203. The high-level output signal of the first NAND gate 221 is input to the second NAND gate 223. The second NAND gate 223 inverts the output signal SR of the first latch 201 and outputs the inverted signal.

Accordingly, a signal that is at a low level is output to the output terminal SC of the scan unit in the first cycle of the clock signal CLK.

Referring to FIG. 3B, the sampling of the input signal in by the first latch 201 and the sampling of the output signal SR of the first latch 201 via the second latch 203 are the same as described above with reference to FIG. 3A. Accordingly, the output signal SR of the first latch 201 and an output signal from the output terminal out of the second latch 203 have the same waveforms as those of FIG. 3A.

However, since the mode selection signal MODE is at a high level, the first NAND gate 221 inverts the output signal out of the second latch 203. Accordingly, the output signal of the first NAND gate 221 is at a low level only in a low-level period of the first cycle of the clock signal CLK and a high-level period of the second cycle of the clock signal CLK. The output signal of the first NAND gate 221 is at a high level on the high-level period of the first cycle of the clock signal CLK and the low-level period of the second cycle of the clock signal CLK. The output signal of the first NAND gate 221 and the output signal SR of the first latch 201 are input to the second NAND gate 223.

The second NAND gate 223 outputs a low-level signal only when both input signals are at a high level, which only occurs in the high-level period of the first cycle of the clock signal CLK. Thus, a low-level signal is output to the output terminal SC in a high-level period of the first cycle of the clock signal CLK.

Figure 4:
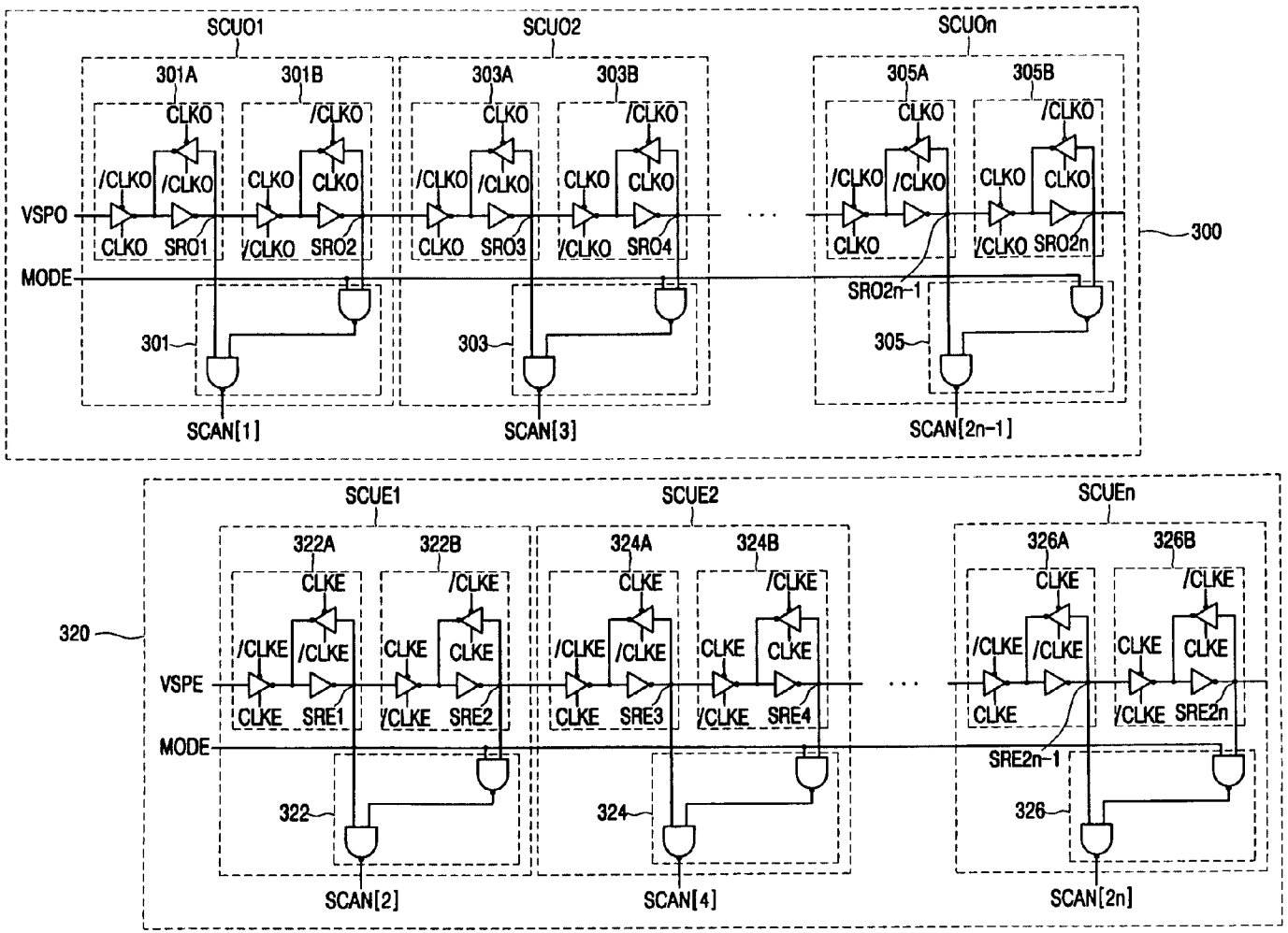
FIG. 4 shows a circuit diagram of the scan driver according to the first exemplary embodiment of the present invention.

FIG. 4 shows a circuit diagram of the scan driver according to the first exemplary embodiment of the present invention.

Referring to FIG. 4, the odd-number scan signal generator 300 and the even-number scan signal generator 320 include scan units as illustrated in FIG. 2 and described above.

The output signal at terminal SC, as shown on FIG. 2, from the second NAND gate of each of the scan units constitutes a scan signal out SCAN[1,2, . . . , 2*n*−1,2*n*].

Each of the scan units of the odd-number scan signal generator 300 receives an odd-number clock signal CLKO and outputs a synchronized odd-number scan signal SCAN[1, 3, . . . ,2*n*−1]. Each of the scan units of the even-number scan signal generator 320 receives an even-number clock signal CLKE and outputs a synchronized even-number scan signal SCAN[2,4, . . . ,2*n*].

Figure 5A:
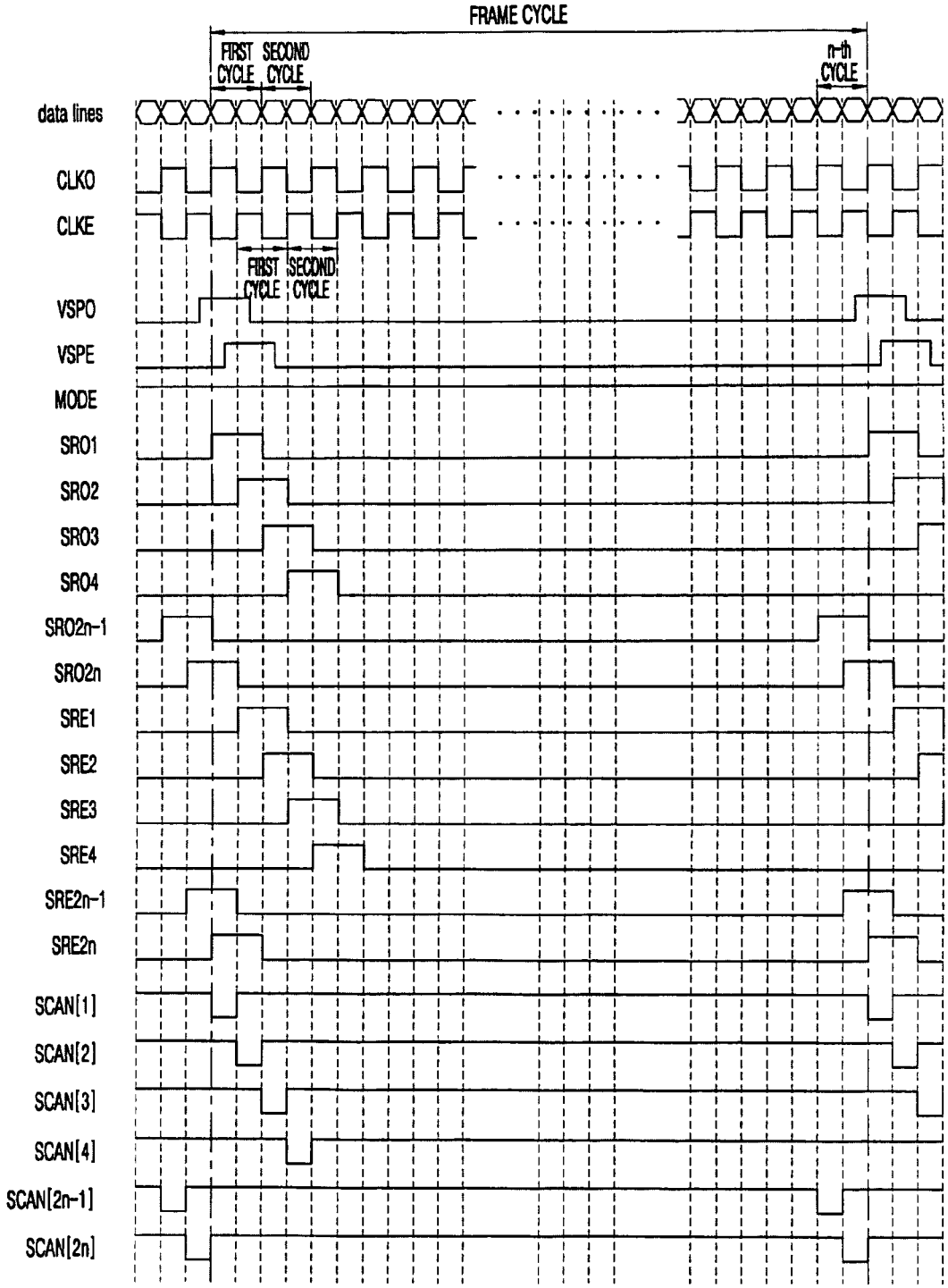
FIG. 5A shows a timing diagram illustrating progressive scanning operation of the scan driver shown in FIG. 4 when the mode selection signal input is high.

FIG. 5A shows a timing diagram illustrating progressive scanning operation of the scan driver shown in FIG. 4 when the mode selection signal input is high.

Figure 5B:
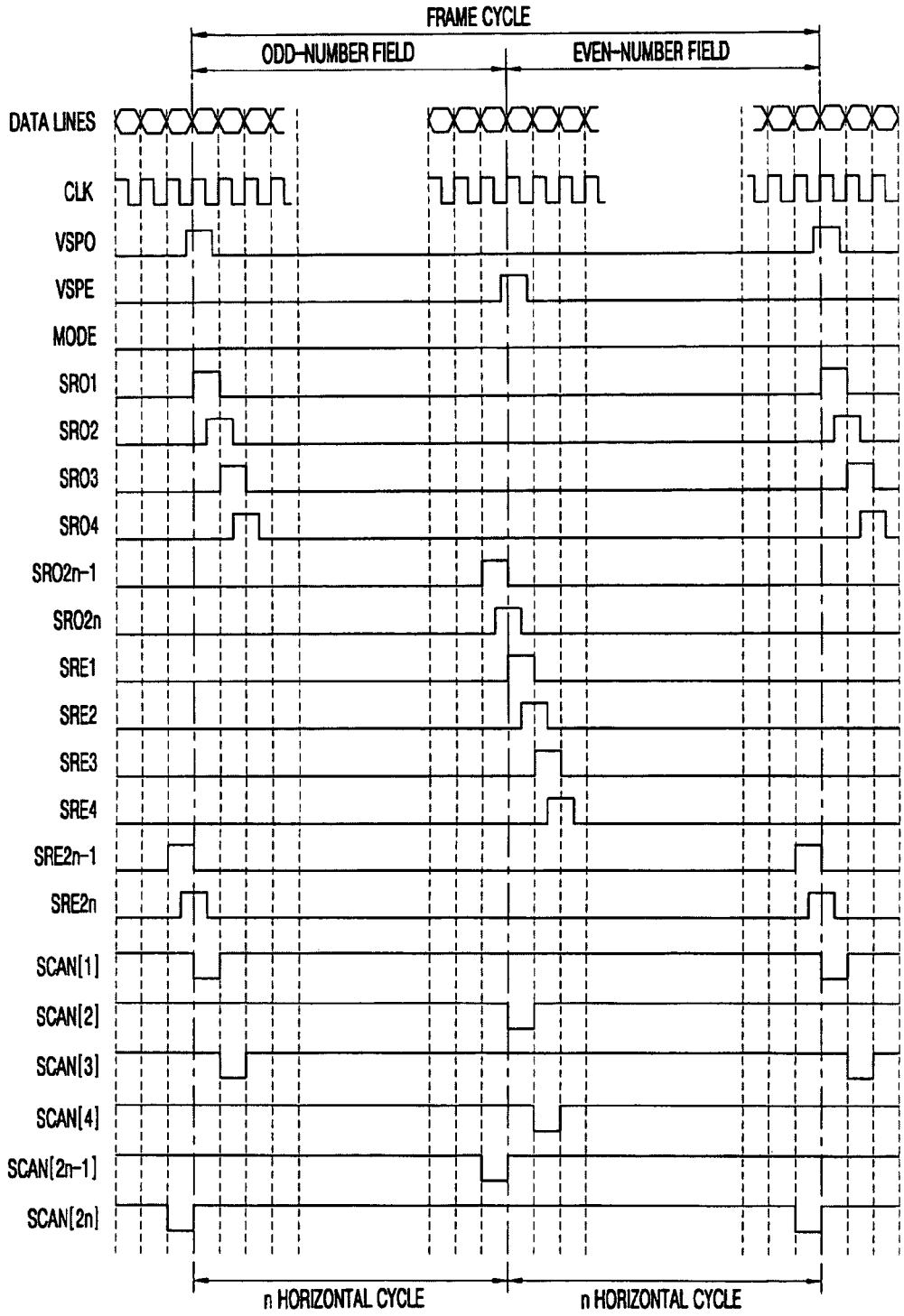
FIG. 5B shows a timing diagram illustrating interlaced scanning operation of the scan driver shown in FIG. 4 when the mode selection signal input is low.

FIG. 5B shows a timing diagram illustrating interlaced scanning operation of the scan driver shown in FIG. 4 when the mode selection signal input is low.

Hereinafter, the progressive scanning shown in FIG. 5A will be described with reference to the circuit diagram of FIG. 4.

A first odd-number scan unit SCUO1 of an odd-number scan signal generator 300 receives an odd-number start pulse VSPO. The first odd-number scan unit SCUO1 samples the odd-number start pulse VSPO on a rising edge of an odd-number clock signal CLKO.

Accordingly, a first latch 301A of the first odd-number scan unit SCUO1 outputs an output signal SRO1 at a high level during a first cycle of the odd-number clock signal CLKO. Also, a second latch 301B of the first odd-number scan unit SCUO1 samples the output signal SRO1 on a falling edge of the first cycle of the odd-number clock signal CLKO and outputs an output signal SRO2 during the low-level period. The output signal SRO2 of the first odd-number scan unit SCUO1 is input to a second odd-number scan unit SCUO2 and input to a first scan signal former 301, which is an odd-number scan signal former of the first odd-number scan unit SCUO1.

In the progressive scan method, the mode selection signal MODE is set to a high level. Accordingly, a first NAND gate of the first scan signal former 301 inverts the output signal SRO2 of the second latch 301B of the first odd-number scan unit SCUO1 and outputs the inverted signal. The inverted signal of the output signal SRO2 is input to a second NAND gate of the first scan signal former 301, along with the output signal SRO1 of the first latch 301A of the first odd-number scan unit SCUO1.

The second NAND gate of the first scan signal former 301 outputs a low-level signal only when the two input signals are both at a high level. Accordingly, a first scan signal SCAN[1] is at a low level only when the output signal SRO1 is at a high level and the output signal SRO2 is at a low level. Thus, the first scan signal SCAN[1] is at a low level in the high-level period of the first cycle of the odd-number clock signal CLKO.

The output signal SRO2, which is input to the second odd-number scan unit SCUO2, is sampled on a rising edge of a second cycle of the odd-number clock signal CLKO. The second odd-number scan unit SCUO2 then performs the same operation as described above with respect to the first odd-number scan unit SCUO1, and outputs output signal SRO3, SRO4, and scan signal SCAN[3]. This operation continues sequentially through the odd-number scan units, where the outcome of an operation is: an n-th odd-number scan signal unit SCUOn outputs a $2n-1$-th scan signal SCAN[$2n-1$] at a low level during a high-level period of an n-th cycle of the odd-number clock signal CLKO.

Also, a first even-number scan unit SCUE1 of an even-number signal generator 320 receives an even-number start pulse VSPE. There may be a phase difference of ½ a clock cycle between the even-number start pulse VSPE and the odd-number start pulse VSPO. Also, the even-number clock signal CLKE may have a waveform that is obtained by inverting the waveform of the odd-number clock signal CLKO.

The first even-number scan unit SCUE1 samples the even-number start pulse VSPE on a rising edge of an even-number clock signal CLKE. Accordingly, a first latch 322A of the first even-number scan unit SCUE1 outputs an output signal SRE1 at a high level during a first cycle of the even-number clock signal CLKE.

Also, a second latch 322B of the first even-number scan unit SCUE1 samples the output signal SRE1 on a falling edge of the first cycle of the even-number clock signal CLKE and outputs an output signal SRE2 during the low-level period. The output signal SRE2 of the first even-number scan unit SCUE1 is input to a second even-number scan unit SCUE2 and input to a second scan signal former 322, which is an even-number scan signal former of the first even-number scan unit SCUE1.

In the progressive scan method, the mode selection signal MODE is set to a high level. Accordingly, as described for the odd-number scan unit, a second scan signal SCAN[2] is at a low level only when the output signal SRE1 is at a high level and the output signal SRE2 is at a low level. Thus, the second scan signal SCAN[2] is at a low level in the high-level period of the first cycle of the even-number clock signal CLKE.

The output signal SRE2, which is input to the second even-number scan unit SCUE2, is sampled on a rising edge of a second cycle of the even-number clock signal CLKE. The second even-number scan unit SCUE2 then performs the same operation as described above with respect to the first even-number scan unit SCUE1, and outputs output signal SRE3, SRE4 and scan signal SCAN[4]. This operation continues sequentially through even-number scan units, where the outcome of an operation is: an n-th even-number scan signal unit SCUEn outputs a $2n$-th scan signal SCAN[$2n$] at a low level during a high-level period of an n-th cycle of the even-number clock signal CLKE.

Therefore, scan signals SCAN[1,2, . . . ,$2n-1$, $2n$] are sequentially output with a phase difference of ½ a clock cycle.

Hereinafter, the interlaced scanning shown in FIG. 5B will be described with reference to the circuit diagram of FIG. 4.

A frame, which is a unit of time required to display an image, is divided into an odd-number field period and an even-number field period. In order to perform interlaced scanning, the odd-number scan signal generator 300 generates odd-number scan signals SCAN[1,3, . . . ,$2n-1$] for the odd-number field period. The even-number scan signal generator 320 generates even-number scan signals SCAN[2, 4, . . . ,$2n$] for the even-number field period.

Further, an odd-number clock signal CLKO has the same waveform as an even-number clock signal CLKE. Accordingly, to facilitate ease of description, clock signal input into the odd-number scan signal generator 300 and the even-number scan signal generator 320 will be simply described as clock signal CLK.

First, just before the odd-number field period starts, an odd-number start pulse VSPO is input to a first odd-number scan unit SCUO1 of the odd-number scan signal generator 300. The first odd-number scan unit SCUO1 samples the odd-number start pulse VSPO on a rising edge of the clock signal CLK.

A first latch 301A of the first odd-number scan unit SCUO1 outputs an output signal SRO1 at a high level during a first cycle of the clock signal CLK. A second latch 301B of the first odd-number scan unit SCUO1 samples the output signal SRO1 on a falling edge of the first cycle of the clock signal CLK and outputs an output signal SRO2 during a low level of a first cycle and a high level of a second cycle of the clock signal CLK. The output signal SRO2 of the first odd-number scan unit SCUO1 is input to a second odd-number scan unit SCUO2 and input to a first scan signal former 301 of the first odd-number scan unit SCUO1.

In the interlaced scan method, a mode selection signal MODE is set to a low level. Thus, a first NAND gate of the first scan signal former 301 outputs a high-level signal irrespective of the output signal SRO2.

The second NAND gate receives the output signal SRO1 of the first latch 301A of the first odd-number scan unit SCUO1 and the high-level output signal of the first NAND gate. Accordingly, the second NAND gate inverts the output signal SRO1 and outputs the inverted signal. Thus, a first scan signal SCAN[1] is at a low level when output signal SRO1 is at a high level, during the first cycle of the clock signal CLK.

The second odd-number scan unit SCUO2 then performs the same operation as described above with respect to the first odd-number scan unit SCUO1, and outputs output signals SRO3, SRO4, and scan signal SCAN[3]. This operation continues sequentially through the odd-number scan units, where the outcome of an operation is: an n-th odd-number scan signal unit SCUOn outputs a $2n-1$-th scan signal SCAN[$2n-1$] at a low level during an n-th cycle of the clock signal CLK in the odd-number field period.

After the odd-number field period, an even-number field period starts. Just before the even-number field period starts, an even-number start pulse VSPE is input to a first even-number scan unit SCUE1 of the even-number scan signal generator 320.

The first even-number scan unit SCUE1 samples the even-number start pulse VSPE on a rising edge of a clock signal CLK. For ease of description of the even-number field period, the number of the clock cycles starts over in the even-field number period. Therefore, the first cycle of clock signal CLK when describing the even-number field period refers to the first cycle of clock signal CLK in the even-number field period.

A first latch 322A of the first even-number scan unit SCUE1 outputs an output signal SRE1 at a high level during a first cycle of the clock signal CLK in the even-number field period. A second latch 322B of the first even-number scan unit SCUE1 samples the output signal SRE1 on a falling edge of the first cycle of the clock signal CLK in the even-number field period, and outputs an output signal SRE2 during a low level of a first cycle and a high level of a second cycle of the clock signal CLK. The output signal SRE2 of the first even-number scan unit SCUE1 is input to a second even-number scan unit SCUE2 and input to a second scan signal former 322 of the first even-number scan unit SCUE1.

In the interlaced scan method, the mode selection signal MODE is set to a low level. Thus, the first NAND gate of the second scan signal former 322 outputs a high-level signal irrespective of the output signal SRE2. The second NAND gate receives the output signal SRE1 of the first latch 322A of the first even-number scan unit SCUE1 and the high-level output signal of the first NAND gate. Accordingly, the second NAND gate inverts the output signal SRE1 and outputs the inverted signal. Thus, a second scan signal SCAN[2] is at a low level when output signal SRE1 is at a high level, in the first cycle of the clock signal CLK in the even-number field period.

The output signal SRE2 is sampled via the second even-number scan unit SCUE2 on a rising edge of a second cycle of the clock signal CLK in the even-number field period. The second even-number scan unit SCUE2 then performs the same operation as described above with respect to the first even-number scan unit SCUE1, and outputs output signals SRE3, SRE4, and scan signal SCAN[4]. This operation continues sequentially through the even-number scan units, where the outcome of the operation is: an n-th even-number scan signal unit SCUEn outputs a $2n$-th scan signal SCAN [$2n$] being at a low level during an n-th cycle in the even-number field period of the clock signal CLK.

Accordingly, as shown in FIG. 5B, when the mode selection signal MODE is at a low level, the scan driver according to the present embodiment of the present invention performs the interlaced scanning. The odd-number scan signals are sequentially applied to odd-numbered scan lines during ½ a cycle of frame, and the even-numbered scan signals are sequentially applied to even-numbered scan lines during ½ the cycle of frame.

Embodiment 2

Figure 6:
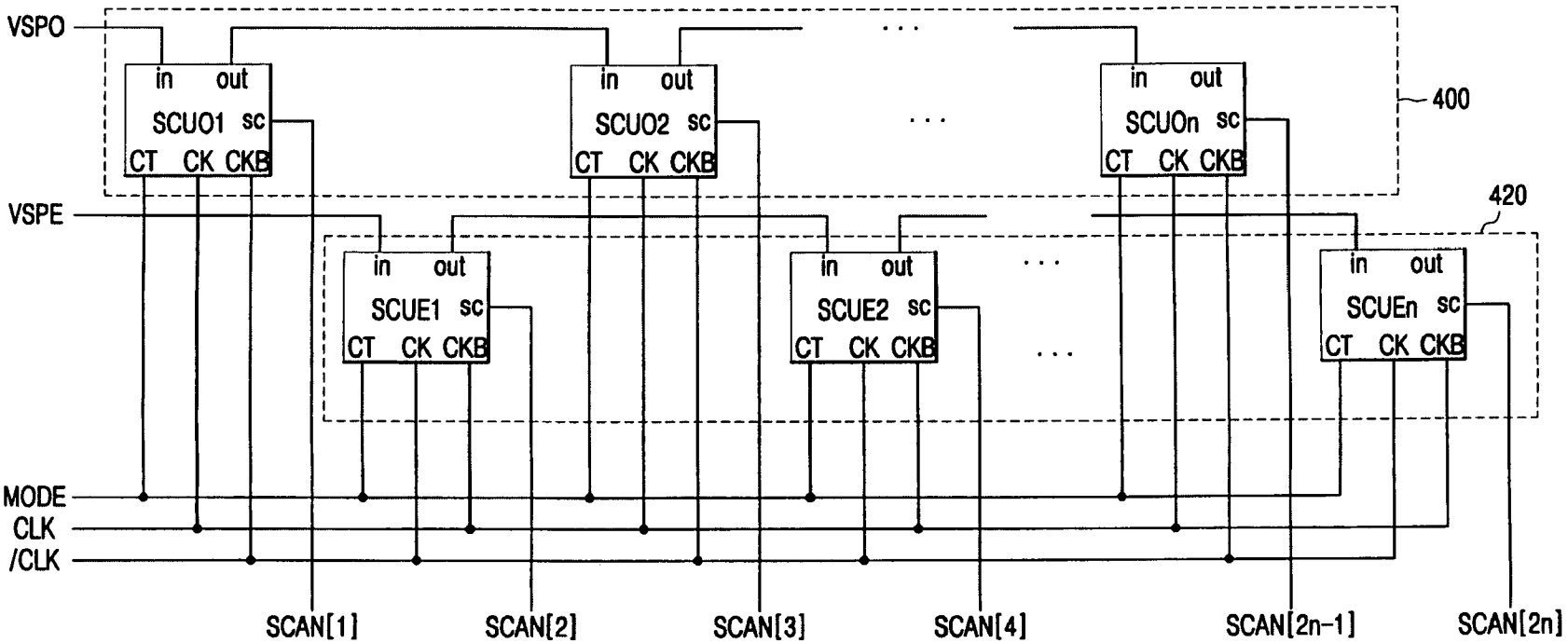
FIG. 6 shows a block diagram of a scan driver that selectively performs progressive scanning and interlaced scanning according to a second exemplary embodiment of the present invention.

FIG. 6 shows a block diagram of a scan driver that selectively performs progressive scanning and interlaced scanning according to a second exemplary embodiment of the present invention.

Referring to FIG. 6, the scan driver of the present embodiment includes an odd-number scan signal generator 400 and an even-number scan signal generator 420. The odd-number scan signal generator 400 and the even-numbered scan signal generator 420 receive a clock signal CLK.

In the first exemplary embodiment, the odd-number scan signal generator 100 receives the odd-number clock signal CLKO and the even-number scan signal generator 120 receives the even-number clock signal CLKE. In the second exemplary embodiment, the odd-number scan signal generator 400 and the even-number scan signal generator 420 both receive a common clock signal CLK. However, the odd-number scan signal generator 400 and the even-number scan signal generator 420 receive the clock signal CLK at different terminals of the individual scan units. Specifically, the odd-number scan units receive clock signal CLK at terminal CK and inverse clock signal /CLK at terminal CKB. The even-number scan units receive clock signal CLK at terminal CKB, and inverse clock signal /CLK at terminal CK.

The odd-number scan signal generator 400 includes a plurality of odd-number scan signal units, the structure of which is as described above with respect to the plurality of odd-number scan signal units illustrated in FIG. 1. The odd-number scan units output odd-number scan signals SCAN[1, 3, . . . ,$2n-1$] from terminals SC at intervals of one cycle of the clock signal CLK.

The even-number scan signal generator 420 includes a plurality of even-number scan signal units, the structure of which is as described above with respect to the plurality of even-number scan signal units illustrated in FIG. 1. However, because even-number scan signal generator 420 receives the inverse clock signal /CLK at terminal CK, the input data is sampled on the falling edge of clock signal CLK and output on the rising edge of clock signal CLK.

The even-number scan units output even-number scan signals SCAN[2,4, . . . ,$2n$] from terminals SC at intervals of one cycle of the clock signal CLK.

Figure 7:
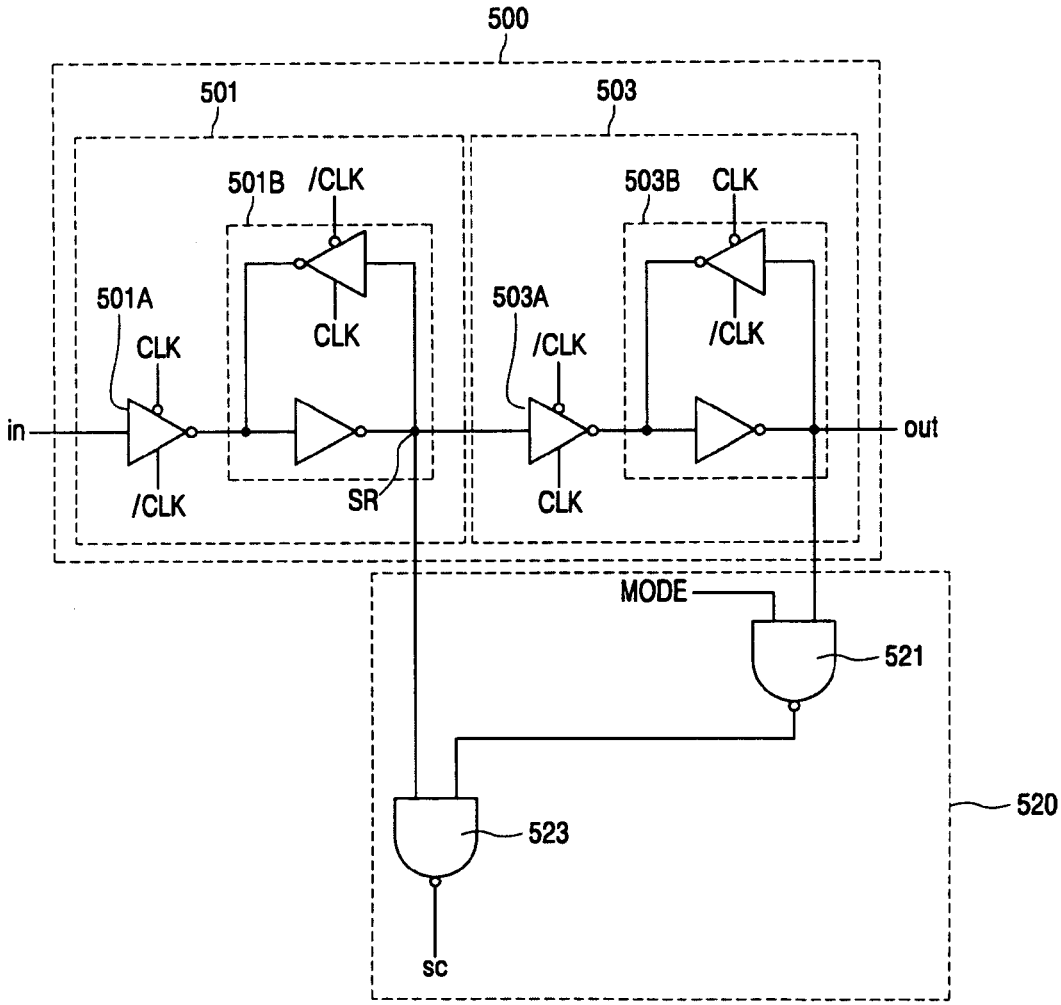
FIG. 7 shows a circuit diagram of an even-number scan unit according to the second exemplary embodiment of the present invention.

FIG. 7 shows a circuit diagram of an even-number scan unit according to the second exemplary embodiment of the present invention.

The odd-number scan unit of the second embodiment has the same components and uses the same clock signal as the scan unit shown in FIG. 2. Accordingly, a description of the odd-number scan unit will be omitted here, and only the structure and operations of the even-number scan unit will be described.

The even-number scan unit shown in FIG. 7 has the same components as the scan unit shown in FIG. 2, but the even-number scan unit of FIG. 7 uses an inverted signal of the clock signal that is used for the scan unit shown in FIG. 2.

Referring to FIG. 7, the even-number scan unit includes a flip-flop 500 and a scan signal former 520.

The flip-flop 500 samples data on a falling edge of a clock signal CLK and outputs data on a rising edge that is delayed by ½ a clock cycle after sampling. For this operation, the flip-flop 500 includes a first latch 501 and a second latch 503, which are coupled in series.

The first latch 501 includes a first sampler 501A and a first holder 501B. The first sampler 501A samples an input signal on a falling edge of a clock signal CLK and outputs the input signal as output signal SR in a low-level period of a clock signal CLK. The input of the input signal is terminated on a rising edge of the clock signal CLK. The first holder 201B samples the input signal on the rising edge of the clock signal CLK, and stores and outputs the input signal during a subsequent high-level period of the clock signal CLK.

The second latch 503 includes a second sampler 503A and a second holder 503B. The second sampler 503A samples the output signal SR from the first latch 501 on the rising edge of the clock cycle, and outputs the output signal in the high-level period of the clock signal. The input of the output signal SR is terminated on a falling edge of the clock signal. The second holder 503B samples the output signal out in the falling edge of the clock cycle, and stores and outputs the output signal out in the low-level period of the clock signal.

The scan signal former 520 includes a first NAND gate 521 and a second NAND gate 523. The first NAND gate 521 receives a mode selection signal MODE and the output signal out of the second latch 503.

When the mode selection signal MODE is at a low level, the first NAND gate 521 outputs a high-level signal irrespective of the output signal of the second latch 503. When the mode selection signal MODE is at a high level, the first NAND gate 521 inverts the output signal of the second latch 503 and outputs the inverted signal.

The second NAND gate 523 receives the output signal SR of the first latch 501 and the output signal of the first NAND gate 521.

When the first NAND gate 521 outputs a high-level signal, the second NAND gate 523 inverts the output signal SR of the first latch 501 and outputs the inverted signal. Therefore, second NAND gate 523 outs a low-level signal when output signal SR is a high-level signal.

When the mode selection signal MODE is at a high level, the second NAND gate 523 performs a NAND operation on the inverted output signal of the second latch 503 and the output signal SR of the first latch 501. Accordingly, the second NAND gate 523 outputs a low-level signal via an output terminal SC when the first latch 501 outputs a high-level signal, the second latch 503 outputs a low-level signal, and the mode selection signal is a high-level signal.

Figure 8A:
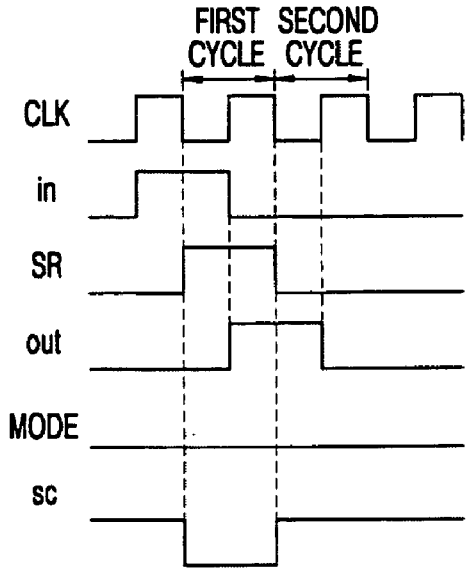
FIG. 8A shows a timing diagram illustrating operation of the even-number scan unit shown in FIG. 7 when the mode selection signal input is low.

FIG. 8A shows a timing diagram illustrating operation of the even-number scan unit shown in FIG. 7 when the mode selection signal input is low.

Figure 8B:
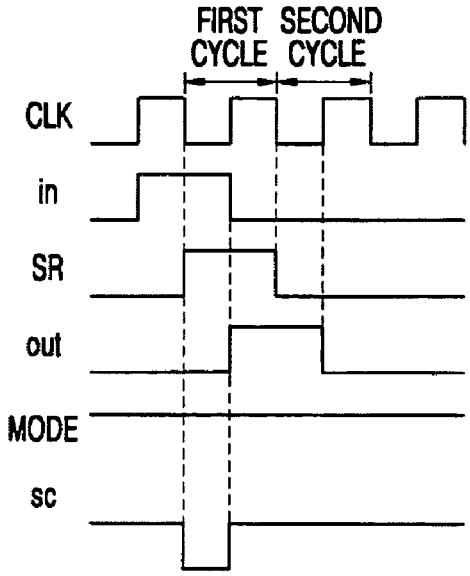
FIG. 8B shows a timing diagram illustrating operation of the even-number scan unit shown in FIG. 7 when the mode selection signal input is high.

FIG. 8B shows a timing diagram illustrating operation of the even-number scan unit shown in FIG. 7 when the mode selection signal input is high.

Referring to FIG. 8A, an input signal in is sampled and output by the first latch 501 on a falling edge of a first cycle of a clock signal CLK. Since the input signal in is at a high level on the falling edge of the first cycle of the clock signal CLK, output signal SR from the first latch 501 is a high-level signal. Also, since the sampled output signal is stored and output by first holder 501B during a high-level period of the first cycle of the clock signal CLK, the output signal SR of the first latch 501 remains at a high level for the high-level period of the first cycle of the clock signal CLK.

The first latch 501 samples the input signal in and outputs the sampled signal on a falling edge of a second cycle of the clock signal CLK. Since the input signal in is at a low level on the falling edge of the second cycle of the clock signal CLK, the output signal SR of the first latch 501 is a low-level signal.

The second latch 503 samples the output signal SR of the first latch 501 on a rising edge of the clock signal CLK and outputs the sampled signal in a high-level period. Since the output signal SR is at a high level on the rising edge of the first cycle of the clock signal CLK, a high-level signal is output via an output terminal out of the second latch 503.

Also, since the output signal SR is at a low level on a rising edge of a second cycle of the clock signal CLK, a low-level signal is output via the output terminal out of the second latch 503.

Since the mode selection signal MODE is at a low level, the first NAND gate 521 shown in FIG. 7 outputs a high-level signal irrespective of the output signal of the second latch 503. The high-level output signal of the first NAND gate 521 is input to the second NAND gate 523. The second NAND gate 523 inverts the output signal SR of the first latch 501 and outputs the inverted signal. Thus, a low-level signal is output via the output terminal SC of the even-number scan unit when output signal SR is at a high level, during the first cycle of the clock signal CLK.

Referring to FIG. 8B, the sampling of an input signal in by the first latch 501 and the sampling of an output signal SR of the first latch 501 via the second latch 503 are the same as described above with reference to FIG. 8A.

Accordingly, the output signal SR of the first latch 501 and the signal output from the output terminal out of the second latch 503 have the same waveforms as the signals of FIG. 8A. However, since the mode selection signal MODE is at a high level, the first NAND gate 521 inverts an output signal out of the second latch 503. An output signal of the first NAND gate 521 is input to the second NAND gate 523. Also, an output signal SR of the first latch 501 is input to the second NAND gate 523. The second NAND gate 523 outputs a low-level signal only when all the input data are at a high level. The output signal of the first NAND gate 521 is at a high level on the low-level period of the first cycle of the clock signal CLK and the high-level period of the second cycle of the clock signal CLK. Thus, a low-level signal is output via the output terminal SC during a low-level period of a first cycle of a clock signal CLK.

When the mode selection signal MODE is at a low level, the even-number scan unit inverts an output signal of a first latch and outputs the inverted signal via an output terminal SC. When the mode selection signal MODE is at a high level, the even-number scan unit performs a NAND operation on the output signal of the first latch and the inverted output signal of the second latch and outputs the result. Where SCAN denotes data output from the output terminal SC, SR denotes an output signal of the first latch, and OUT denotes an output signal of the second latch, SCAN can be expressed as in the following Equation 1:

$$\mathrm{SCAN}=(SR\cdot\mathrm{OUT}')'=SR'+\mathrm{OUT} \quad (1)$$

In Equation 1, SCAN may be expressed as a logical sum of an inverted output signal SR' of the first latch and the output signal OUT of the second latch.

Figure 9:
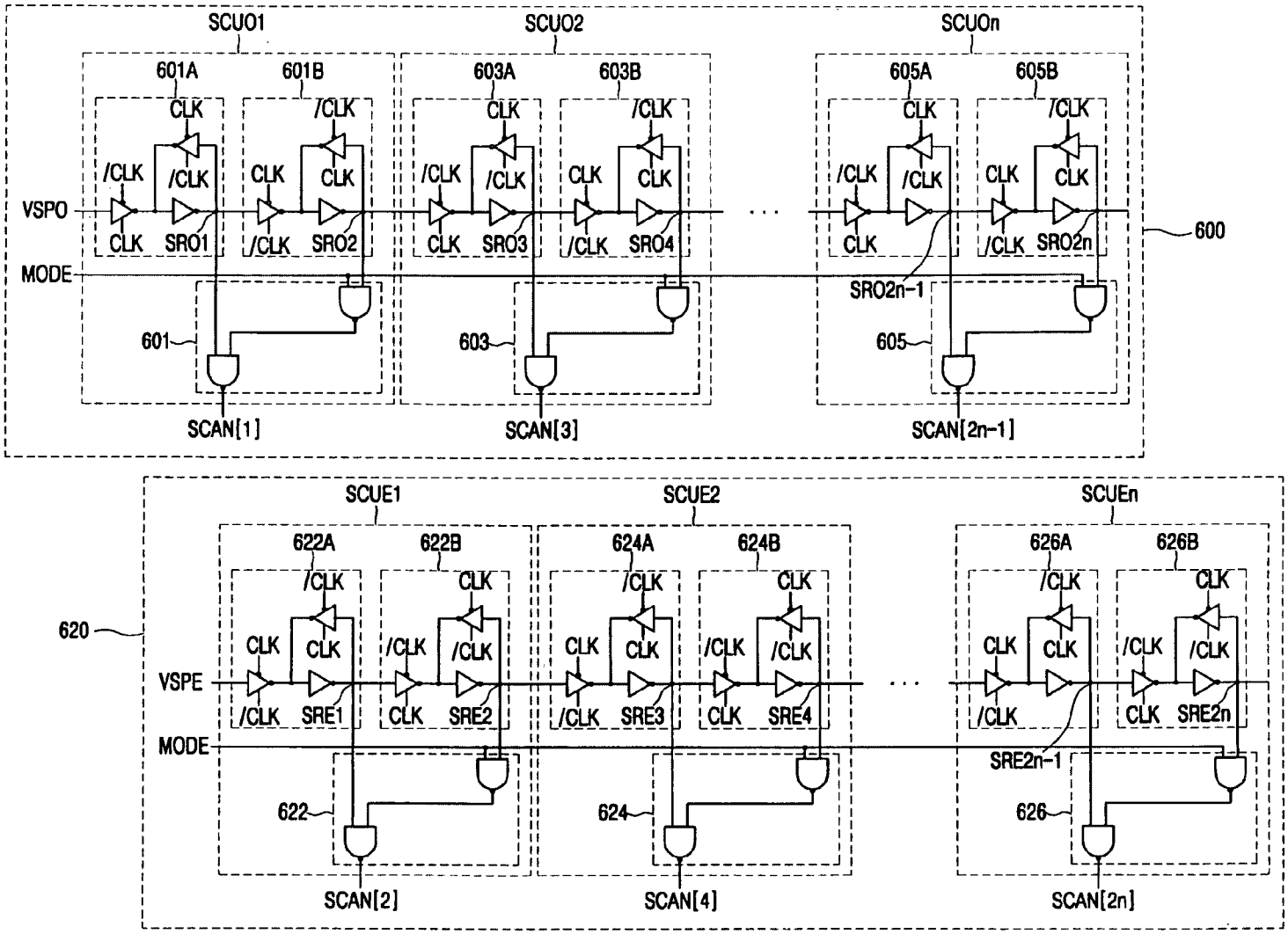
FIG. 9 shows a circuit diagram of the scan driver according to the second exemplary embodiment of the present invention.

FIG. 9 shows a circuit diagram of the scan driver according to the second exemplary embodiment of the present invention.

Referring to FIG. 9, the scan unit shown in FIG. 2 and described above can be applied to a plurality of odd-number scan units connected in series of an odd-number scan signal generator 600, and the even-number scan unit shown in FIG.

7 and described above can be applied to a plurality of scan units connected in series of an even-number scan signal generator 620.

An output signal of the second NAND gate of each of the scan units constitutes a scan signal SCAN[1,2, . . . ,2*n*−1, 2*n*]. Each of the scan units of the odd-number scan signal generator 600 receives a clock signal CLK and outputs a synchronized odd-number scan signal SCAN[1,3, . . . ,2*n*−1]. Each of the scan units of the even-number scan signal generator 620 receives the clock signal CLK and outputs a synchronized even-number scan signal SCAN[2,4, . . . ,2*n*].

Figure 10A:
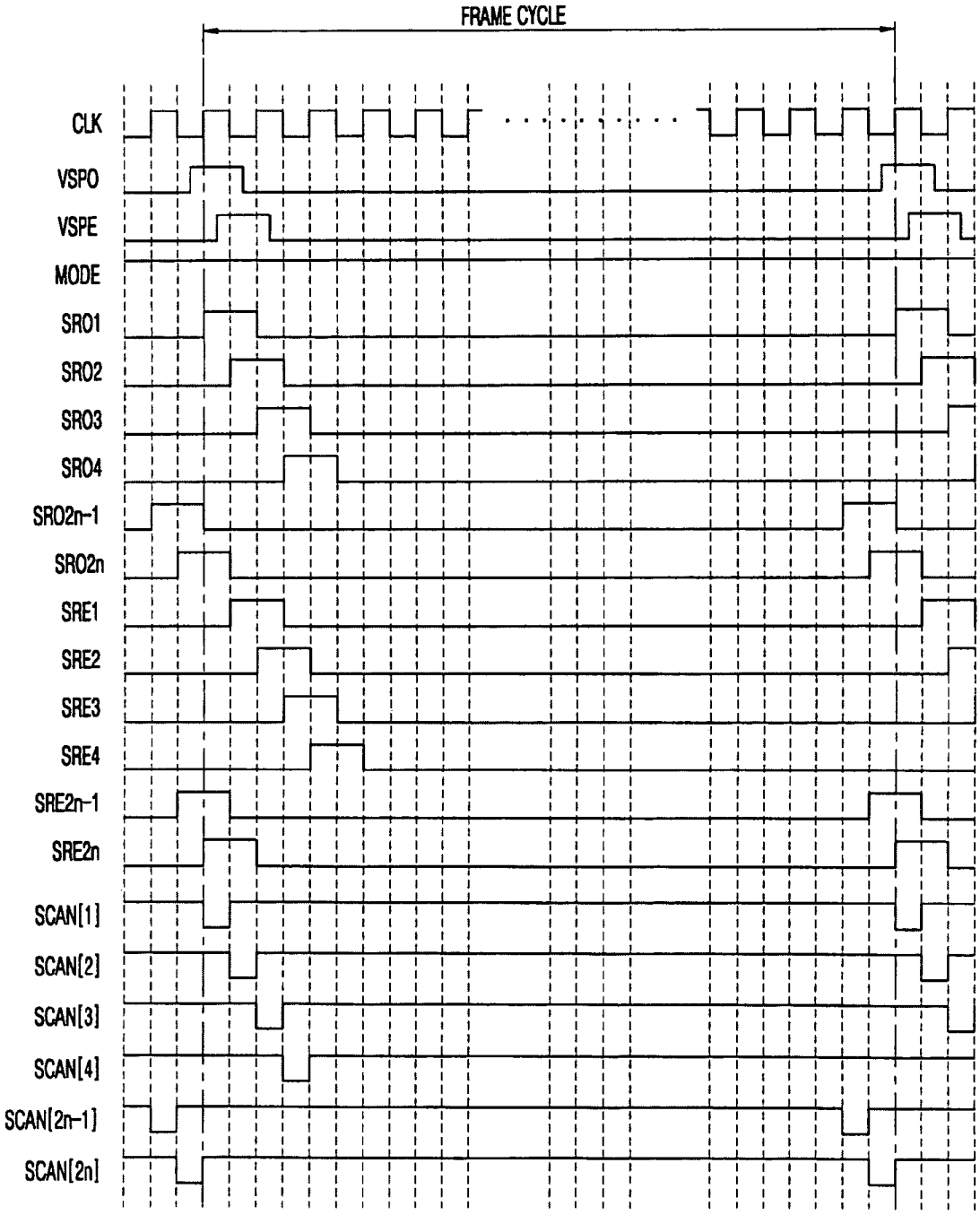
FIG. 10A shows a timing diagram illustrating progressive scanning operation of the scan driver shown in FIG. 9 when the mode selection signal input is high.

FIG. 10A shows a timing diagram illustrating progressive scanning operation of the scan driver shown in FIG. 9 when the mode selection signal input is high.

Figure 10B:
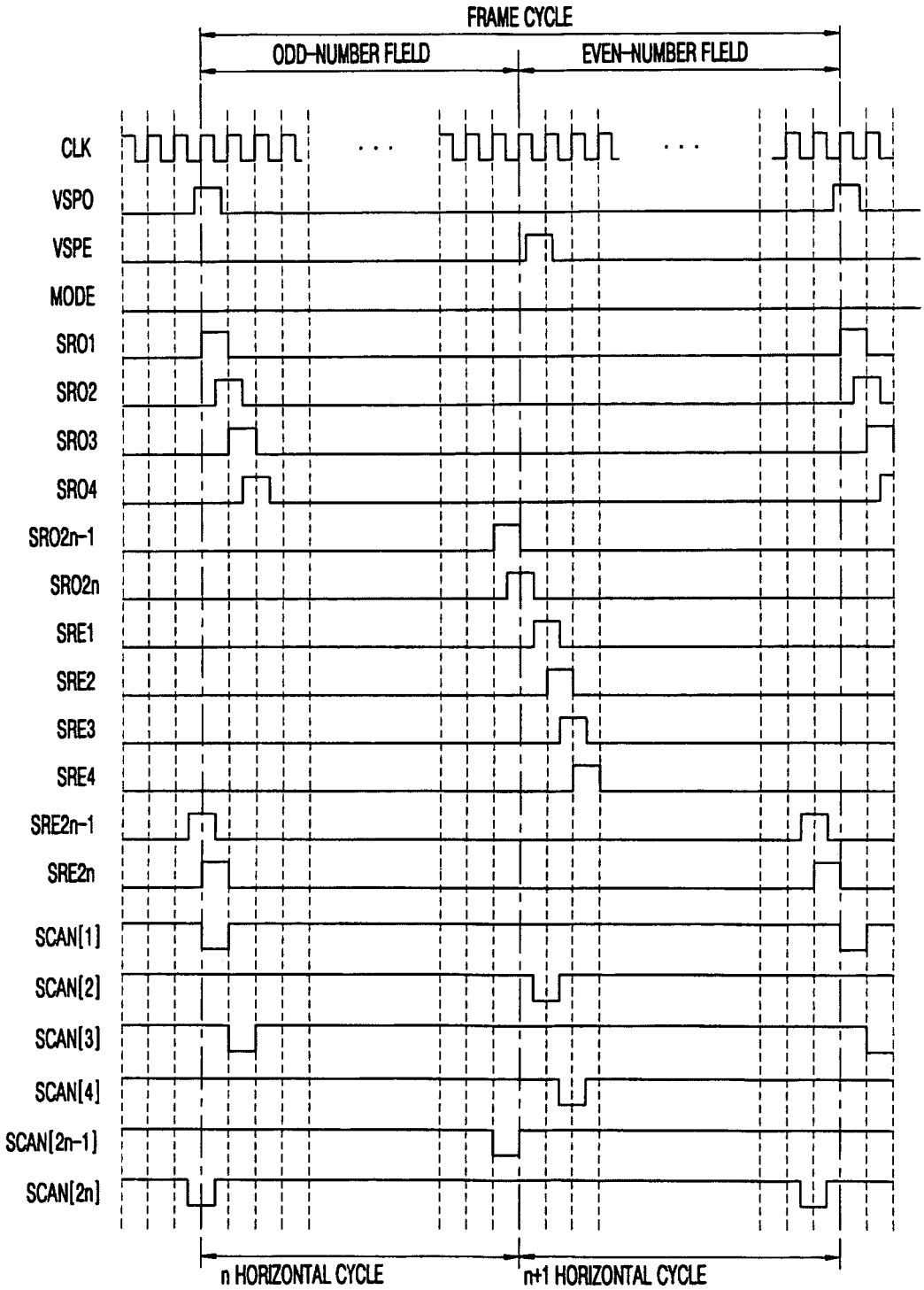
FIG. 10B shows a timing diagram illustrating interlaced scanning operation of the scan driver shown in FIG. 9 when the mode selection signal input is low.

FIG. 10B shows a timing diagram illustrating interlaced scanning operation of the scan driver shown in FIG. 9 when the mode selection signal input is low.

Hereinafter, the progressive scanning shown in FIG. 10A will be described with reference to the circuit diagram of FIG. 9.

First, a first odd-number scan unit SCUO1 of the odd-number scan signal generator 600 receives an odd-number start pulse VSPO. The first odd-number scan unit SCUO1 samples the odd-number start pulse VSPO on a rising edge of a clock signal CLK.

Accordingly, a first latch 601A of the first odd-number scan unit SCUO1 outputs an output signal SRO1 at a high level during a first cycle of the clock signal CLK. Also, a second latch 601B of the first odd-number scan unit SCUO1 samples the output signal SRO1 on a falling edge of the first cycle of the clock signal CLK and outputs an output signal SRO2 during the low-level period. The output signal SRO2 of the first odd-number scan unit SCUO1 is input to a second odd-number scan unit SCUO2 and input to a first scan signal former 601 of the first odd-number scan unit SCUO1.

In the progressive scan method, a mode selection signal MODE is set to a high level. Thus, a first NAND gate of the first scan signal former 601 inverts the output signal SRO2 of the second latch 601B of the first odd-number scan unit SCUO1 and outputs the inverted signal. The inverted signal of the output signal SRO2 is input to a second NAND gate of the first scan signal former 601, along with the output signal SRO1 of the first latch 601A of the first odd-number scan unit SCUO1.

The second NAND gate of the first scan signal former 601 outputs a low-level signal only when the two input signals are both at a high level. Accordingly, a first scan signal SCAN[1] is at a low level only when the output signal SRO1 is at a high level and the output signal SRO2 is at a low level. Thus, the first scan signal SCAN[1] is at a low level in a high-level period of the first cycle of the clock signal.

The output signal SRO2 input to the second odd-number scan unit SCUO2 is sampled on a rising edge of a second cycle of the clock signal CLK. The second odd-number scan unit SCUO2 then performs the same operation as described above with respect to the first odd-number scan unit SCUO1, and outputs output signal SRO3, SRO4, and scan signal SCAN[3]. This operation continues sequentially through the odd-number scan units, where the outcome of an operation is: an n-th odd-number scan signal unit SCUOn outputs a 2*n*−1-th scan signal SCAN[2*n*−1] at a low level during a high-level period of an n-th cycle of the clock signal CLK.

Also, an even-number start pulse VSPE is input to a first even-number scan unit SCUE1 of the even-number scan signal generator 620. There may be a phase difference of ½ a clock cycle between the even-number start pulse VSPE and the odd-number start pulse VSPO.

The first even-number scan unit SCUE1 samples an even-number start pulse VSPE on a falling edge of a clock signal CLK. Accordingly, a first latch 622A of the first even-number scan unit SCUE1 outputs an output signal SRE1 at a high level in a high-level period of a first cycle of the clock signal CLK and in a low-level period of a second cycle thereof.

Also, a second latch 622B of the first even-number scan unit SCUE1 samples the output signal SRE1 on a rising edge of the second cycle of the clock signal CLK and outputs an output signal SRE2 during the high-level period. The output signal SRE2 of the first even-number scan unit SCUE1 is input to a second even-number scan unit SCUE2 and input to a second scan signal former 622 of the first even-number scan unit SCUE1.

In the progressive scan method, a mode selection signal MODE is set to a high level. Thus, as described for the odd-number scan unit NAND gates, a second scan signal SCAN[2] is at a low level when the output signal SRE1 is at a high level and the output signal SRE2 is at a low level. Thus, the second scan signal SCAN[2] is at a low level in a low-level period of the first cycle of the clock signal CLK.

The output signal SRE2 input to the second even-number scan unit SCUE2 is sampled on a falling edge of a second cycle of the clock signal CLK. The second even-number scan unit SCUE2 then performs the same operation as described above with respect to the first even-number scan unit SCUE1, and outputs output signal SRE3, SRE4 and scan signal SCAN [4]. This operation continues sequentially through even-number scan units, where the outcome of an operation is: an n-th even-number scan signal unit SCUEn outputs a 2*n*-th scan signal SCAN[2*n*] at a low level during a low-level period of an n-th cycle of the clock signal CLK.

Accordingly, the respective scan signals SCAN[1, 2, . . . ,2*n*−1,2*n*] are sequentially output with a phase difference of ½ a clock cycle.

Hereinafter, the interlaced scanning shown in FIG. 10B will be described with reference to the circuit diagram of FIG. 9.

A frame, which is a unit of time required to display an image, is divided into an odd-number field period and an even-number field period. In order to perform interlaced scanning, the odd-number scan signal generator 600 generates odd-number scan signals SCAN[1,3, . . . ,2*n*−1] for the odd-number field period. The even-number scan signal generator 620 outputs a signal having no data required for scanning in the odd-number field period.

For the even-number field period that follows the odd-number field period, the even-number scan signal generator 620 generates even-number scan signals SCAN[2,4, . . . ,2*n*]. The odd-number scan signal generator 600 outputs a signal having no data required for scanning in the even-number field period.

First, just before the odd-number field period starts, an odd-number start pulse VSPO is input to a first odd-number scan unit SCUO1 of the odd-number scan signal generator 600. The first odd-number scan unit SCUO1 samples the odd-number start pulse VSPO on a rising edge of the clock signal CLK.

A first latch 601A of the first odd-number scan unit SCUO1 outputs an output signal SRO1 at a high level during a first cycle of the clock signal CLK. A second latch 601B of the first odd-number scan unit SCUO1 samples the output signal SRO1 on a falling edge of the first cycle of the clock signal CLK and outputs an output signal SRO2 during the low-level period of the first cycle and the high-level period of the second cycle of the clock signal CLK. The output signal SRO2 of the first odd-number scan unit SCUO1 is input to a second odd-number scan unit SCUO2 and input to a first scan signal former 601 of the first odd-number scan unit SCUO1.

In the interlaced scan method, a mode selection signal MODE is set to a low level. Thus, a first NAND gate of the first scan signal former 601 outputs a high-level signal irrespective of the output signal SRO2.

The second NAND gate receives the output signal SRO1 of the first latch 601A of the first odd-number scan unit SCUO1 and the high-level output signal SRO2 of the second latch 601B. Accordingly, the second NAND gate inverts the output signal SRO1 and outputs the inverted signal. Thus, a first scan signal SCAN[1] is at a low level when output signal SRO1 is at a high level, during the first cycle of the clock signal CLK.

The output signal SRO2 is then sampled by the second odd-number scan unit SCUO2 on a rising edge of a second cycle of the clock signal CLK. The second odd-number scan unit SCUO2 then performs the same operation as described above with respect to the first odd-number scan unit SCUO1, and outputs output signals SRO3, SRO4, and scan signal SCAN[3]. This operation continues sequentially through the odd-number scan units, where the outcome of an operation is: an n-th odd-number scan signal unit SCUOn outputs a $2n-1$-th scan signal SCAN[$2n-1$] at a low level during an n-th cycle of the clock signal CLK in the odd-number field period.

After the odd-number field period, an even-number field period starts. Just before the even-number field period starts, an even-number start pulse VSPE is input to a first even-number scan unit SCUE1 of the even-number scan signal generator 620.

The first even-number scan unit SCUE1 samples the even-number start pulse VSPE on a falling edge of a clock signal CLK in the even-number field period. For ease of description of the even-number field period, the number of the clock cycles shall start over in the even-field number period. Therefore, the first cycle of clock signal CLK when describing the even-number field period refers to the first cycle of clock signal CLK in the even-number field period.

A first latch 622A of the first even-number scan unit SCUE1 outputs an output signal SRE1 at a high level during a low-level period of the first cycle of the clock signal CLK.

A second latch 622B of the first even-number scan unit SCUE1 samples the output signal SRE1 on a rising edge of the second cycle of the clock signal CLK and outputs an output signal SRE2 during the second cycle of the clock signal CLK. The output signal SRE2 of the first even-number scan unit SCUE1 is input to a second even-number scan unit SCUE2 and input to a second scan signal former 622 of the first even-number scan unit SCUE1.

In the interlaced scan method, the mode selection signal MODE is set to a low level. Thus, the first NAND gate of the second scan signal former 622 outputs a high-level signal irrespective of the output signal SRE2. The second NAND gate receives the output signal SRE1 of the first latch 622A of the first even-number scan unit SCUE1 and the high-level output signal SRE2 of the second latch 622B. Accordingly, the second NAND gate inverts the output signal SRE1 and outputs the inverted signal. Thus, a second scan signal SCAN [2] is at a low level when output signal SRE1 is at a high level, in the low-level period of the first cycle of clock signal CLK.

The output signal SRE2 is sampled via the second even-number scan unit SCUE2 on a falling edge of the second cycle of the clock signal CLK. The second even-number scan unit SCUE2 then performs the same operation as described above with respect to the first even-number scan unit SCUE1, and outputs output signals SRE3, SRE4, and scan signal SCAN [4]. This operation continues sequentially through the even-number scan units, where the outcome of an operation is: an n-th even-number scan signal unit SCUEn outputs a $2n$-th scan signal SCAN[$2n$] being at a low level during a low-level period of a n-th cycle and during a high-level period of a n+1-th cycle of the clock signal CLK in the even-number field period.

Accordingly, as shown in FIG. 10B, when the mode selection signal MODE is at a low level, the scan driver according to the present embodiment of the present invention performs the interlaced scanning. The odd-number scan signals are sequentially applied to odd-numbered scan lines during ½ a cycle of frame, and the even-numbered scan signals are sequentially applied to even-numbered scan lines during ½ the cycle of frame.

In the above-described process, it can be seen that a scan signal synchronized with a clock signal CLK is generated, and the scan driver can selectively perform progressive scanning and interlaced scanning in response to a mode selection signal.

Embodiment 3

Figure 11:
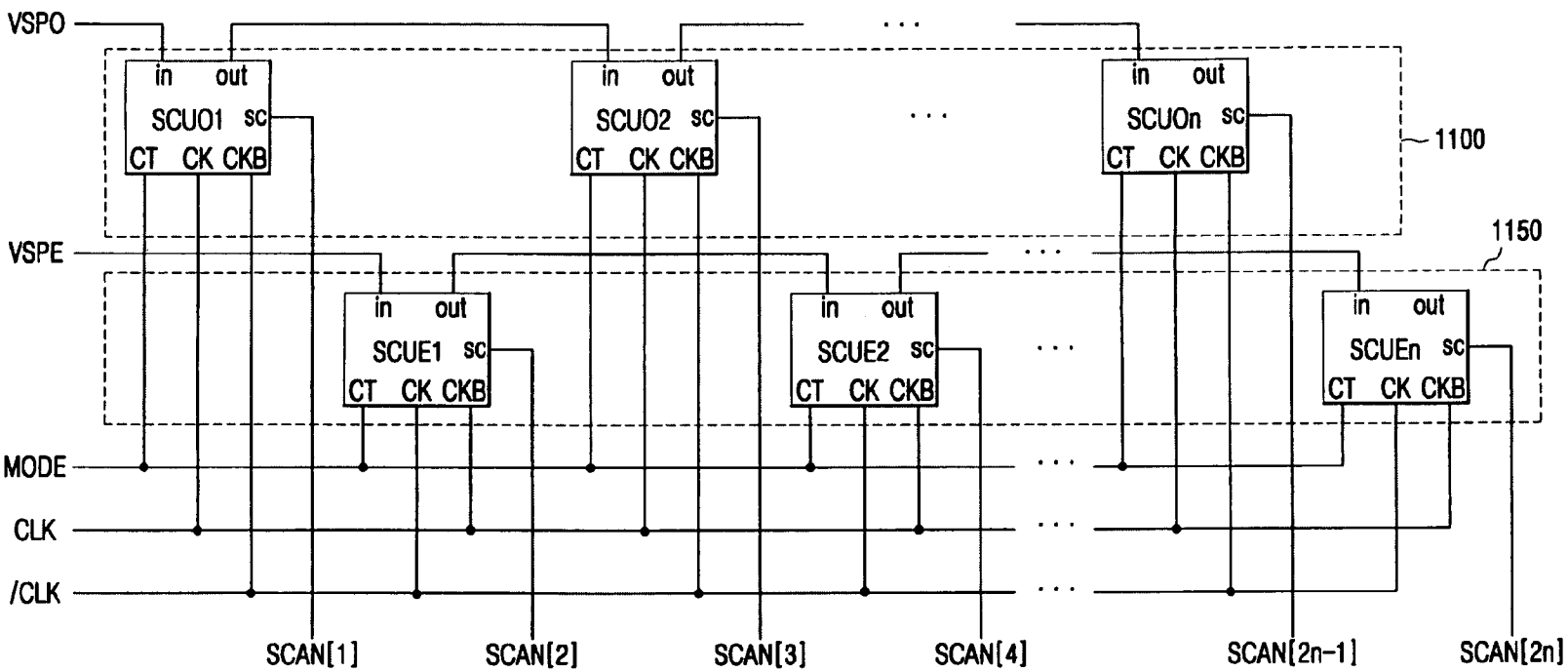
FIG. 11 shows a block diagram of a scan driver that selectively performs progressive scanning and interlaced scanning according to a third exemplary embodiment of the present invention.

FIG. 11 is a block diagram of a scan driver that selectively performs progressive scanning and interlaced scanning according to a third exemplary embodiment of the present invention.

Referring to FIG. 11, the scan driver of the present embodiment includes an odd-number scan signal generator 1100 and an even-number scan signal generator 1150, the description of which matches the description provided for the odd-number scan signal generator and even-number scan signal generator with reference to the scan driver in FIG. 6.

Figure 12:
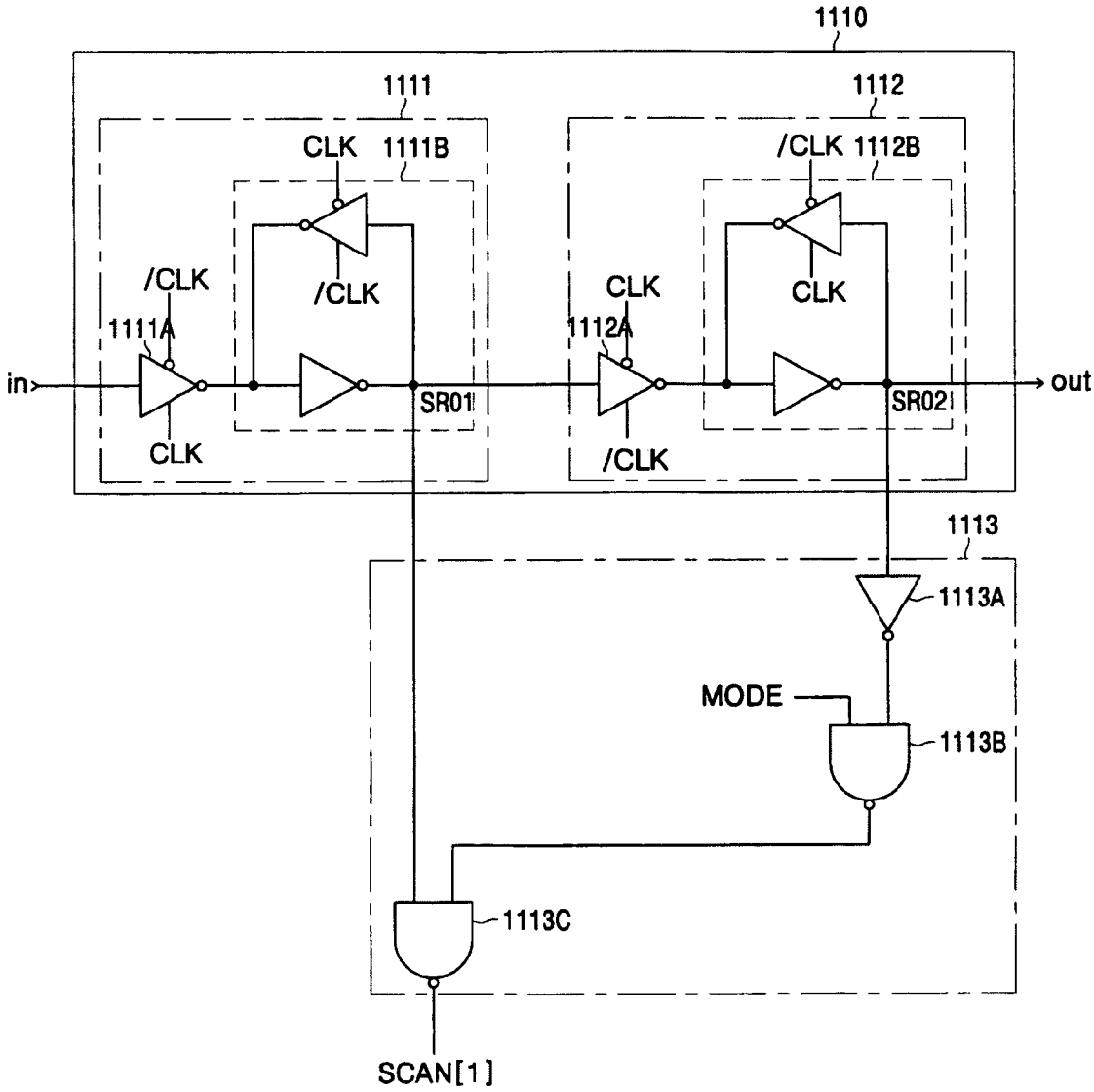
FIG. 12 shows a circuit diagram of an odd-number scan unit according to the third exemplary embodiment of the present invention.

FIG. 12 shows a circuit diagram of an odd-number scan unit according to the third exemplary embodiment of the present invention.

Referring to FIG. 12, the odd-number scan unit corresponds to the first odd-number scan unit SCUO1 of FIG. 11 and includes a flip-flop 1110 and an odd-number scan signal former 1113.

The flip-flop 1110 samples data on a rising edge of a clock signal CLK and outputs the data on a falling edge that is delayed by ½ a clock cycle after sampling. For this operation, the flip-flop 1110 includes a first latch 1111 and a second latch 1112, which are coupled in series.

The first latch 1111 includes a first sampler 1111A and a first holder 1111B. The first sampler 1111A samples an input signal on a rising edge of a clock signal CLK and outputs the input signal as output signal SR in a high-level period of a clock signal CLK. The input of the input signal is terminated on a falling edge of the clock signal CLK. The first holder 1111B samples the input signal on the falling edge of the clock signal CLK, and outputs and stores the input signal in a low-level period of the clock signal CLK.

The second latch 1112 includes a second sampler 1112A and a second holder 1112B. The second sampler 1112A samples the output signal SRO1 from the first latch 1111 on the falling edge of the clock cycle, and outputs the output signal SRO2 in the low-level period of the clock signal. The input of the output signal SRO1 is terminated on a rising edge of the clock signal. The second holder 1112B samples the output signal SRO2 in the rising edge of the clock cycle, and outputs and stores the output signal in the high-level period of the clock signal.

The odd-number scan signal former 1113 includes an inverter 1113A, a first NAND gate 1113B and a second NAND gate 1113C. The inverter 1113A inverts an output signal SRO2 of the second latch 1112 and outputs the inverted signal to the first NAND gate 1113B.

The first NAND gate 1113B receives a mode selection signal MODE and the inverted signal of the output signal SRO2 of the second latch 1112.

When the mode selection signal MODE is at a low level, the first NAND gate 1113B outputs a high-level signal irrespective of the output signal of the second latch 1112. That is, the output signal of the second latch 1112 is masked by the mode selection signal MODE being at the low level. When the mode selection signal MODE is at a high level, the first NAND gate 1113B inverts the output signal of the second latch 1112.

The second NAND gate 1113C receives the output signal SRO1 of the first latch 1111 and the output signal of the first NAND gate 1113B. When the first NAND gate 1113B outputs a high-level signal, the second NAND gate 1113C inverts the output signal SRO1 of the first latch 1111 and outputs the inverted signal. Thus, the second NAND gate 1113C outputs a low-level signal when output signal SRO1 is a high-level signal.

When the mode selection signal MODE is at a high level, since the first NAND gate 1113B inverts the output signal of the inverter 1113A, the first NAND gate 1113B outputs a signal equivalent to the output signal SRO2 of the second latch 1112. Accordingly, the second NAND gate 1113C outputs a low-level signal when the mode selection signal is a high-level signal, the output signal SRO2 of the second latch 1112 is at a high level, and the output signal SRO1 of the first latch 1111 is at a high level.

Figure 13A:
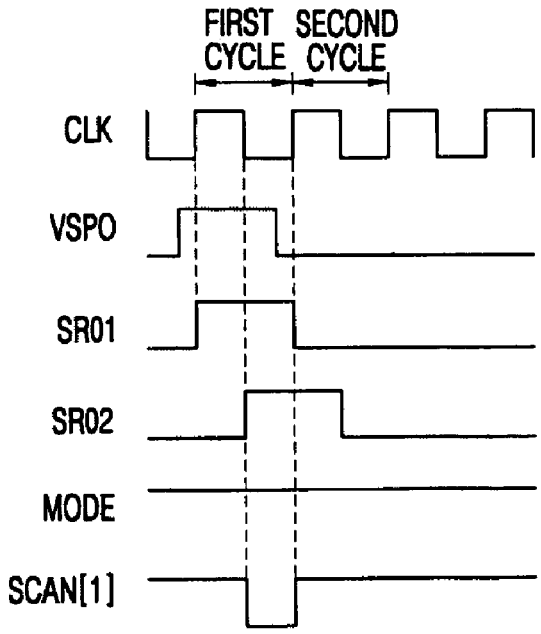
FIG. 13A shows a timing diagram illustrating operation of the odd-number scan unit shown in FIG. 12 when the mode selection signal input is high.

FIG. 13A shows a timing diagram illustrating operation of the odd-number scan unit shown in FIG. 12 when the mode selection signal input is high.

Figure 13B:
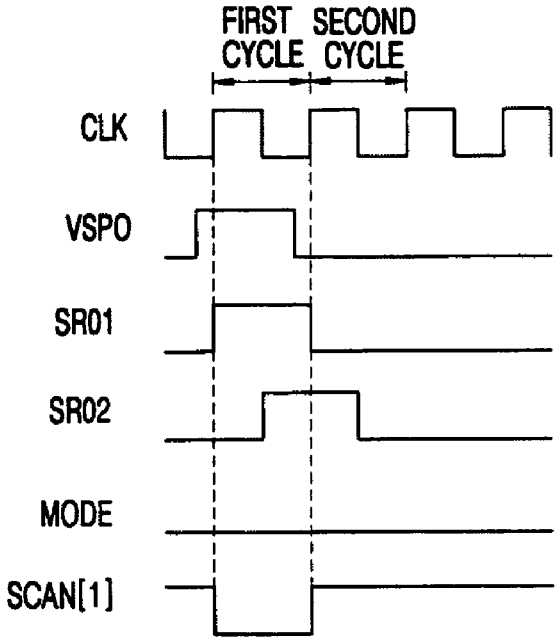
FIG. 13B shows a timing diagram illustrating operation of the odd-number scan unit shown in FIG. 12 when the mode selection signal input is low.

FIG. 13B shows a timing diagram illustrating operation of the odd-number scan unit shown in FIG. 12 when the mode selection signal input is low.

Referring to FIG. 13A, an input signal VSPO is sampled and output by a first latch 1111 on a rising edge of a first cycle of a clock signal CLK. Since the input signal VSPO is at a high level on the rising edge of the first cycle of the clock signal CLK, output signal SRO1 from the first latch 1111 is a high-level signal. Also, since the sampled signal is stored and output during a low-level period of the first cycle of the clock signal CLK, the output signal SRO1 of the first latch 1111 remains at a high level for the low-level period of the first cycle of the clock signal CLK.

The first latch 1111 samples an input signal in and outputs the sampled signal on a rising edge of a second cycle of the clock signal CLK. Since the input signal in is at a low level on a rising edge of the second cycle of the clock signal CLK, the output signal SRO1 of the first latch 1111 outputs a low-level signal.

The second latch 1112 samples the output signal SRO1 of the first latch 1111 on a falling edge of the clock signal CLK and outputs the sampled signal in a low-level period. Since the output signal SRO1 is at a high level on the falling edge of the first cycle of the clock signal CLK, a high-level signal is output via an output terminal out of the second latch 1112. Also, since the output signal SRO1 is at a low level on a falling edge of the second cycle of the clock signal CLK, a low-level signal is output via the output terminal out of the second latch 1112.

Since the mode selection signal MODE is at a high level, the first NAND gate 1113B shown in FIG. 2 inverts the output signal of the inverter 1113A. Accordingly, the first NAND gate 113B outputs an output signal SRO2 of the second latch 1112 to the second NAND gate 1113C. The second NAND gate 1113C performs a NAND operation on the output signal SRO1 of the first latch 1111 and the output signal SRO2 of the second latch 1112.

Accordingly, a signal SCAN[1] that is at a low level during a low-level period of the first cycle of the clock signal CLK is output via an output terminal of the odd-number scan unit.

Referring to FIG. 13B, the sampling of the input signal VSPO by the first latch 1111 and the sampling of the output signal SRO1 of the first latch 1111 by the second latch 1112 are the same as described with reference to FIG. 13A. Thus, the output signal SRO1 of the first latch 1111 and the output signal SRO2 of the second latch 1112 have the same waveforms as those of FIG. 13A.

However, since the mode selection signal MODE is at a low level, the first NAND gate 1113B masks the output signal SRO2 of the second latch 1112. That is, the first NAND gate 1113B outputs a high-level signal irrespective of the level of the output signal SRO2. The second NAND gate 1113C, which receives a high-level signal, inverts the output signal SRO1 of the first latch 1111.

Accordingly, the odd-number scan signal former of the odd-number scan unit inverts the output signal SRO1 of the first latch 1111 and outputs the first scan signal SCAN[1] in the first cycle.

Figure 14:
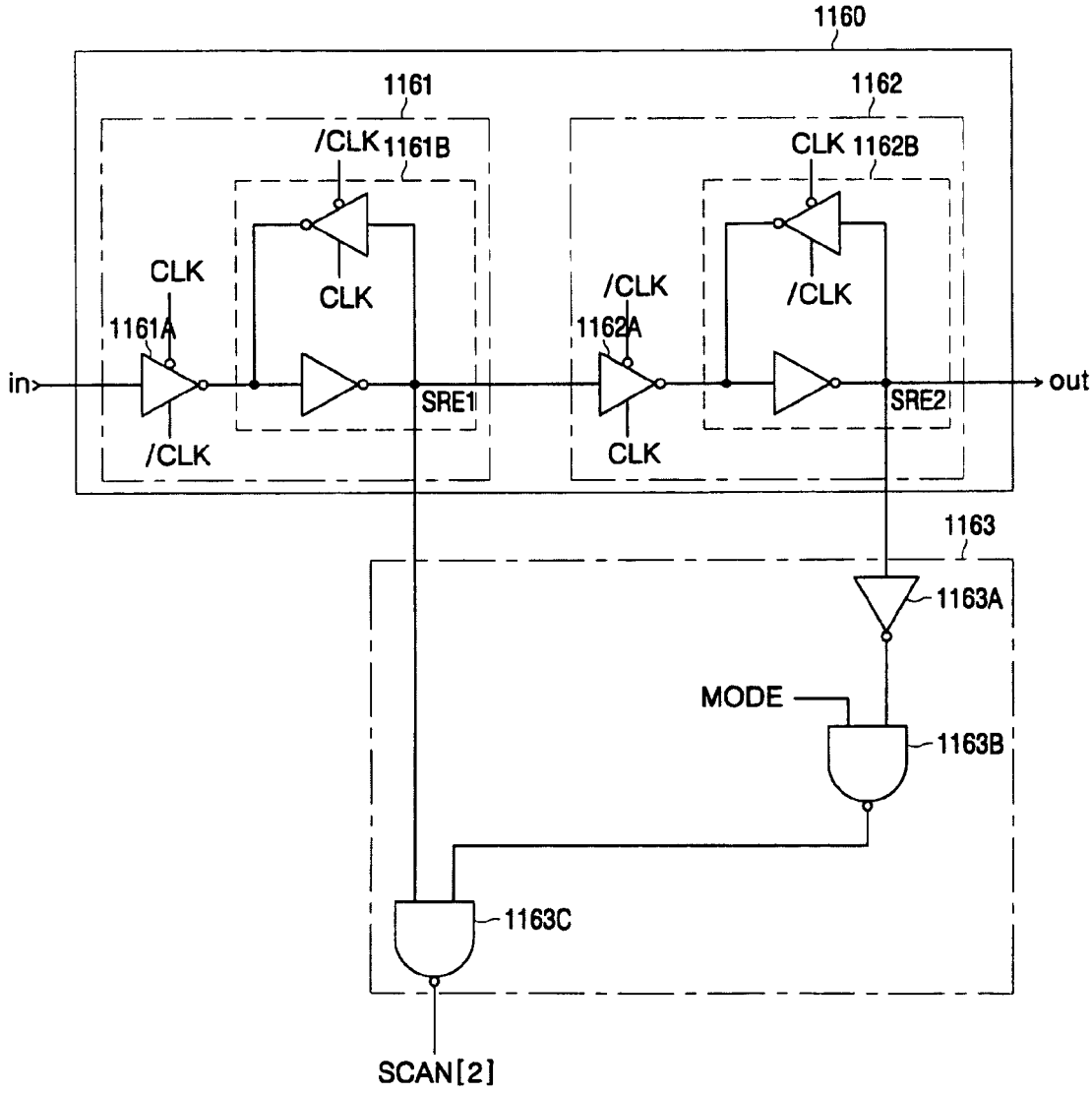
FIG. 14 shows a circuit diagram of an even-number scan unit according to the third exemplary embodiment of the present invention.

FIG. 14 shows a circuit diagram of the even-number scan unit according to the third exemplary embodiment of the present invention.

Referring to FIG. 14, the even-number scan unit corresponds to the first even-number scan unit SCUE1 of FIG. 11 and includes a flip-flop 1160 and an even-number scan signal former 1163. Operation of the even-number scan unit matches operation of the odd-number scan unit illustrated in FIG. 12, as described above, with the exception that the first latch 1161 of the flip-flop 1160 samples the input data on the falling edge of a clock signal CLK, and the second latch 1162 of the flip-flop 1160 samples the output data from the first latch 1161 on a rising edge of a clock signal CLK.

Figure 15A:
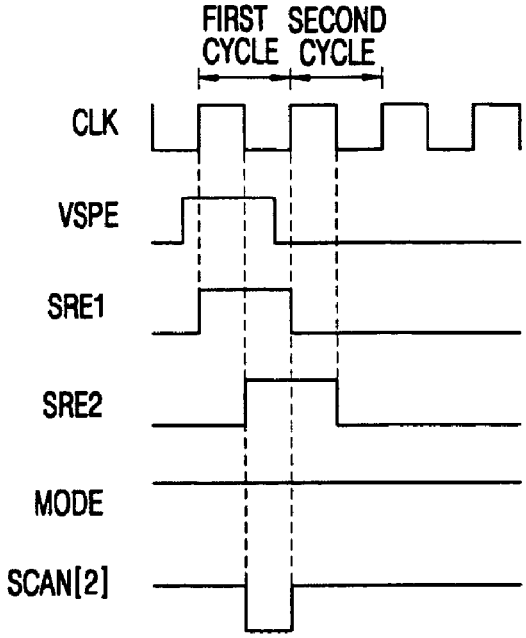
FIG. 15A shows a timing diagram illustrating operation of the even-number scan unit shown in FIG. 14 when the mode selection signal input is high.

FIG. 15A shows a timing diagram illustrating operation of the even-number scan unit shown in FIG. 14 when the mode selection signal input is high.

Figure 15B:
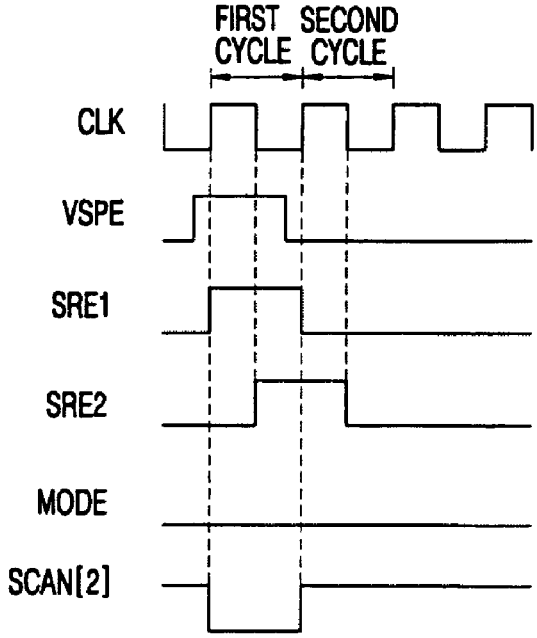
FIG. 15B shows a timing diagram illustrating operation of the even-number scan unit shown in FIG. 14 when the mode selection signal input is low.

FIG. 15B shows a timing diagram illustrating operation of the even-number scan unit shown in FIG. 14 when the mode selection signal input is low.

Referring to FIG. 15A, an input signal VSPE is sampled on a falling edge of a first cycle of a clock signal CLK and output by the first latch 1161 during the low-level period. Since the input signal VSPE is at a high level on the falling edge of the first cycle of the clock signal CLK, the output signal SRE1 of the first latch 1161 is a high-level signal. Also, since the sampled output signal is stored and output during a low-level period of the first cycle of the clock signal CLK, the output signal SRE1 of the first latch 1161 remains at a high level during a high-level period of the first cycle of the clock signal CLK.

The input signal VSPE is sampled and output via the first latch 1161 on a falling edge of a second cycle of the clock signal CLK. Since the input signal VSPE is at a low level on a falling edge of the second cycle of the clock signal CLK, the output signal SRE1 of the first latch 1161 is at a low level.

The output signal SRE1 of the first latch 1161 is sampled by the second latch 1162 on a rising edge of the clock signal CLK and output during the high-level period. Since the output signal SRE1 is at a high level on a rising edge of the first cycle of the clock signal CLK, the output signal SRE2 of the second latch 1162 is at a high level. Also, since the output signal SRE1 is at a low level on a rising edge of the second cycle of the clock signal CLK, a low-level signal is output via an output terminal out of the second latch 1162.

Since the mode selection signal MODE is at a high level, the first NAND gate 1163B shown in FIG. 14 inverts the output signal of the inverter 1163A. Thus, the first NAND gate 1163B outputs the output signal SRE2 of the second latch 1162 to the second NAND gate 1163C. The second NAND gate 1163C performs a NAND operation on the output signal SRE1 of the first latch 1161 and the output signal SRE2 of the second latch 1162.

Accordingly, a low-level signal SCAN[2] is output via an output terminal of the even-number scan unit when output signal SRE1 and output signal SRE2 are both high, which occurs during a high-level period of the first cycle of the clock signal CLK.

Referring to FIG. 15B, the sampling of the input signal VSPE by the first latch 1161 and the sampling of the output signal SRE1 of the first latch 1161 by the second latch 1162 are the same as described with reference to FIG. 15A. Accordingly, the output signal SRE1 of the first latch 1161 and the output signal SRE2 of the second latch 1162 have the same waveforms as those of FIG. 15A.

However, since the mode selection signal MODE is at a low level, the first NAND gate 1163B outputs a high-level signal irrespective of the level of the output signal SRE2 of the second latch 1162. The second NAND gate 1163C, which receives the high-level signal, inverts the output signal SRE1 of the first latch 1161.

Accordingly, the even-number scan signal former of the even-number scan unit inverts the output signal SRE1 of the first latch 1161 and outputs a second scan signal SCAN[2] with a low-level when output signal SRE1 is high during the first cycle.

Figure 16:
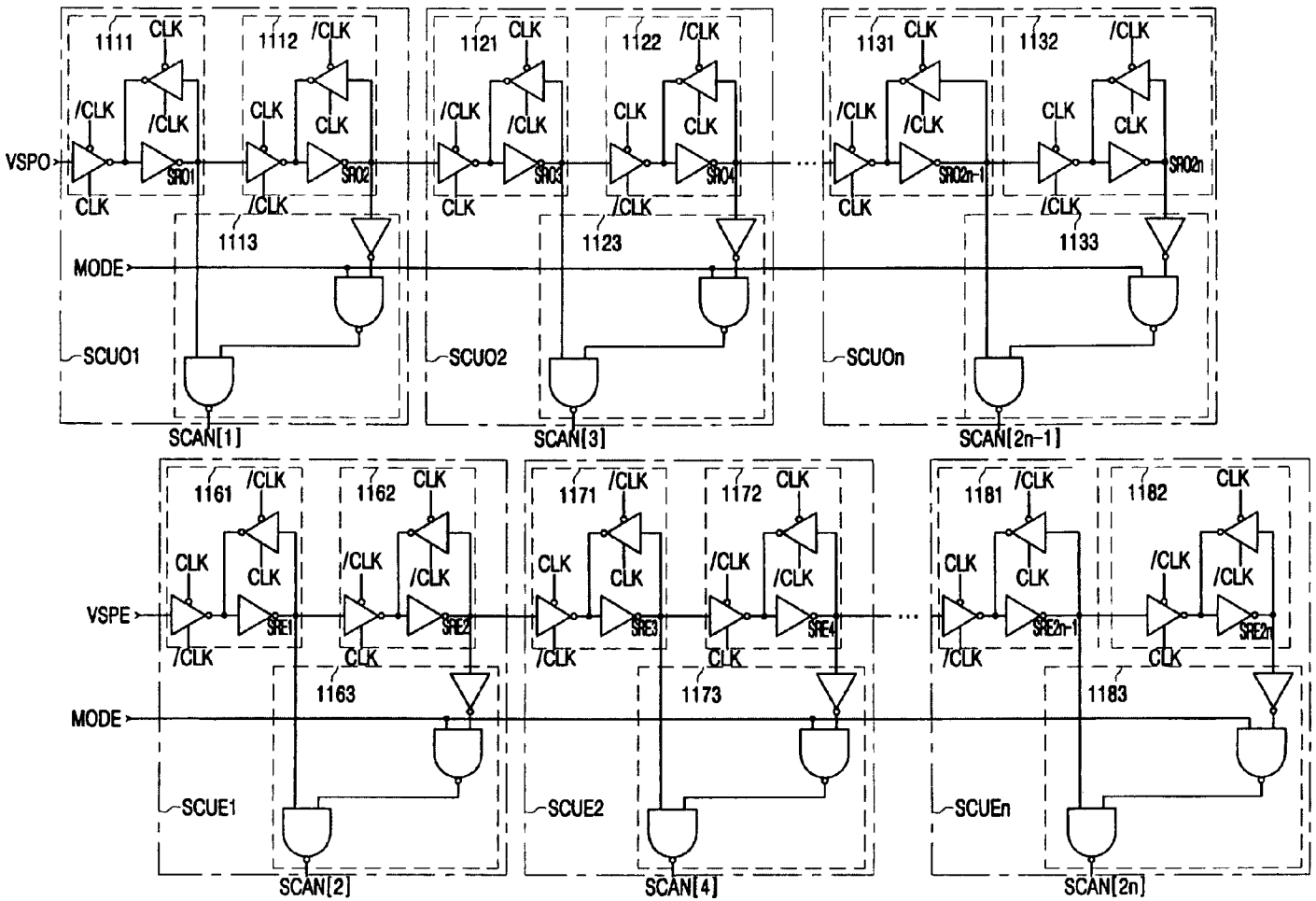
FIG. 16 shows a circuit diagram of the scan driver according to the third exemplary embodiment of the present invention.

FIG. 16 shows a circuit diagram of the scan driver according to the third exemplary embodiment of the present invention.

Referring to FIG. 16, the odd-number scan unit shown in FIG. 12 can be used as the scan units of the odd-number scan signal generator 1100, and the even-number scan unit shown in FIG. 14 can be used as the scan units of the even-number scan signal generator 1150.

As can be seen from FIGS. 12 and 14, the output signal of the second NAND gate of each of the scan units constitutes a scan signal SCAN[1,2, . . . ,2*n*−1, 2*n*].

Each of the odd-number scan units of the odd-number scan signal generator 1100 receives a clock signal CLK and outputs an odd-number scan signal SCAN[1,3, . . . ,2*n*−1] that is synchronized with the clock signal CLK. Each of the even-number scan units of the even-number scan signal generator 1150 receives the clock signal CLK and outputs an even-number scan signal SCAN[2,4, . . . ,2*n*] that is synchronized with the clock signal CLK.

Figure 17A:
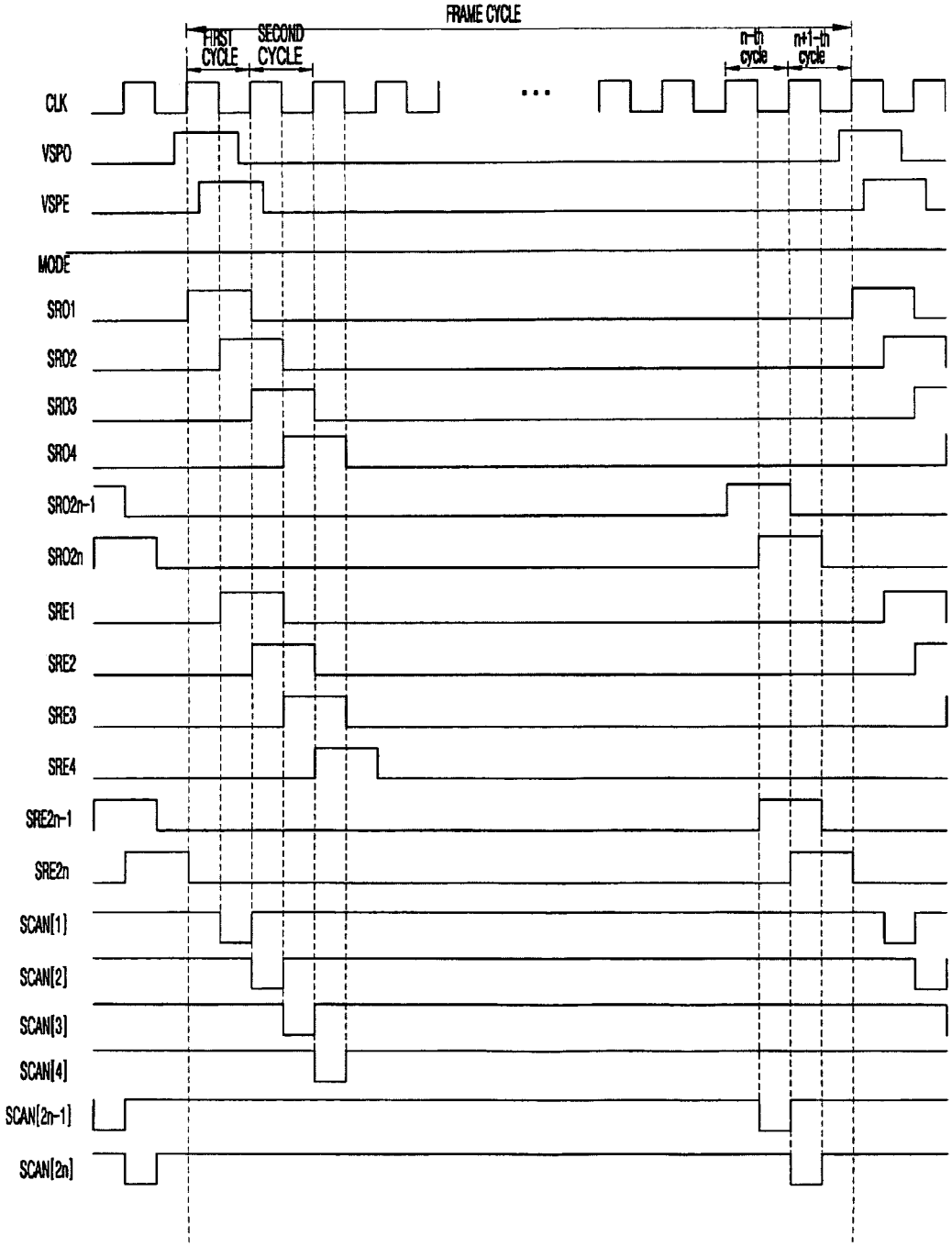
FIG. 17A shows a timing diagram illustrating progressive scanning operation of the scan driver shown in FIG. 16 when the mode selection signal input is high.

FIG. 17A shows a timing diagram illustrating progressive scanning operation of the scan driver shown in FIG. 16 when the mode selection signal input is high.

Figure 17B:
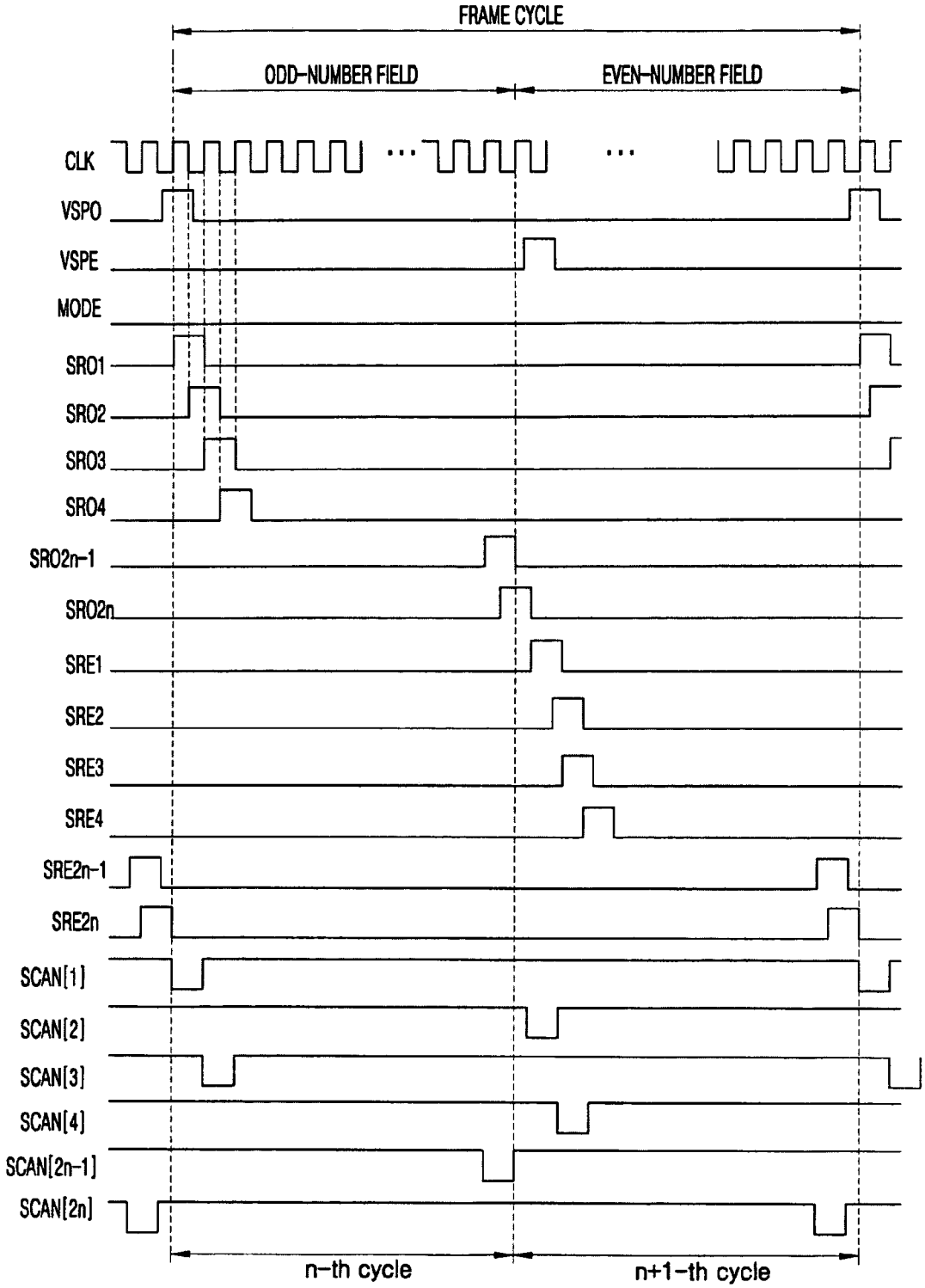
FIG. 17B shows a timing diagram illustrating interlaced scanning operation of the scan driver shown in FIG. 16 when the mode selection signal input is low.

FIG. 17B shows a timing diagram illustrating interlaced scanning operation of the scan driver shown in FIG. 16 when the mode selection signal input is low.

Hereinafter, the progressive scanning shown in FIG. 17A will be described with reference to the circuit diagram of FIG. 16.

A first odd-number scan unit SCUO1 of the odd-number scan signal generator 1100 receives an odd-number start pulse VSPO. The first odd-number scan unit SCUO1 samples the odd-number start pulse VSPO on a rising edge of a clock signal CLK. Accordingly, the first latch 1111 of the first odd-number scan unit SCUO1 outputs an output signal SRO1 at a high level during a first cycle of the clock signal CLK.

Also, a second latch 1112 of the first odd-number scan unit SCUO1 samples the output signal SRO1 on a falling edge of the first cycle of the clock signal CLK and outputs an output signal SRO2 during a low-level period. The output signal SRO2 of the first odd-number scan unit SCUO1 is input to a second odd-number scan unit SCUO2 and input to a first scan signal former 1113, which is an odd-number scan signal former of the first odd-number scan unit SCUO1.

In the progressive scan method, the mode selection signal MODE is set to a high level. Thus, a first NAND gate of the first scan signal former 1113 inverts an output signal of an inverter. Accordingly, the output signal SRO2 of the second latch 1112 is input to the second NAND gate of the first scan signal former 1113.

The second NAND gate receives the output signal SRO1 of the first latch 1111 of the first odd-number scan unit SCUO1 and the output signal SRO2 of the second latch 1112. The second NAND gate of the first scan signal former 1113 outputs a low-level signal only when both the input signals are at a high level. Accordingly, the first scan signal SCAN[1] is at a low level only when the output signal SRO1 is at a high level and the output signal SRO2 is at a high level. Thus, the first scan signal SCAN[1] is at a low level in a low-level period of the first cycle of the clock signal CLK.

The output signal SRO2, which is input to the second odd-number scan unit SCUO2, is sampled on a rising edge of a second cycle of the clock signal CLK. The second odd-number scan unit SCUO2 then performs the same operation as described above with respect to the first odd-number scan unit SCUO1, and outputs output signal SRO3, SRO4, and scan signal SCAN[3]. This operation continues sequentially through the odd-number scan units, where the outcome of an operation is: an n-th odd-number scan signal unit SCUOn outputs a 2*n*−1-th scan signal SCAN[2*n*−1] at a low level in a low-level period of an n-th cycle of the clock signal CLK. Also, an even-number start pulse VSPE is input to a first even-number scan unit SCHE1 of an even-number signal generator 1420. There may be a phase difference of ½ a clock cycle between the even-number start pulse VSPE and the odd-number start pulse VSPO.

The first even-number scan unit SCUE1 samples the even-number start pulse VSPE on a falling edge of a clock signal CLK. Accordingly, a first latch 1161 of the first even-number scan unit SCUE1 outputs an output signal SRE1 at a high level during a low-level period of a first cycle of the clock signal CLK and during a high-level period of a second cycle thereof.

Also, a second latch 1162 of the first even-number scan unit SCUE1 samples the output signal SRE1 and outputs the sampled signal on a rising edge of the second cycle of the clock signal CLK. Accordingly, the second latch 1162 of the first even-number scan unit SCUE1 outputs an output signal SRE2 being at a high level for the second cycle of the clock signal CLK. The output signal SRE2 of the first even-number scan unit SCUE1 is input to a second even-number scan unit SCUE2 and input to a second scan signal former 1163, which is an even-number scan signal former of the first even-number scan unit SCUE1.

In the progressive scan method, the mode selection signal MODE is set to a high level. Accordingly, as described for the odd-number scan unit, a second scan signal SCAN[2] is at a low level only when the output signal SRE1 is at a high level and the output signal SRE2 is at a high level. Thus, the second scan signal SCAN[2] is at a low level in a high-level period of the second cycle of the clock signal CLK.

The output signal SRE2, which is input to the second even-number scan unit SCUE2, is sampled on a falling edge of the second cycle of the clock signal CLK. The second even-number scan unit SCUE2 then performs the same operation as described above with respect to the first even-number scan unit SCUE1, and outputs output signal SRE3, SRE4 and scan signal SCAN[4]. This operation continues sequentially through even-number scan units, where the outcome of an operation is: an n-th even-number scan signal unit SCUEn outputs a 2*n*-th scan signal SCAN[2*n*] at a low level during a high-level period of an n-th cycle of the clock signal CLK.

Therefore, respective scan signals SCAN[1,2, . . . ,2*n*−1, 2*n*] are sequentially output with a phase difference of ½ a clock cycle.

Hereinafter, the interlaced scanning shown in FIG. 17B will be described with reference to the circuit diagram of FIG. 16.

A frame, Which is a unit of time required to display an image, is divided into an odd-number field period and an even-number field period. In order to perform interlaced scanning, the odd-number scan signal generator 1100 generates odd-number scan signals SCAN[1,3, . . . ,2*n*−1] for the odd-number field period. Also, an even-number scan signal generator 1150 generates even-number scan signals SCAN [2,4, . . . ,2*n*] for the even-number field period.

First, just before the odd-number field period starts, an odd-number start pulse VSPO is input to a first odd-number scan unit SCUO1 of the odd-number scan signal generator 1100. The first odd-number scan unit SCUO1 samples the odd-number start pulse VSPO on a rising edge of the clock signal CLK.

Thus, a first latch 1111 of the first odd-number scan unit SCUO1 outputs an output signal SRO1 at a high level during a first cycle of the clock signal CLK. Also, a second latch 1112 of the first odd-number scan unit SCUO1 samples the output signal SRO1 on a falling edge of the first cycle of the clock signal CLK and outputs an output signal SRO2 during a low level of the first cycle and a high level of the second cycle of the clock signal CLK. The output signal SRO2 of the first odd-number scan unit SCUO1 is input to a second odd-number scan unit SCUO2 and input to a first scan signal former 1113 of the first odd-number scan unit SCUO1.

In the interlaced scan method, a mode selection signal MODE is set to a low level. Thus, a first NAND gate of the first scan signal former 1113 outputs a high-level signal irrespective of the output signal SRO2.

The second NAND gate receives the output signal SRO1 of the first latch 1111 of the first odd-number scan unit SCUO1 and the high-level output signal of the first NAND gate. Accordingly, the second NAND gate inverts the output signal SRO1 and outputs the inverted signal. Thus, a first scan signal SCAN[1] is at a low level when the output signal SRO1 is at a high level, during the first cycle of the clock signal CLK.

The output signal SRO2 is then sampled by the second odd-number scan unit SCUO2 on a rising edge of a second cycle of the clock signal CLK. The second odd-number scan unit SCUO2 then performs the same operation as described above with respect to the first odd-number scan unit SCUO1, and outputs output signal SRO3, SRO4, and scan signal SCAN[3]. This operation continues sequentially through the odd-number scan units, where the outcome of an operation is: an n-th odd-number scan signal unit SCUOn outputs a 2*n*−1-th scan signal SCAN[2*n*−1] at a low level during an n-th cycle of the clock signal CLK in the odd-number field period.

After the odd-number field period, an even-number field period starts. Just after the even-number field period starts, an even-number start pulse VSPE is input to a first even-number scan unit SCUE1 of the even-number scan signal generator 1150.

The first even-number scan unit SCUE1 samples the even-number start pulse VSPE on a falling edge of a clock signal CLK in the even-number field period. For ease of description of the even-number field period, the number of the clock cycles shall start over in the even-field number period. Therefore, the first cycle of clock signal CLK when describing the even-number field period refers to the first cycle of clock signal CLK in the even-number field period.

Thus, a first latch 1161 of the first even-number scan unit SCUE1 outputs an output signal SRE1 at a high level during a low-level period of a first cycle of the clock signal CLK and during a high-level period of a second cycle thereof.

A second latch 1162 of the first even-number scan unit SCUE1 samples the output signal SRE1 on a rising edge of the second cycle of the clock signal CLK and outputs an output signal SRE2 during the second cycle. The output signal SRE2 of the first even-number scan unit SCUE1 is input to a second even-number scan unit SCUE2 and input to a second scan signal former 1163 of the first even-number scan unit SCUE1.

In the interlaced scan method, the mode selection signal MODE is set to a low level. Thus, the first NAND gate of the second scan signal former 1163 outputs a high-level signal irrespective of the output signal SRE2.

The second NAND gate receives the output signal SRE1 of the first latch 1161 of the first even-number scan unit SCUE1 and the high-level output signal of the first NAND gate. Accordingly, the second NAND gate inverts the output signal SRE1 and outputs the inverted signal. That is, a second scan signal SCAN[2] is at a low level when output signal SRE1 is a high level, during a low-level period of the first cycle of the clock signal CLK and during a high-level period of the second cycle thereof.

The output signal SRE2 is sampled via the second even-number scan unit SCUE2 on a falling edge of the second cycle of the clock signal CLK. The second even-number scan unit SCUE2 then performs the same operation as described above with respect to the first even-number scan unit SCUE1, and outputs output signals SRE3, SRE4, and scan signal SCAN [4]. This operation continues sequentially through the even-number scan units, where the outcome of an operation is: an n-th even-number scan signal unit SCUEn outputs a 2*n*-th scan signal SCAN[2*n*] at a low level during a low-level period of an n-th cycle of the clock signal CLK and during a high-level period of an n+1-th cycle in the even-number field period.

Accordingly, as shown in FIG. 17B, when the mode selection signal MODE is at a low level, the scan driver according to the third embodiment of the present invention performs the interlaced scanning.

Therefore, in the third embodiment, progressive scanning and interlaced scanning can be selectively performed with the applications of a mode selection signal, an odd-number start pulse, and an even-number start pulse.

Embodiment 4

Figure 18:
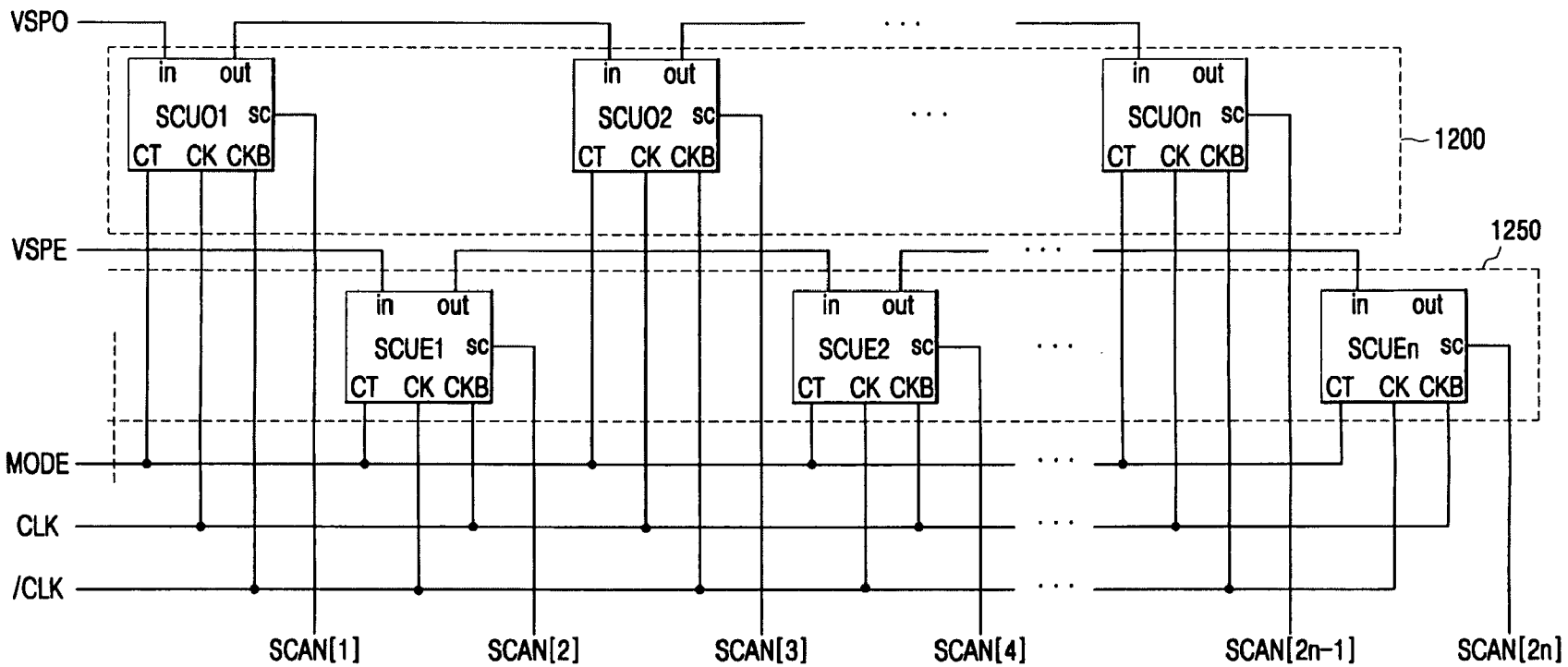
FIG. 18 shows a block diagram of a scan driver that selectively performs progressive scanning and interlaced scanning according to a fourth exemplary embodiment of the present invention.

FIG. 18 shows a block diagram of a scan driver that selectively performs progressive scanning and interlaced scanning according to a fourth exemplary embodiment of the present invention.

Referring to FIG. 18, the scan driver of the present embodiment includes an odd-number scan signal generator 1200 and an even-number scan signal generator 1250, the description of which matches the description provided for the odd-number scan signal generator and even-number scan signal generator with reference to the scan driver in FIG. 6.

Figure 19:
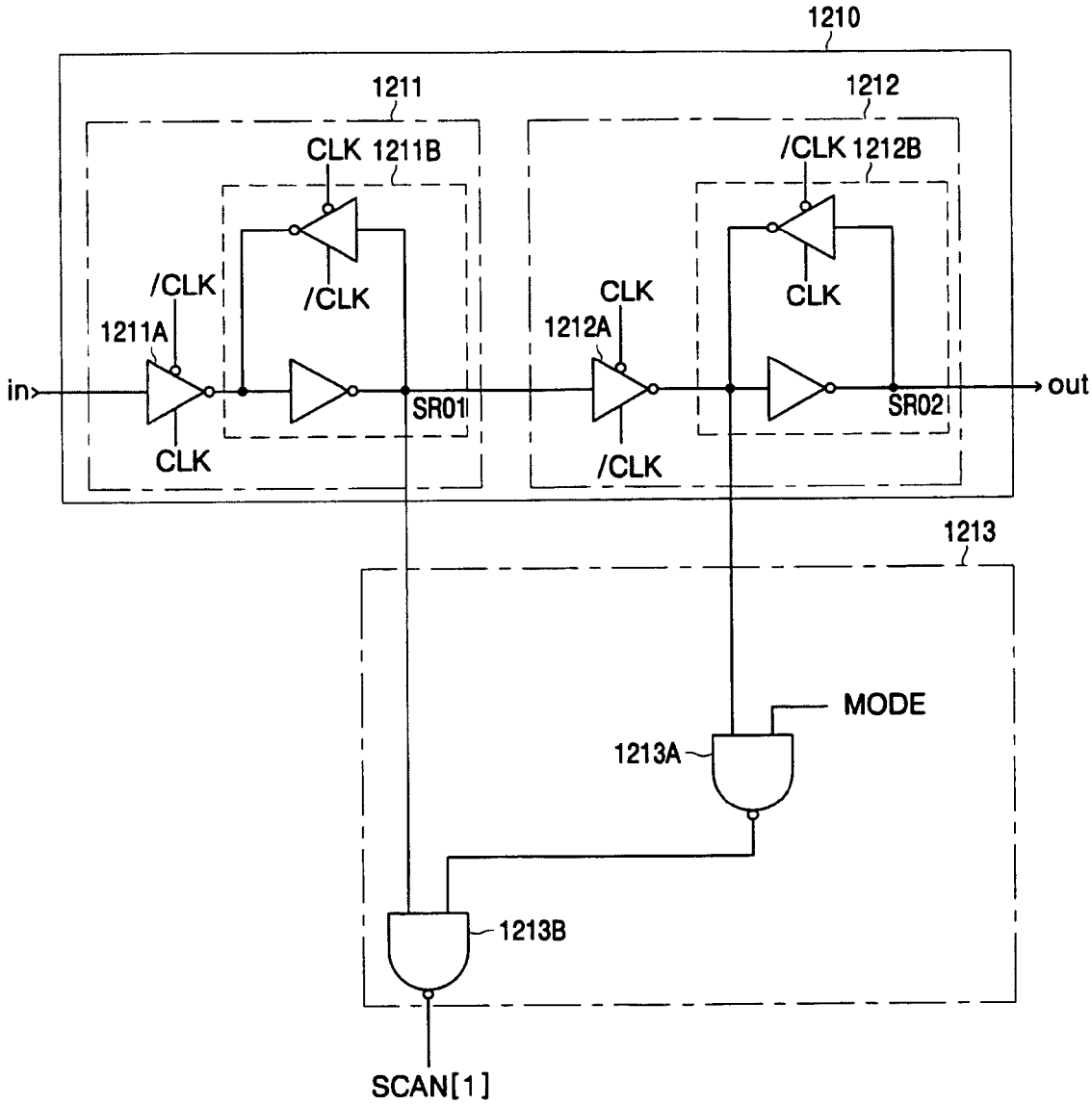
FIG. 19 shows a circuit diagram of an odd-number scan unit according to the fourth exemplary embodiment of the present invention.

FIG. 19 shows a circuit diagram of an odd-number scan unit according to the fourth exemplary embodiment of the present invention.

Referring to FIG. 19, the odd-number scan unit corresponds to the first odd-number scan unit SCUO1 of FIG. 18 and includes a flip-flop 1210 and an odd-number scan signal former 1213.

The structure and operation of the flip-flop 1210 are the same as those of the flip-flop 1110 of the odd-number scan unit as described in the third embodiment with reference to FIG. 12. However, the odd-number scan unit of FIG. 19 has a different structure of odd-number scan signal former than the odd-number scan unit of FIG. 12.

The odd-number scan signal former 1213 includes a first NAND gate 1213A and a second NAND gate 1213B.

The first NAND gate 1213A receives an output signal of the second sampler 1212A of the second latch 1212 and a mode selection signal MODE. The second NAND gate 1213B receives an output signal of the first NAND gate 1213A and the output signal SRO1 of the first latch 1211.

On comparing the odd-number scan signal former 1213 with the odd-number scan signal former 1113 shown in FIG. 12, the output signal of the second sampler 1112 of FIG. 12 is input to the first NAND gate 1113B via the inverter of the second holder 1113A. In FIG. 19, the output signal of the second sampler 1212B is equivalent to output signal SRO1 that has been inverted once. In FIG. 12, the input signal SRO2 into first NAND gate 1113B has been inverted twice more than the input signal SRO2 into first NAND gate 1213A. When delay time caused by the inverters is disregarded, the input signal into the first NAND gate 1213A of FIG. 19 is equivalent to the input signal into first NAND gate 1113B of FIG. 12.

Accordingly, when the mode selection signal MODE in FIG. 19 is at a high level, the output of the first NAND gate 1213A is equal to the output signal from the second holder 1212. Therefore, the second NAND gate 1213B performs a NAND operation on the output signal SRO1 of the first latch 1211 and the output signal of the second sampler 1212A.

Also, when the mode selection signal MODE is at a low level, the output of the first NAND gate 1213A is high regardless of the input from the second sampler 1212A. Therefore, the second NAND gate 1213B inverts the output signal SRO1 of the first latch 1211.

Figure 20A:
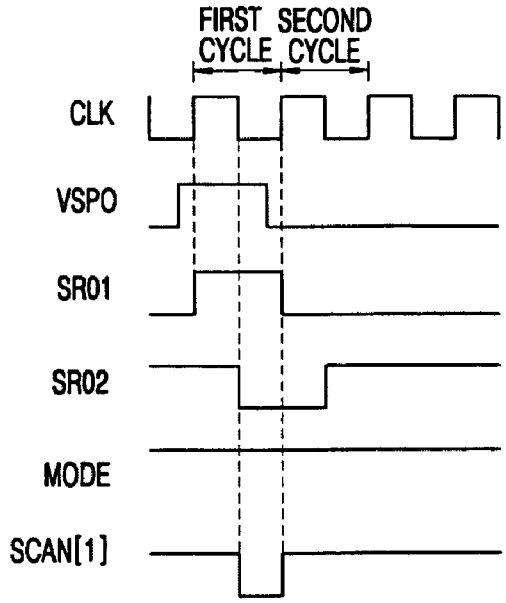
FIG. 20A shows a timing diagram illustrating operation of the odd-number scan unit shown in FIG. 19 when the mode selection signal input is high.

FIG. 20A shows a timing diagram illustrating operation of the odd-number scan unit shown in FIG. 19 when the mode selection signal input is high.

Figure 20B:
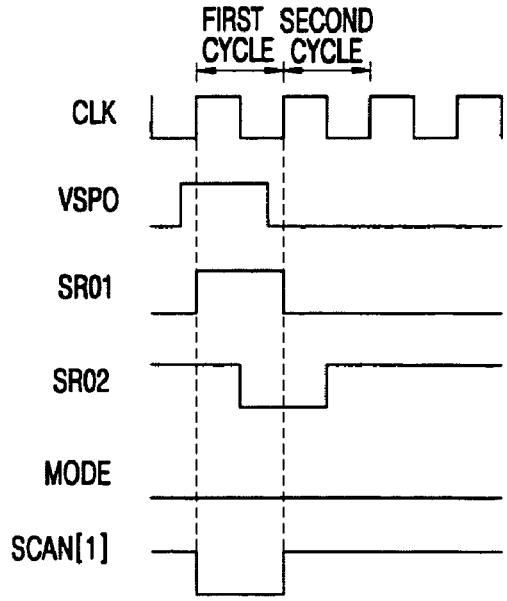
FIG. 20B shows a timing diagram illustrating operation of the odd-number scan unit shown in FIG. 19 when the mode selection signal input is low.

FIG. 20B shows a timing diagram illustrating operation of the odd-number scan unit shown in FIG. 19 when the mode selection signal input is low.

Referring to FIG. 20A, the input of the odd-number start pulse VSPO, the application of the output signal SRO1 of the first latch and the high-level mode selection signal MODE, and the formation of the first scan signal SCAN[1] are the same as described with reference to FIG. 13A. However, the output signal SRO2 of the second sampler 1212A corresponds to a signal that is obtained by delaying the output signal SRO1 of the first latch 1211 by ½ a clock cycle and inverting the delayed signal. This is because the second sampler 1212A samples the output signal SRO 1 of the first latch 1211 and inverts the sampled signal on a falling edge of the clock signal CLK.

Accordingly, as described with reference to FIG. 13A, the first scan signal SCAN[1] from the odd-number scan unit shown in FIG. 19 is at a low level during a low-level period of a first cycle of the clock signal CLK.

Referring to FIG. 20B, the sampling of an input signal VSPO via the first latch 1211 and the sampling of the output signal SRO1 of the first latch 1211 via the second latch 1212 are the same as described with reference to FIG. 13B. Accordingly, the output signal SRO1 of the first latch 1211 and the output signal of the second latch 1212 have the same waveforms as those of FIG. 13B. However, since the input signal to the first NAND gate 1213A is equivalent to the output signal of the second sampler 1212A, the output signal of the second sampler 1212A corresponds to a signal that is obtained by delaying the output signal SRO1 of the first latch 1211 by ½ a clock cycle and inverting the delayed signal.

Since the mode selection signal MODE is at a low level, the first NAND gate 1213A outputs a high-level signal irrespective of the level of the output signal from the second sampler 1212A. The second NAND gate 1213B, which receives the high-level signal, inverts the output signal SRO 1 of the first latch 1211.

Accordingly, the odd-number scan signal former 1213 of the odd-number scan unit inverts the output signal SRO1 of the first latch 1211 and outputs the first scan signal SCAN[1].

Figure 21:
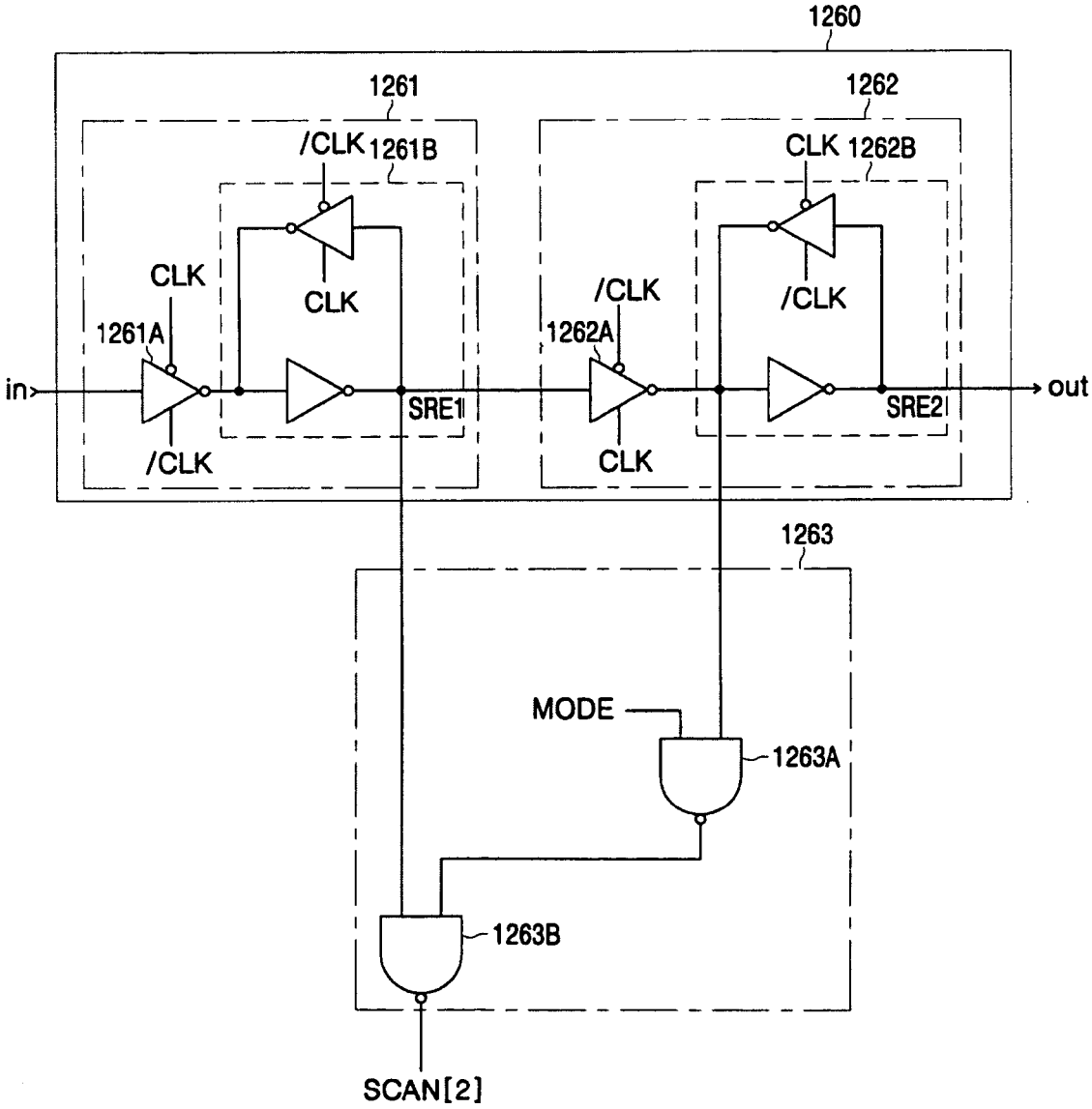
FIG. 21 shows a circuit diagram of an even-number scan unit according to the fourth exemplary embodiment of the present invention.

FIG. 21 shows a circuit diagram of the even-number scan unit according to the even-number scan unit.

Referring to FIG. 21, the even-number scan unit corresponds to the first even-number scan unit SCUE1 of FIG. 18 and includes a flip-flop 1260 and an even-number scan signal former 1263. Structure and operation of the even-number scan unit matches structure of the odd-number scan unit illustrated in FIG. 19, as described above, with the exception that the first latch 1261 of the flip-flop 1260 samples the input data on the falling edge of a clock signal CLK, and the second latch 1262 of the flip-flop 1260 samples the output data from the first latch 1261 on a rising edge of a clock signal CLK.

As with the odd-number scan unit illustrated in FIG. 19, the output signal of a second sampler 1262A is applied to a first NAND gate 1263A in the even-number scan unit illustrated in FIG. 21.

Accordingly, when the mode selection signal MODE in FIG. 21 is at a high level, the output of the first NAND gate 1263A is equal to the output signal SRO2 from the second holder 1262. Therefore, the second NAND gate 1263B performs a NAND operation on the output signal SRO1 of the first latch 1261 and the output signal of the second sampler 1262A.

Also, when the mode selection signal MODE is at a low level, the output of the first NAND gate 1263A is high regardless of the input from the second sampler 1262A. Therefore, the second NAND gate 1263B inverts the output signal SRO1 of the first latch 1261.

Figure 22A:
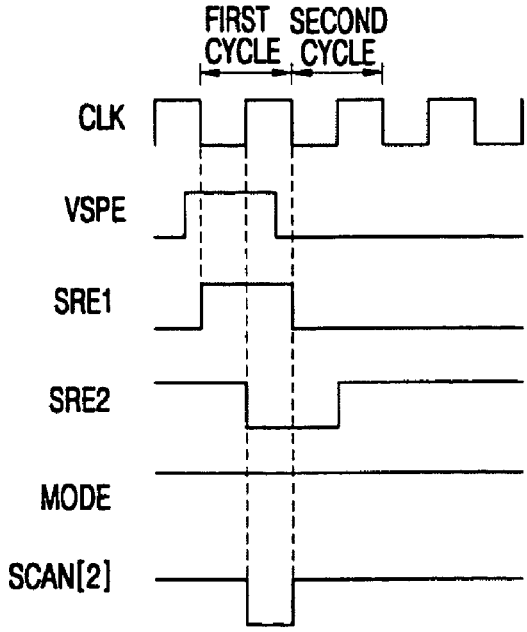
FIG. 22A shows a timing diagram illustrating operation of the even-number scan unit shown in FIG. 21 when the mode selection signal input is high.

FIG. 22A shows a timing diagram illustrating operation of the even-number scan unit shown in FIG. 21 when the mode selection signal input is high.

Figure 22B:
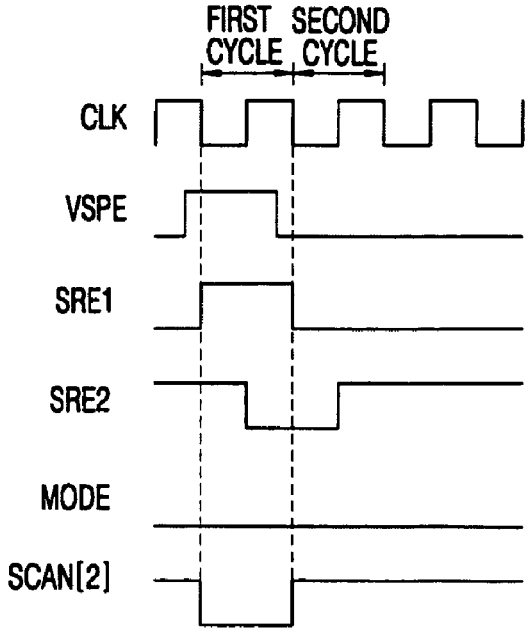
FIG. 22B shows a timing diagram illustrating operation of the even-number scan unit shown in FIG. 21 when the mode selection signal input is low.

FIG. 22B shows a timing diagram illustrating operation of the even-number scan unit shown in FIG. 21 when the mode selection signal input is low.

Referring to FIG. 22A, the input of the even-number start pulse VSPE, the application of the output signal SRE1 of the first latch 1261 and the high-level mode selection signal MODE, and the formation of the second scan signal SCAN[2] are the same as described with reference to FIG. 15A. However, the output signal SRE2 of the second sampler 1262A corresponds to a signal that is obtained by delaying the output signal SRE1 of the first latch 1261 by ½ a clock cycle and inverting the delayed signal. This is because the second sampler 1262A samples the output signal SRE1 of the first latch 1261 and inverts the sampled signal on a rising edge of the clock signal CLK.

Accordingly, as described with reference to FIG. 15A, the second scan signal SCAN[2] from the first even-number scan unit shown in FIG. 21 is at a low level during a high-level period of a first cycle of the clock signal CLK.

Referring to FIG. 22B, the sampling of an input signal VSPE via the first latch 1261 and the sampling of the output signal SRE1 of the first latch 1261 via the second latch 1262 are the same as described with reference to FIG. 15B. Accordingly, the output signal SRE1 of the first latch 1261 and the output signal of the second latch 1262 have the same waveforms as those of FIG. 15B. However, since the input signal of the first NAND gate 1263A is equivalent to the output signal SRE2 of the second sampler 1262A, the output signal of the second sampler 1262A corresponds to a signal that is obtained by delaying the output signal SRE1 of the first latch 1261 by ½ a clock cycle and inverting the delayed signal.

Since the mode selection signal MODE is at a low level, the first NAND gate 1263A outputs a high-level signal irrespective of the level of the output signal from the second sampler 1262A. The second NAND gate 1263B, which receives the high-level signal, inverts the output signal SRE1 of the first latch 1261.

Accordingly, the even-number scan signal former 1263 of the even-number scan unit inverts the output signal SRE1 of the first latch 1261 and outputs the second scan signal SCAN [2].

Figure 23:
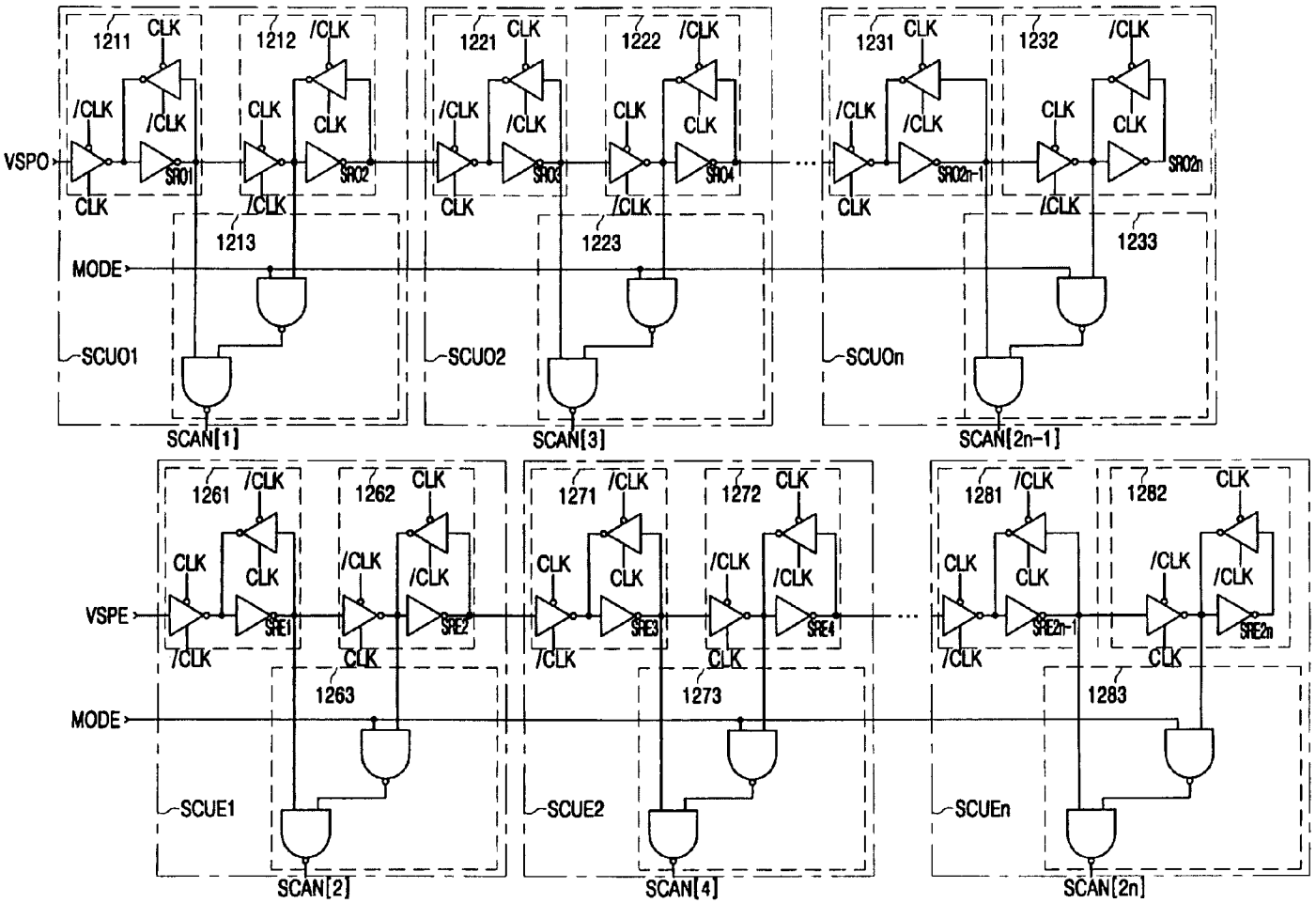
FIG. 23 shows a circuit diagram of the scan driver that selectively performs progressive scanning and interlaced scanning according to the fourth exemplary embodiment of the present invention.

FIG. 23 shows a circuit diagram of the scan driver according to the fourth exemplary embodiment of the present invention.

Referring to FIG. 23, the odd-number scan unit shown in FIG. 19 is applied to the plurality of scan units of the odd-number scan signal generator 1200, and the even-number scan unit shown in FIG. 21 is applied to the plurality of scan units of the even-number scan signal generator 1250.

As can be seen from FIGS. 19 AND 21, an output signal of the second NAND gate of each of the scan units constitutes a scan signal out[1,2, . . . , 2*n*−1,2*n*].

Each of the odd-number scan units of the odd-number scan signal generator 1200 receives a clock signal CLK and outputs an odd-number scan signal SCAN[1,3, . . . ,2*n*−1] that is synchronized with the clock signal CLK. Each of the scan units of the even-number scan signal generator 1250 receives a clock signal CLK and outputs an even-number scan signal SCAN[2,4, . . . ,2*n*] that is synchronized with the clock signal CLK.

Figure 24A:
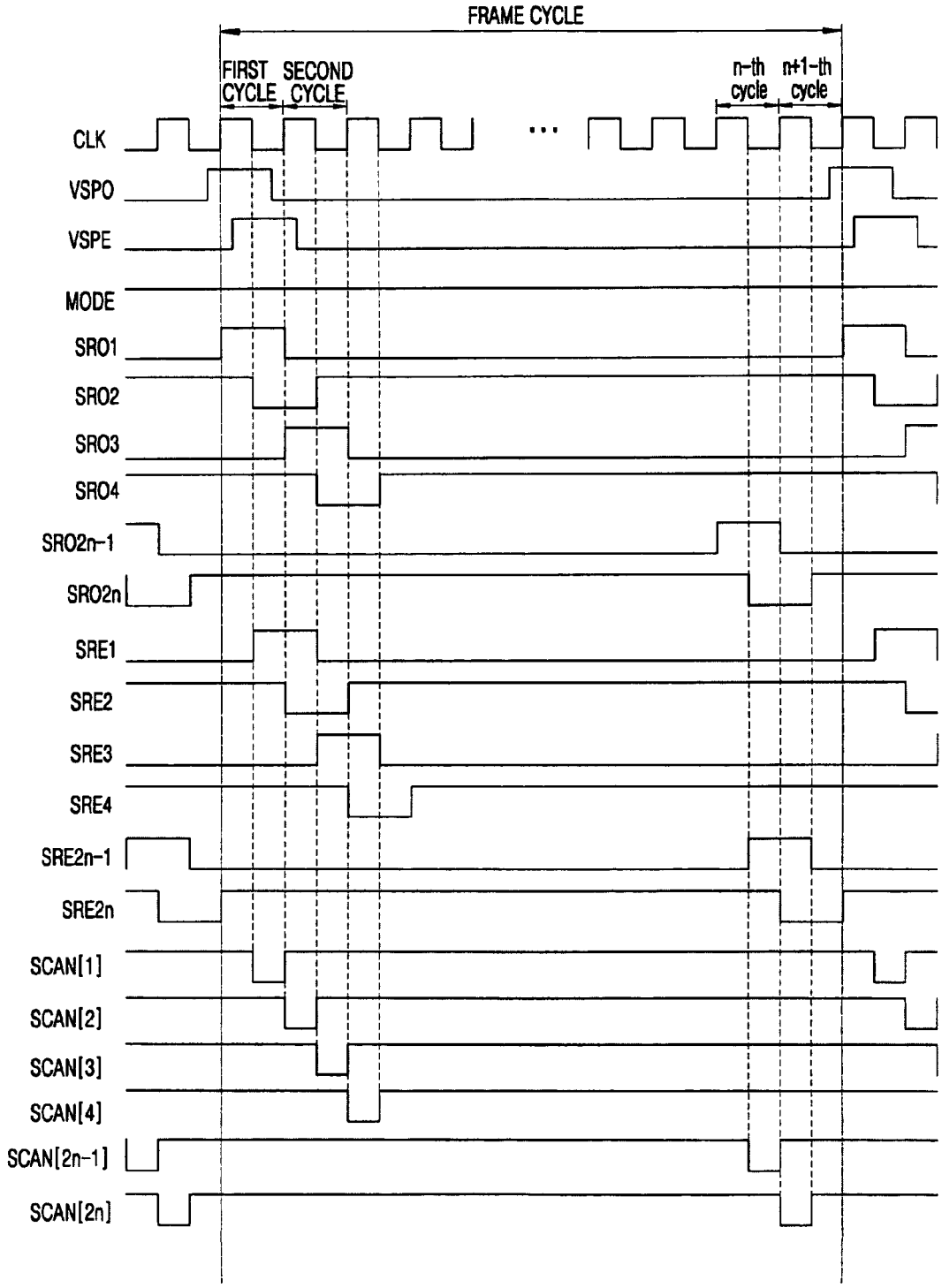
FIG. 24A shows a timing diagram illustrating progressive scanning operation of the scan driver shown in FIG. 23 when the mode selection signal input is high.

FIG. 24A shows a timing diagram illustrating progressive scanning operation of the scan driver shown in FIG. 23 when the mode selection signal input is high.

Figure 24B:
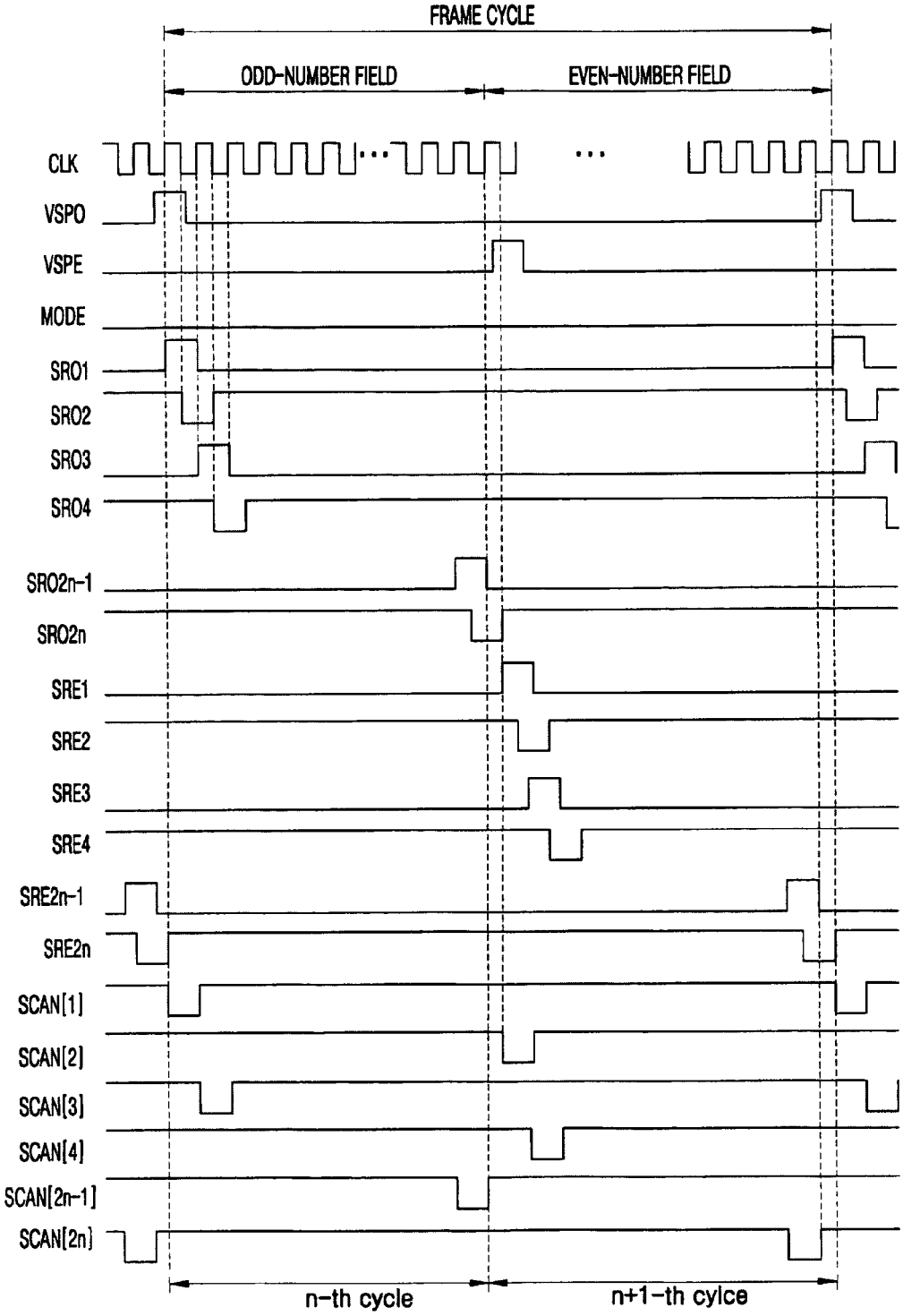
FIG. 24B shows a timing diagram illustrating interlaced scanning operation of the scan driver shown in FIG. 23 when the mode selection signal input is low.

FIG. 24B shows a timing diagram illustrating interlaced scanning operation of the scan driver shown in FIG. 23 when the mode selection signal input is low.

Hereinafter, the progressive scanning shown in FIG. 24A will be described with reference to the circuit diagram of FIG. 23.

The progressive scanning shown in FIG. 24A is the same as the operation shown in FIG. 17A except that in FIG. 24A, the output signal of a second sampler of each of the scan units is used as an input signal of a first NAND gate. In the progressive scanning operation illustrated in FIG. 17A, the output signal of a second holder is inverted and then used an input signal of a first NAND gate. Operation is otherwise as described above with respect to FIG. 17A.

Hereinafter, the interlaced scanning shown in FIG. 24B will be described with reference to the circuit diagram of FIG. 23.

The interlaced scanning shown in FIG. 24B is the same as the operation shown in FIG. 17B except that in FIG. 24B, the output signal of a second sampler of each scan unit is used as an input signal of a first NAND gate. In the interlaced scanning operation illustrated in FIG. 17B, the output signal of a second holder is inverted and then used as an input signal for a first NAND gate. Operation is otherwise as described above with respect to FIG. 17B.

Consequently, according to the fourth embodiment of the present invention, the scan driver can selectively perform progressive scanning and interlaced scanning in response to a mode selection signal, an odd-number start pulse, and an even-number start pulse.

Embodiment 5

Figure 25:
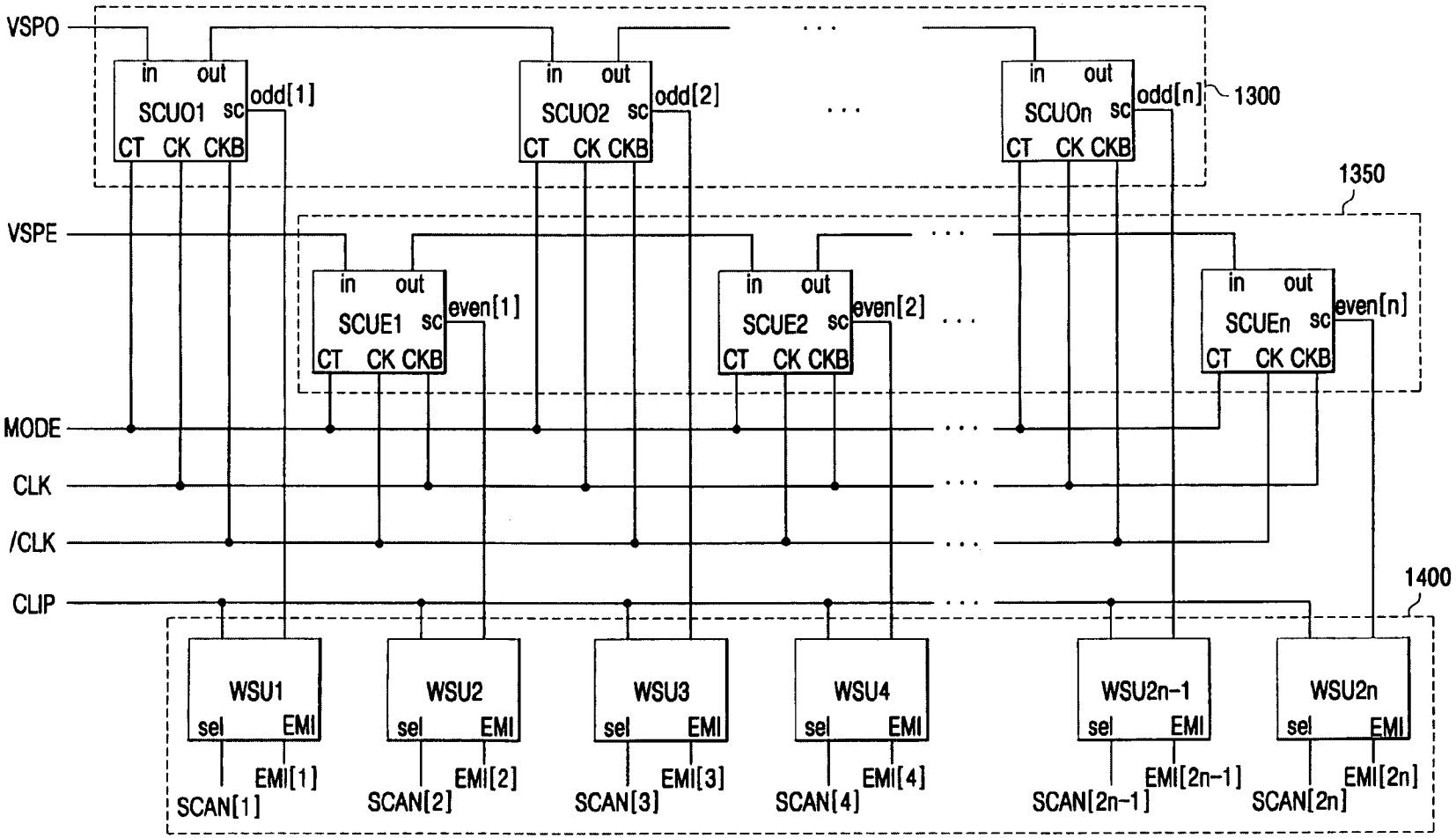
FIG. 25 shows a block diagram of a scan driver that selectively performs progressive scanning and interlaced scanning according to a fifth exemplary embodiment of the present invention.

FIG. 25 shows a block diagram of a scan driver that selectively performs progressive scanning and interlaced scanning according to a fifth exemplary embodiment of the present invention.

Referring to FIG. 25, the scan driver of the fifth exemplary embodiment includes an odd-number signal generator 1300, an even-number signal generator 1350, and a scan/emission control signal former 1400.

The odd-number signal generator 1300 includes a plurality of odd-number scan units which are coupled in series. Each of the odd-number scan units includes an odd-number flip-flop and an odd-number signal former. The odd-number signal generator 1300 can have the same components and performs the same operations as the odd-number scan signal generators 1100 and 1200 of either the third or fourth embodiment.

Accordingly, the application of an odd-number start pulse, the application of a clock signal CLK, and the generation of signals in response to a mode selection signal MODE are the same as described in the third or fourth embodiment. Also, the odd-number flip-flop is the same as described in the third or fourth embodiment, and the odd-number signal generator 1300 also has the same components and performs the same operations as described in the third or fourth embodiment.

The even-number signal generator 1350 includes a plurality of even-number scan units which are coupled in series. Each of the even-number scan units includes an even-number flip-flop and an even-number signal former. The even-number signal generator 1350 has the same components and performs the same operations as the even-number scan signal generators 1150 and 1250 of the third or fourth embodiment.

Accordingly, the application of an even-number start pulse, the application of a clock signal CLK, and the generation of signals in response to a mode selection signal MODE are the same as described in the third or fourth embodiment. Also, the even-number flip-flop is the same as described in the third or fourth embodiment, and the even-number signal generator 1350 also has the same components and performs the same operations as described in the third or fourth embodiment.

The scan/emission control signal former 1400 includes a plurality of waveform shaping units. A first waveform shaping units WSU1 receives a first odd-number signal ODD[1], which is an output signal of the first odd-number scan unit SCUO1, and an impulse signal CLIP. The first waveform shaping unit WSU1 performs a logical operation of the input signals and outputs a first scan signal SCAN[1] and a first emission control signal EMI[1].

The second waveform shaping unit WSU2 receives a first even-number signal EVEN[1] and the impulse signal CLIP, and outputs a second scan signal SCAN[2] and a second emission control signal EMI[2].

As described above, the odd-number scan units are coupled with odd-numbered waveform shaping units, respectively, and the even-number scan units are coupled with even-numbered waveform shaping units, respectively.

Figure 26A:
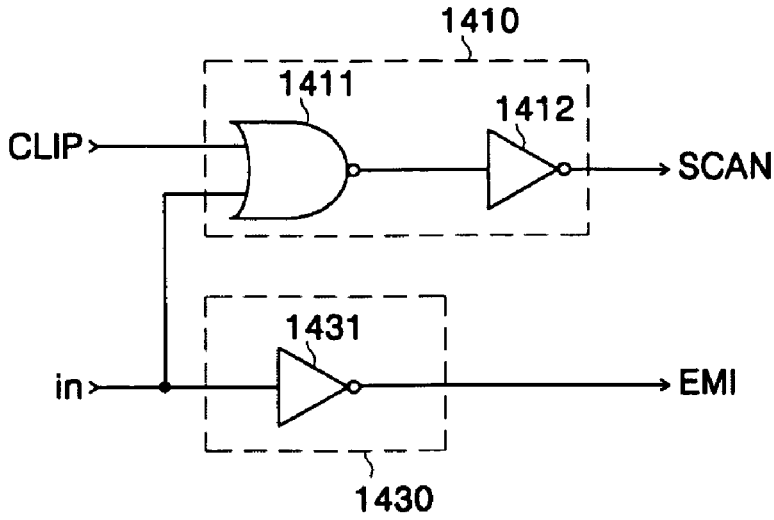
FIG. 26A shows a circuit diagram of a waveform shaping unit according to the fifth exemplary embodiment of the present invention.

FIG. 26A shows a circuit diagram of a waveform shaping unit according to the fifth exemplary embodiment of the present invention.

Figure 26B:
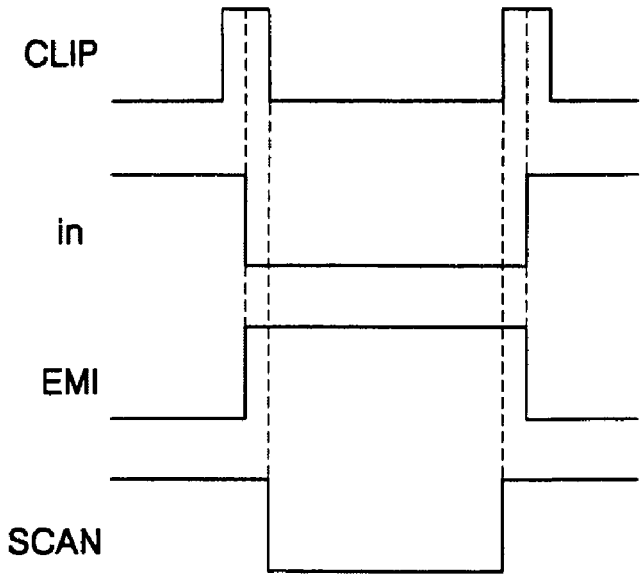
FIG. 26B shows a timing diagram of a waveform shaping unit according to the fifth exemplary embodiment of the present invention.

FIG. 26B shows a timing diagram of a waveform shaping unit according to the fifth exemplary embodiment of the present invention.

A scan signal forming path 1410 includes a NOR gate 1411 and a first inverter 1412. The NOR gate 1411 receives an impulse signal CLIP and an input signal in, and the first inverter 1412 inverts an output signal of the NOR gate 1411. That is, the scan signal forming path 1410 performs an OR operation on the impulse signal CLIP and the input signal in.

The emission control signal forming path 1430 includes a second inverter 1431, which inverts the input signal in. Also, the second inverter 1431 has a given delay time. The delay time may be equal to a delay time of a signal caused by the scan signal forming path 1410. Accordingly, the emission control signal forming path 1430 may include an odd number of inverters to correspond to the delay time caused by the scan signal forming path 1410.

FIG. 26B illustrates the waveforms of a scan signal SCAN and an emission control signal EMI that result from the impulse signal CLIP and the input signal in.

The input signal in is an output signal ODD[1,2, . . . ,n] of the odd-number signal generator 1300 or an output signal EVEN[1,2, . . . ,n] of the even-number signal generator 1350. The output signal ODD[1,2, . . . ,n] of the odd-number signal generator 1300 is equivalent to the odd-number scan signal as described in the third and fourth embodiments, and the output signal EVEN[1,2, . . . ,n] of the even-number signal generator 1350 is equivalent to the even-number scan signal as described in the third and fourth embodiments.

When the impulse signal CLIP and the input signal in are input to an input terminal of the NOR gate of a waveform shaping unit, the scan signal forming path 1410 performs an OR operation on the two input signals. Thus, a low-level period of the scan signal SCAN is shortened to less than a low-level period of the input signal in.

Also, the emission control signal forming path 1430 inverts the input signal in to form an emission control signal EMI.

Figure 27A:
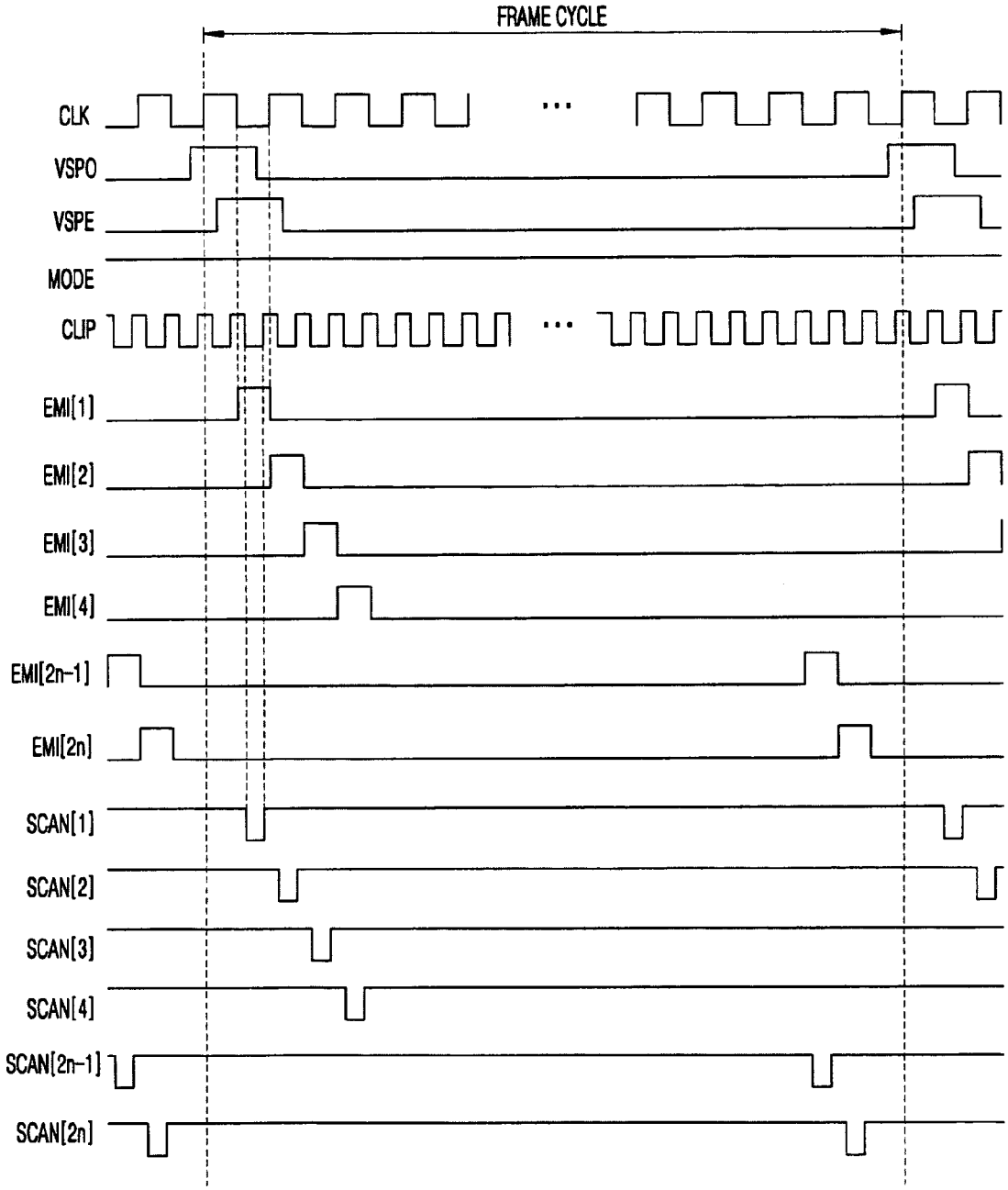
FIG. 27A shows a timing diagram illustrating progressive scanning operation of the scan driver shown in FIG. 25 when the mode selection signal input is high.

FIG. 27A shows a timing diagram illustrating progressive scanning operation of the scan driver shown in FIG. 25 when the mode selection signal input is high.

Figure 27B:
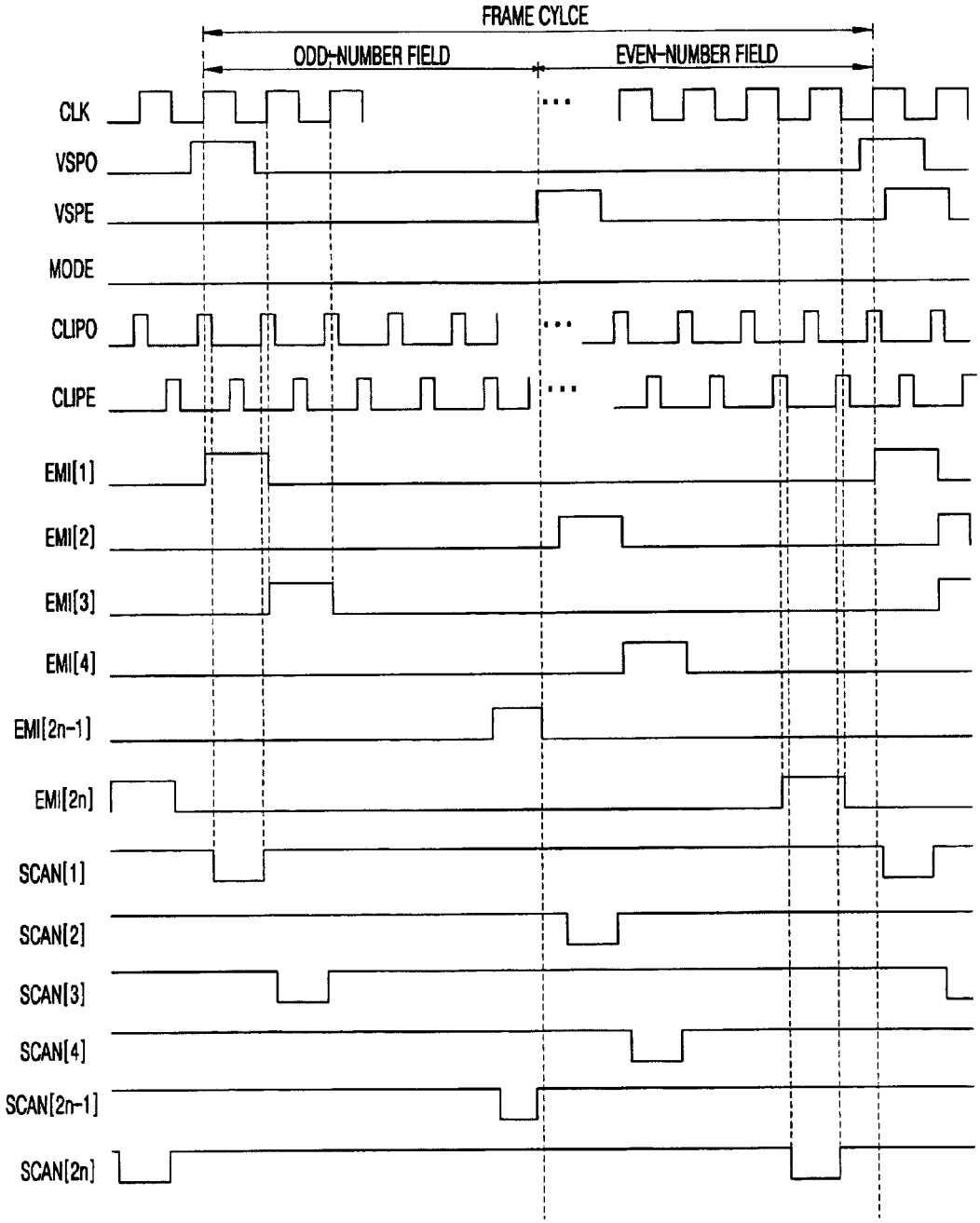
FIG. 27B shows a timing diagram illustrating interlaced scanning operation of the scan driver shown in FIG. 25 when the mode selection signal input is low.

FIG. 27B shows a timing diagram illustrating interlaced scanning operation of the scan driver shown in FIG. 25 when the mode selection signal input is low.

Hereinafter, progressive scanning of the scan driver of the present embodiment will be described with reference to FIG. 25, FIG. 26A, and FIG. 27A.

The input of an odd-number start pulse VSPO, the input of an even-number start pulse VSPE, the input of a mode selection signal MODE, and the generation of odd-number signals and even-number signals are as described in the third and fourth embodiments with reference to FIG. 17A and FIG. 24A. However, the odd-number scan signals SCAN[1, 3, . . . ,2*n*−1] of the third and fourth embodiments are equivalent to odd-number signals ODD[1,2, . . . ,n] of the present embodiment, and the even-number scan signals SCAN[2, 4, . . . ,2*n*] of the third and fourth embodiments are equivalent to even-number signals EVEN[1,2, . . . ,n] of the present embodiment.

In FIG. 27A, since the emission control signal EMI has an inverted waveform of input signal in, which can be an odd-number signal or even-number signal, the emission control signals EMI[1,2, . . . ,2*n*] have inverted waveforms of the scan signals SCAN[1,2, . . . ,2*n*] illustrated during progressive scanning in the third and fourth embodiments.

Also, in FIG. 27A, each of the waveform shaping units performs an OR operation on the input signal in and an impulse signal CLIP, and then outputs a scan signal SCAN. For example, referring to FIG. 25, the first waveform shaping unit WSU1 performs an OR operation on a first odd-number signal ODD[1] and the impulse signal CLIP and outputs the result as a first scan signal SCAN[ ]. The first scan signal SCAN[1] has a low-level period that is narrowed by a high-level period of one cycle of the impulse signal CLIP.

The above-described process is sequentially performed by the first waveform shaping unit WSU1 through a 2*n*-th waveform shaping unit WSU2*n*. Thus, an emission control signal corresponding to a scan signal has a high-level period that is wider than a low-level period of the scan signal. As a result, during a program operation of a certain pixel, the emission control signal can be elevated to a high level to turn off an emission control transistor before a new data signal is applied to a driving transistor.

Hereinafter, the interlaced scanning of the scan driver of the present embodiment will be described with reference to FIG. 25, FIG. 26A, and FIG. 27B.

The input of an odd-number start pulse VSPO, the input of an even-number start pulse VSPE, the input of a mode selection signal MODE, and the generation of odd-number signals and even-number signals are the same as described in the third and fourth embodiments with reference to FIG. 17B and FIG. 24B. However, odd-number scan signals SCAN[1, 3, . . . ,2*n*−1] of the third and fourth embodiments are equivalent to odd-number signals ODD[1,2, . . . ,n] of the present embodiment, and the even-number scan signals SCAN[2, 4, . . . ,2*n*] of the third and fourth embodiments are equivalent to even-number signals EVEN[1,2, . . . ,n] of the present embodiment.

In FIG. 27B, since an emission control signal EMI has an inverted waveform of input signal in, which can be an odd-number signal or even-number signal, emission control signals EMI[1,2, . . . ,2*n*] have inverted waveforms of the scan signals SCAN[1,2, . . . ,2*n*] illustrated during interlaced scanning in the third and fourth embodiments.

Also, in FIG. 27B, each of the waveform shaping units performs an OR operation on an input signal in and an impulse signal CLIP, and then outputs a scan signal SCAN. For example, referring to FIG. 25, a first waveform shaping unit WSU1 performs an OR operation on a first odd-number signal ODD[1] and an odd-number impulse signal CLIPO and outputs the result as a first scan signal SCAN[1]. The first scan signal SCAN[1] has a low-level period that is narrowed by a high-level period of one cycle of the odd-number impulse signal CLIPO. Odd-numbered waveform shaping units commonly receive the odd-number impulse signal CLIPO and perform an OR operation on the odd-number impulse signal CLIPO and the odd-number signals ODD[1,2, . . . ,n].

Also, even-numbered waveform shaping units receive an even-number impulse signal CLIPE. There may be a phase difference of ½ a clock cycle between the even-number impulse signal CLIPE and the odd-number impulse signal CLIPO. The even-numbered waveform shaping units perform an OR operation on the even-number impulse signal CLIPE and the even-number scan signals EVEN[1,2, . . . ,n].

The above-described process is sequentially performed by the first waveform shaping unit WSU1 through a 2*n*-th waveform shaping unit WSU2*n*. Thus, an emission control signal corresponding to a scan signal has a high-level period that is wider than a low-level period of the scan signal. As a result, during a program operation of a certain pixel, the emission control signal can be elevated to a high level to turn off an emission control transistor before a new data signal is applied to a driving transistor.

First, the odd-numbered waveform shaping units invert the odd-number signals ODD[1,2, . . . ,n], which are generated during an odd-number field period, and form odd-numbered emission control signals EMI[1,3, . . . ,2*n*−1], respectively. Also, the odd-numbered waveform shaping units perform an OR operation on the odd-number impulse signal CLIPO the odd-number signals ODD[1,2, . . . ,n], which are output signals of the odd-number scan units, and generate odd-number scan signals SCAN[1,3, . . . ,2*n*−1].

After the odd-number field period starts, an even-number field period starts. The even-numbered waveform shaping units invert the even-number signals EVEN[1,2, . . . ,n], which are generated during an even-number field period, and form even-numbered emission control signals EMI[2,4, . . . ,2*n*]. Also, the even-numbered waveform shaping units perform an OR operation on the even-number impulse signal CLIPE and the even-number signals EVEN[1,2, . . . ,n], which are output signals of the even-number scan units, and generate even-number scan signals SCAN[2,4, . . . ,2*n*].

In the above-described process, the odd-numbered emission control signals EMI[1,3, . . . ,2*n*−1] and the even-numbered scan signals SCAN[1,3, . . . ,2*n*−1] are generated for the odd-number field period, and the even-numbered emission control signals EMI[2,4, . . . ,2*n*] and the odd-numbered scan signals SCAN[2,4, . . . ,2*n*] are generated for the even-number field period. In this manner, the interlaced scanning is performed.

Embodiment 6

Figure 28:
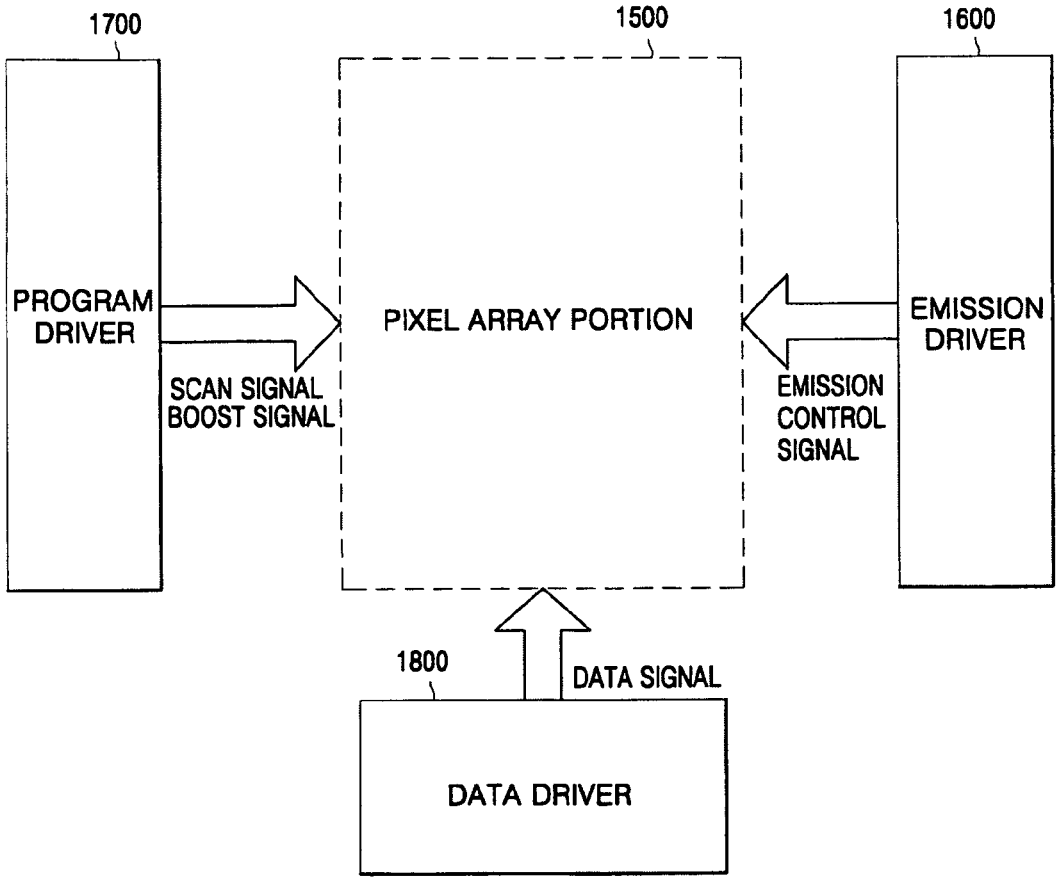
FIG. 28 shows a block diagram of an organic light emitting display (OLED) that selectively performs progressive scanning and interlaced scanning according to a sixth exemplary embodiment of the present invention.

FIG. 28 shows a block diagram of an organic light emitting display (OLED) that selectively performs progressive scanning and interlaced scanning according to a sixth exemplary embodiment of the present invention.

Referring to FIG. 28, the organic light emitting display of the present embodiment includes a pixel array portion 1500 in which pixels are arranged in a plurality of rows and columns, an emission driver 1600, which supplies an emission control signal to the pixel array portion 1500, a program driver 1700, which supplies a scan signal and a boost signal to the pixel array portion 1500, and a data driver 1800, which supplies a data signal to a pixel selected by the scan signal.

The program driver 1700 may be disposed opposite the emission driver 1600 with the pixel array portion 1500 interposed between. In another embodiment, the program driver 1700 may be disposed in the same region as the emission driver 1600.

The program driver 1700 applies the boost signal and the scan signal to the pixels. The data signal is written in response to the scan signal, and the data signal is applied from the data driver 1800 to the pixels to write the data signal. When the writing of the data signal is complete, the emission driver 1600 emits a signal to a pixel, which then emits light.

Figure 29A:
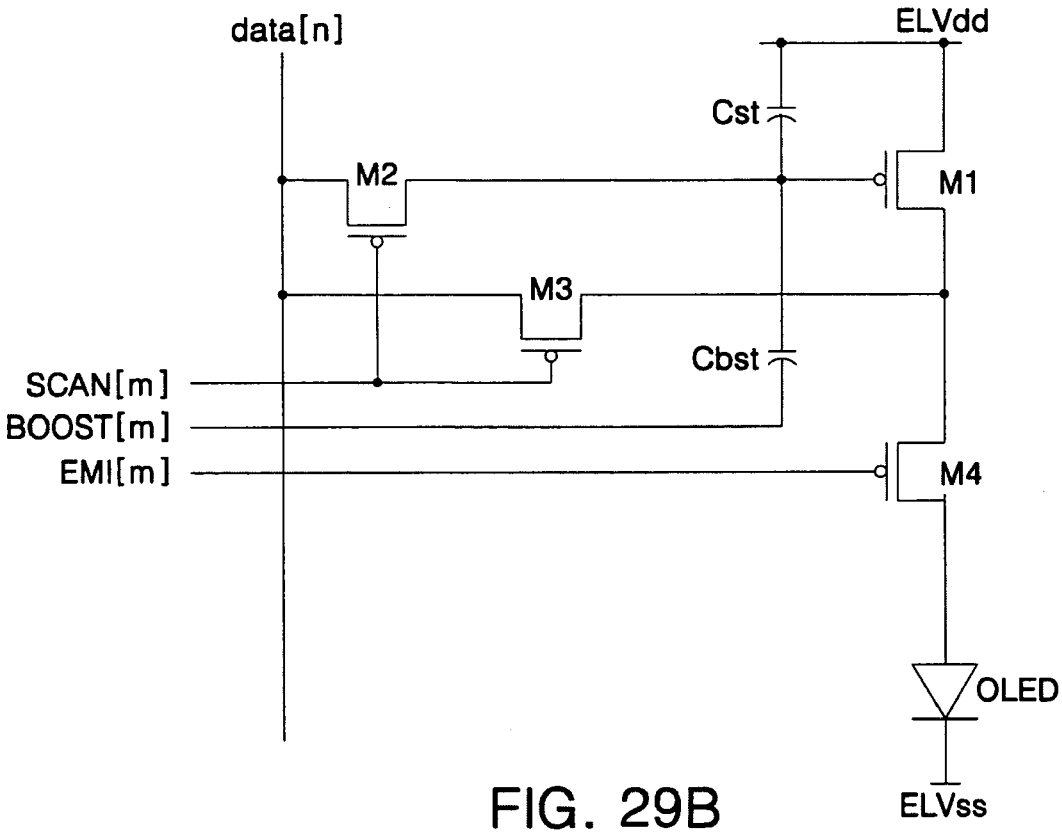
FIG. 29A shows a circuit diagram of a pixel driving circuit for a pixel in the pixel array portion according to the sixth exemplary embodiment of the present invention.

FIG. 29A shows a circuit diagram of a pixel driving circuit for a pixel in the pixel array portion according to the sixth exemplary embodiment of the present invention.

Figure 29B:
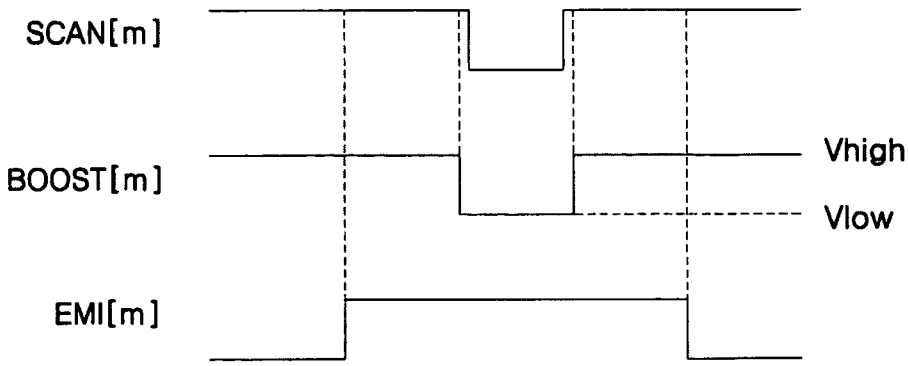
FIG. 29B shows a timing diagram illustrating the operation of the pixel driving circuit shown in FIG. 29A according to the sixth exemplary embodiment of the present invention.

FIG. 29B shows a timing diagram illustrating the operation of the pixel driving circuit shown in FIG. 29A according to the sixth exemplary embodiment of the present invention.

Referring to FIG. 29A, the pixel driving circuit includes four transistors M1, M2, M3, and M4, two capacitors Cst and Cbst, and an organic light emitting display OLED.

The transistor M1 is a driving transistor that supplies to the transistor M3 the same current as data current Idata that is sunk via a data line data[n]. The gate terminal of the driving transistor M1 is coupled with one terminal of the program capacitor Cst and the transistor M2. Also, the driving transistor M1 is coupled with a power supply line with voltage ELVdd and coupled with the transistors M3 and M4.

The transistor M2 is a switching transistor that is turned on in response to a scan signal SCAN[m] and forms a current path from the data line data[n] to capacitors Cst and Cbst. Also, the switching transistor M2 applies a predetermined bias voltage to the gate of the driving transistor M1 and forms a voltage Vgs of the driving transistor M1 corresponding to the data current Idata.

The transistor M3 is turned on in response to the scan signal SCAN[m] and forms a path for current to flow from the driving transistor M1 to the data line data[n].

The transistor M4 is an emission control transistor that is turned on in response to an emission control signal EMI[m] and forms a path for current to flow from the driving transistor M1 to the organic light emitting display OLED.

The boost capacitor Cbst elevates a voltage at a gate terminal of the driving transistor M1 when a boost signal BOOST [m] is applied to one terminal of the boost capacitor Cbst. With the elevation of the voltage at the gate terminal of the driving transistor M1, the influence of parasitic capacitance caused by the transistors M1 and M2 is minimized.

The pixel driving circuit stores the voltage Vgs corresponding to the data current Idata in the program capacitor Cst and turns on the emission control transistor M4 to provide current equal to the program current to the organic light emitting display OLED.

Hereinafter, the operations of the pixel driving circuit will be described with reference to FIG. 29A and FIG. 29B.

First, the emission control signal EMI[m] transitions from a low-level signal to a high-level signal and the emission control transistor M4 is turned off. Thus, emission operation of the organic light emitting display OLED ceases.

Subsequently, the boost signal BOOST[m] transitions from Vhigh to Vlow. Then the scan signal SCAN[m] transitions to a low level and the transistors M2 and M3 are turned on. While the transistors M2 and M3 are being turned on, the data current Idata is sunk, and a voltage Va corresponding to the data current Idata is generated at the gate terminal of the transistor M1. The data current Idata can be expressed as in the following Equation 2:

$$Idata=K(ELVdd-Va-Vth)^2 \quad (2)$$

The electric charge Qst stored in the program capacitor Cst equals C1 *(ELVdd−Va), where C1 equals the capacitance of program capacitor Cst. The electric charge Qbst stored in the boost capacitor Cbst equals C2 *(Va−Vlow), where C2 equals the capacitance of boost capacitor Cbst. When the scan signal SCAN[m] is at a low level, the transistor M1 operates in a triode region. Thus, the two capacitors Cst and Cbst can receive electric charges required to maintain voltage Va at the gate terminal of the transistor M1 via the transistor M2. Also, since a path for electric charges is formed through the transistor M2 while it is turned on, Qst does not need to be equal to Qbst.

Subsequently, when the scan signal SCAN[m] transitions from a low-level signal to a high-level signal, transistors M2 and M3 turn off, and the charges in the capacitors Cst and Cbst are redistributed. If the capacitance of the transistor M1 between the gate electrode and a heavily doped region of the transistor M1 is neglected, the electric charge Qst of the program capacitor Cst should be equal to the electric charge Qbst of the boost capacitor Cbst.

Thereafter, when the boost signal BOOST[m] transitions upward from Vlow to Vhigh, the electric charges at the gate terminal of the transistor M1 are redistributed. The resulting voltage Va' at the gate terminal of the transistor M1 can be expressed as in the following equation 3:

$$Va' = \frac{Cbst - Cst}{2Cbst}Va + \frac{Vhigh}{2} + \frac{Cst}{2Cbst}ELVdd \quad (3)$$

According to equation 3, the voltage Va' at the gate terminal of the transistor M1 is proportional to the voltage Vhigh and a voltage Va measured during an initial program operation.

Normally, without the boost capacitor Cbst, when the transistors M2 and M3 are turned off, the voltage at the gate terminal of the driving transistor M1 varies due to parasitic capacitance of the transistor. Therefore, the pixel driving circuit shown in FIG. 29A includes the boost capacitor Cbst, thus eliminating the variation in voltage at the gate terminal of the driving transistor M1 caused by the parasitic capacitance.

Figure 30:
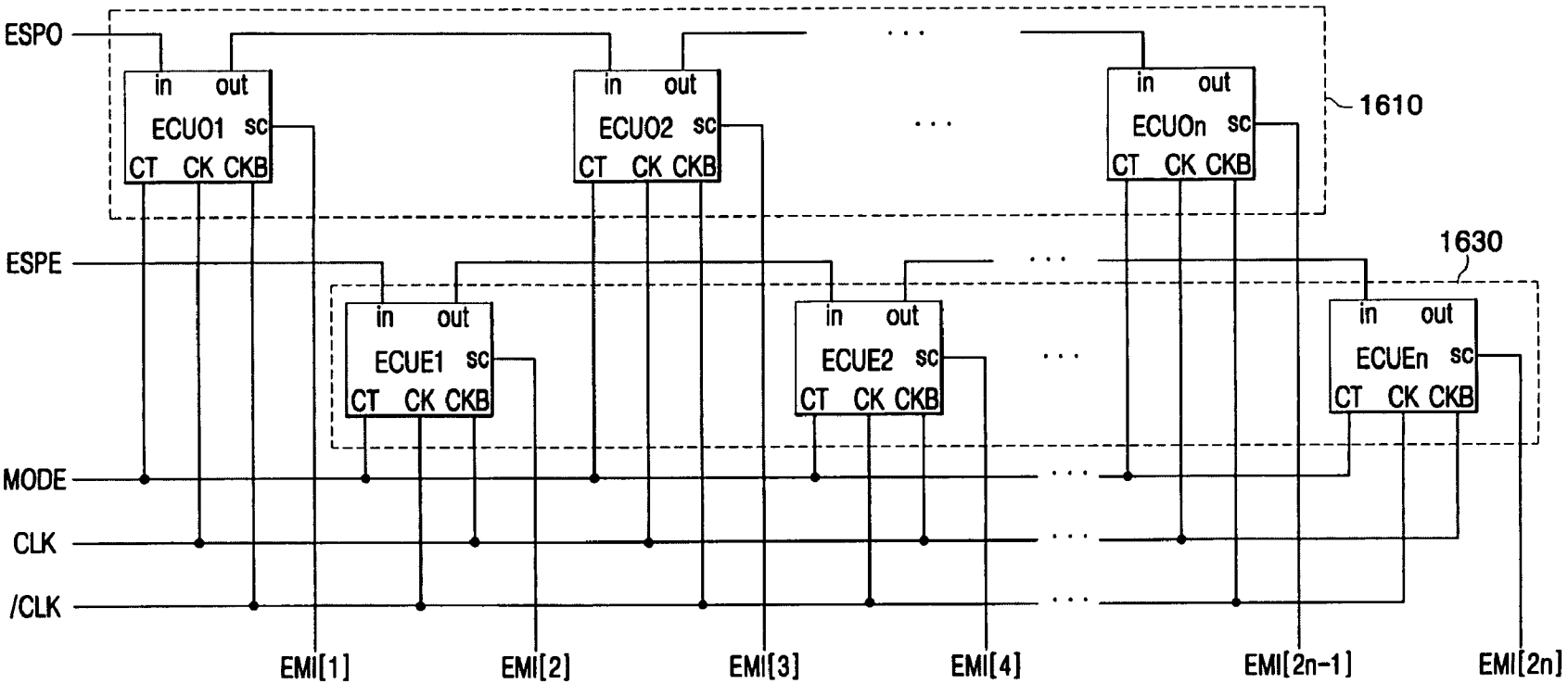
FIG. 30 shows a block diagram of an emission driver illustrated in FIG. 28.

FIG. 30 shows a block diagram of the emission driver 1600 illustrated in FIG. 28.

Referring to FIG. 30, the emission driver 1600 includes an odd-number emission control signal generator 1610 and an even-number emission control signal generator 1630.

The odd-number emission control signal generator 1610 includes a plurality of odd-number emission control units, ECUO1, ECUO2, . . . ECUOn, which are coupled in series. Each odd-number emission control unit receives a clock signal CLK input to a terminal CK, an inverse clock signal /CLK input to a terminal CKB, and a mode selection signal MODE input to a control terminal CT.

Also, each of the odd-number emission control unit includes a flip-flop and a logic circuit, which receives two signals from the flip-flop and generates an emission control signal. Accordingly, the odd-number emission control signal generator 1610 is a shift register that outputs shifted data in response to an input clock signal for each cycle.

A first odd-number emission unit ECUO1 receives an odd-number emission start pulse ESPO input to terminal in. The first odd-number emission control unit ECUO1 samples an input signal on a rising edge of the clock signal CLK and outputs a first emission control signal EMI[1] in a high-level period of a clock signal CLK through a logical operation from terminal SC.

Also, the sampled data is output via an output terminal out on a falling edge that is one-half of a cycle later than the rising edge at which the odd-number emission start pulse ESPO was sampled. The data, which is output on the falling edge of the clock signal CLK, is input to a second odd-number emission control unit ECUO2 on the subsequent rising edge of the clock signal CLK.

The above-described correlation between adjacent odd-number emission control units, inputting of the mode selection signal MODE, and application of a clock signal CLK are applied from the first odd-number emission control unit ECUO1 to an n-th odd-number emission control unit ECUOn. The mode selection signal MODE and the clock signal CLK are input in parallel to all the odd-number emission control units of the odd-number emission control signal generator 1610, and the respective odd-number emission control units are coupled in series to adjacent odd-number emission control units. Accordingly, the odd-number emission control units output odd-number emission control signals EMI[1,3,5, . . . ,2*n*−1] from terminals SC at intervals of one cycle of the clock signal CLK.

The even-number emission control signal generator 1630 includes a plurality of even-number emission control signal units, ECUE1, ECUE2, . . . ECUEn, which are coupled in series. Each even-number emission control unit receives a clock signal CLK input to a terminal CKB, an inverse clock signal /CLK input to a terminal CK, and a mode selection signal MODE input to a control terminal CT.

Each even-number emission control unit has a flip-flop and a logic circuit, which performs a logical operation on signals of the flip-flop and generates an even-number emission control signal. Accordingly, the even-number emission control signal generator 1630 is a shift register that outputs shifted data in response to an input clock signal for each cycle.

A first even-number emission control unit ECUE1 receives an even-number emission start pulse ESPE input to terminal in. The first even-number emission control unit ECUE1 samples the even-number emission start pulse ESPE on a falling edge of the clock signal CLK and outputs a second emission control signal EMI[2] from terminal SC in a low-level period of a clock signal CLK through a logical operation.

Also, the sampled data is output via an output terminal out on a rising edge of the clock signal CLK that is one-half of a cycle later than the falling edge at which the even-number emission start pulse ESPE as an input signal is sampled. The data, which is output on the rising edge of the clock signal CLK, is input to a second even-number emission control unit ECUE2 on the subsequent falling edge of the clock signal CLK.

The above-described correlation between adjacent even-number emission control units, inputting of the mode selection signal MODE, and application of a clock signal CLK are applied from the first even-number emission control unit ECUE1 to an n-th even-number emission control unit ECUEn. The mode selection signal MODE and the clock signal CLK are input in parallel to all the even-number emission control units of the even-number emission control signal generator 1630, and the respective even-number emission control units are coupled in series to adjacent even-number emission control units. Accordingly, the even-number emission control units output even-number emission control signals EMI[2,4, . . . ,2*n*] at intervals of one cycle of the clock signal CLK.

Figure 31:
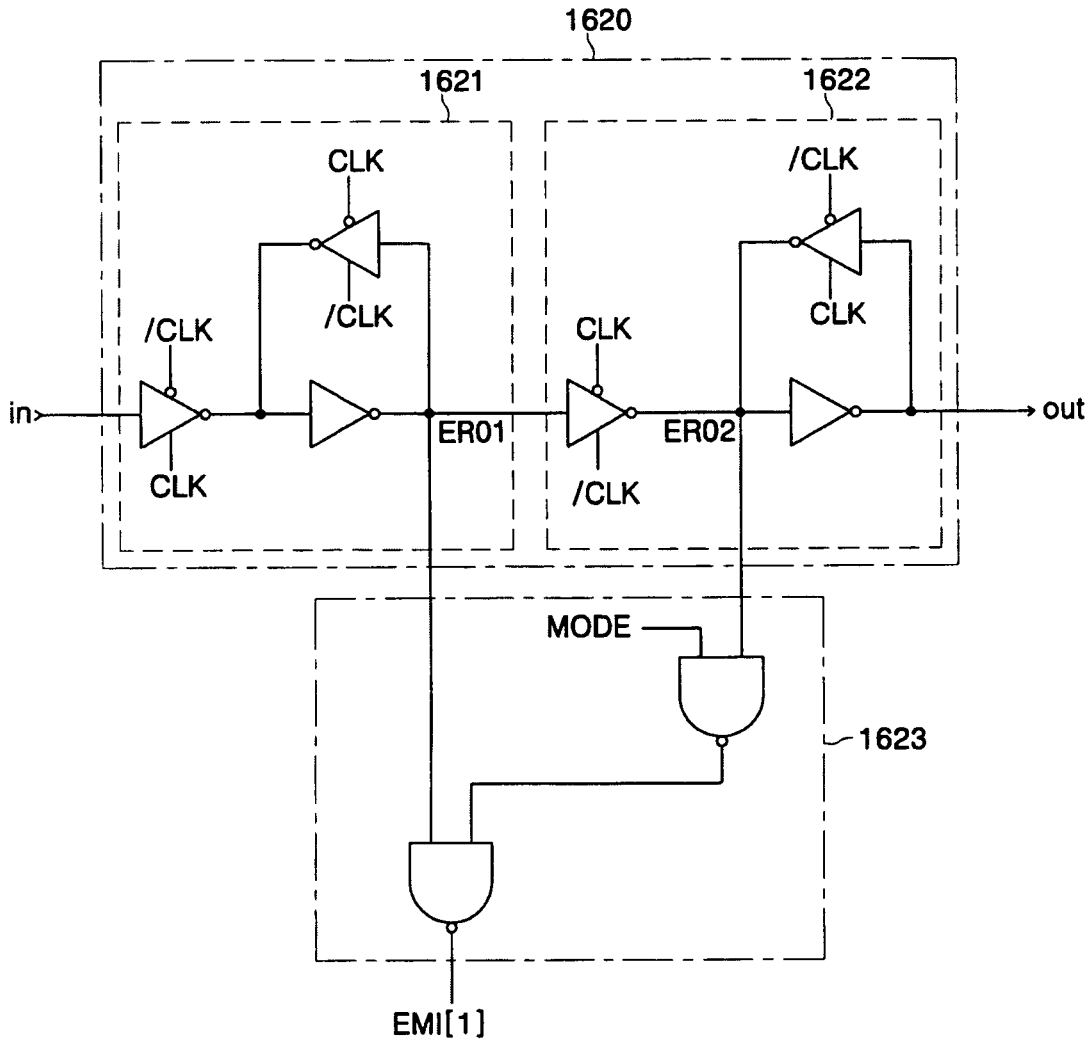
FIG. 31 shows a circuit diagram of an odd-number emission control unit illustrated in FIG. 30.

FIG. 31 shows a circuit diagram of the odd-number emission control unit illustrated in FIG. 30.

Referring to FIG. 31, the circuit diagram of the odd-number emission control unit is the same as the circuit diagram as described in the fourth embodiment with reference to FIG. 19.

Accordingly, a flip-flop 1620 samples an input signal during a high-level period of a clock signal CLK and outputs data, which is sampled during a low-level period of the clock signal CLK, via an output terminal out of a second latch 1622.

Also, an emission control signal former 1623 performs a NAND operation on an output signal ERO1 of a first latch 1621 and a signal that is obtained by delaying the output signal ERO1 by ½ a clock cycle.

The odd-number emission control unit shown in FIG. 31 can make use of the circuit as described in the third embodiment with reference to FIG. 12. Since the operations of the circuit shown in FIG. 12 were described in the third embodiment, a description thereof will not be presented here.

Figure 32A:
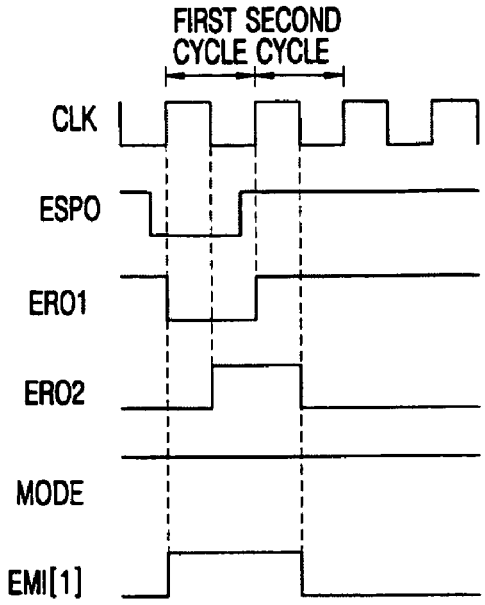
FIG. 32A shows a timing diagram illustrating operation of the odd-number emission control unit shown in FIG. 31 when the mode selection signal input is high.

FIG. 32A shows a timing diagram illustrating operation of the odd-number emission control unit shown in FIG. 31 when the mode selection signal input is high.

Figure 32B:
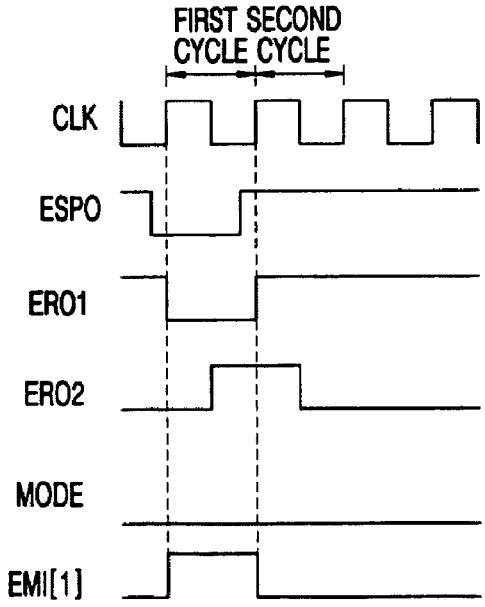
FIG. 32B shows a timing diagram illustrating operation of the odd-number emission control unit shown in FIG. 31 when the mode selection signal input is low.

FIG. 32B shows a timing diagram illustrating operation of the odd-number emission control unit shown in FIG. 31 when the mode selection signal input is low.

The operations of the odd-number emission control unit as shown in FIG. 32A and FIG. 32B are the same as shown in FIG. 13A and FIG. 13B, and FIG. 20A and FIG. 20B except that an odd-number emission start pulse ESPO has an inverted form of the odd-number start pulse VSPO as described in the third and fourth embodiments.

Accordingly, when the mode selection signal MODE is at a high level, as shown in FIG. 32A, an emission control signal EMI[1] is at a high level when either output signal ERO1 or the input from a first NAND gate into a second NAND gate is at a high level. Therefore, as shown in FIG. 32A, emission control signal EMI[1] is at a high level for the duration of the first cycle and the high period of a second cycle of the clock signal CLK.

Also, when the mode selection signal MODE is at a low level, as shown in FIG. 32B, an emission control signal EMI [1] is at a high level only when output signal ERO1 is at a high level. This time range spans the duration of the first cycle of clock signal CLK.

Although not shown in the figures, the even-number emission control unit may include the even-number scan unit as described in the third embodiment with reference to FIG. 14 or as described in the fourth embodiment with reference to FIG. 21.

Figure 33:
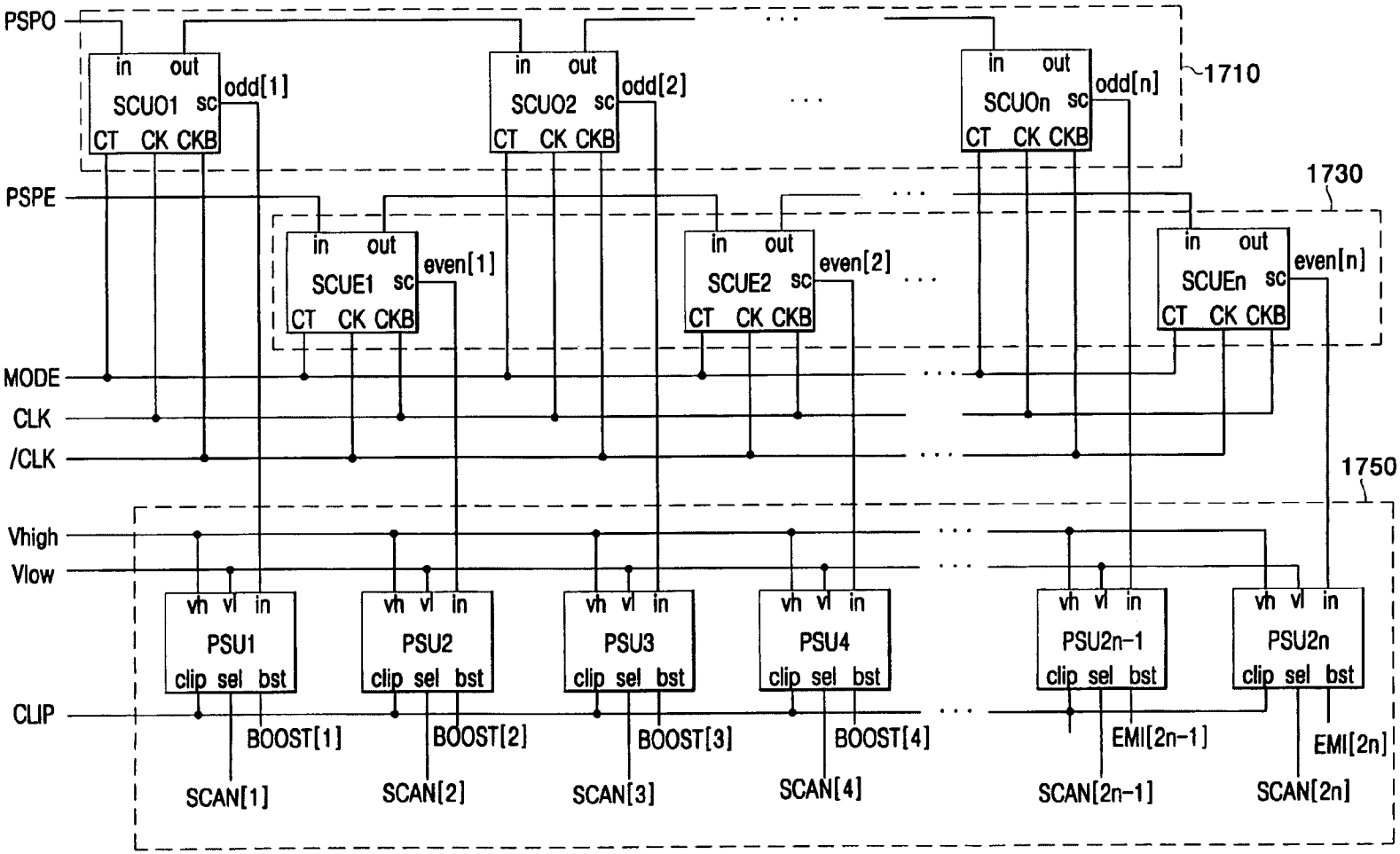
FIG. 33 shows a block diagram of a program driver illustrated in FIG. 28.

FIG. 33 shows a block diagram of the program driver illustrated in FIG. 28.

Referring to FIG. 33, the program driver 1700 of the present embodiment includes an odd-number signal generator 1710, an even-number signal generator 1730, and a scan/boost signal former 1750.

The odd-number signal generator 1710 has the same components and performs the same operations as the odd-number scan signal generator 1100 as described in the third embodiment or odd-number scan signal generator 1200 as described in the fourth embodiment. Accordingly, the application of an odd-number start pulse, the application of a clock signal CLK to terminal CK and inverse clock signal /CLK to terminal CKB, and the generation of signals in response to a mode selection signal MODE coupled with terminal CT are the same as described in either the third or fourth embodiment.

Also, the even-number signal generator 1730 has the same components and performs the same operations as the even-number scan signal generator 1150 as described in the third embodiment or even-number scan signal generator 1250 as described in the fourth embodiment. Accordingly, the application of an even-number start pulse, the application of a clock signal CLK, and the generation of signals in response to a mode selection signal MODE are the same as described in either the third or fourth embodiment.

The scan/boost signal former 1750 includes a plurality of waveform shaping units. A first waveform shaping unit PSU1 receives a first odd-number signal ODD[1], which is an output signal of a first odd-number scan unit SCUO1, an impulse signal CLIP, and is coupled with a power source Vhigh and a power source Vlow. The first waveform shaping unit PSU1 performs a logical operation on the input signals and outputs a first scan signal SCAN[1] and a first boost signal BOOST [1].

A second waveform shaping unit PSU2 receives a first even-number signal EVEN[1], which is an output signal of a first even-number scan unit SCUE1, an impulse signal CLIP, and is coupled with a power source Vhigh and a power source Vlow. The second waveform shaping unit PSU2 performs a logical operation on the input signals and and outputs a second scan signal SCAN[2] and a second boost signal BOOST [2].

As described above, the odd-number scan units are coupled with odd-numbered waveform shaping units, and the even-number scan units are coupled with even-numbered waveform shaping units.

Figure 34:
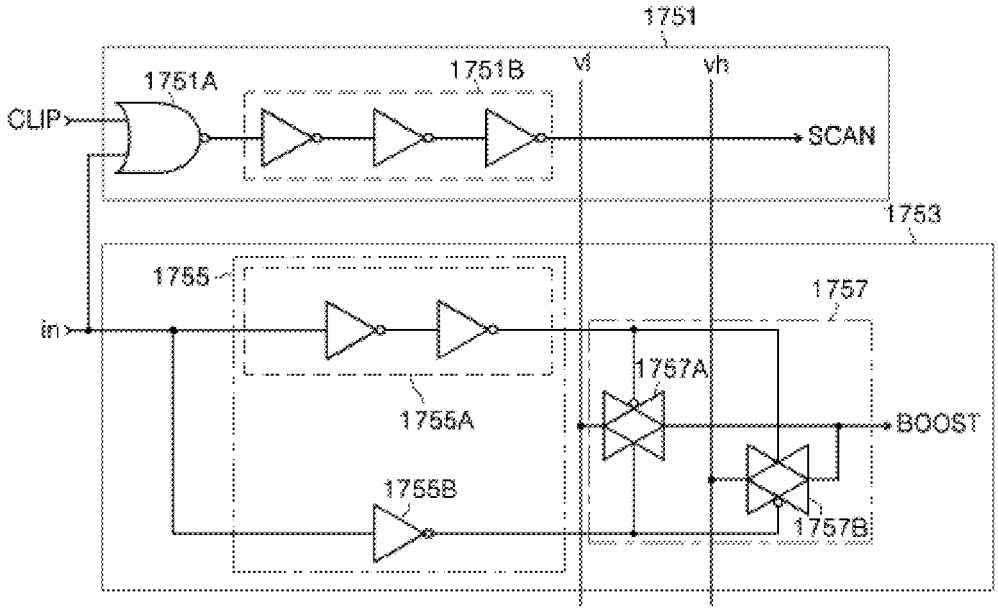
FIG. 34 shows a circuit diagram of a waveform shaping unit shown in FIG. 33.

FIG. 34 shows a circuit diagram of the waveform shaping unit illustrated in FIG. 33.

Referring to FIG. 34, a waveform shaping unit includes a scan signal forming path 1751 and a boost signal forming path 1753.

The scan signal forming path 1751 includes a NOR gate 1751A, which receives an impulse signal CLIP and an input signal in, and an odd number of inverters 1751B. The odd number of inverters 1751B receive an output signal of the NOR gate 1751B and form and output a scan signal SCAN. Either the odd-number signal ODD or even-number signal EVEN may be the input to the input terminal in.

The scan signal forming path 1751 performs an OR operation on the impulse signal CLIP and a signal that is input via an input terminal in and forms the scan signal SCAN.

The boost signal forming path 1753 includes a transmission gate controller 1755 and a transmission gate 1757.

The transmission gate controller 1755 includes a buffer 1755A and a control inverter 1755B. The buffer 1755A buffers a signal that is input via the input terminal in, and the control inverter 1755B inverts the signal that is input via the input terminal in. Thus, an output signal of the buffer 1755A corresponds to an inverted signal of an output signal of the control inverter 1755B.

The transmission gate 1757 includes a first transmission gate 1757A and a second transmission gate 1757B. The first transmission gate 1757A is coupled with a power source with voltage Vlow, and first transmission gate 1757A outputs a pulse with voltage Vlow in response to a low-level input signal. The second transmission gate 1757B is coupled with a power source with voltage Vhigh, and second transmission gate 1757B outputs a pulse with voltage Vhigh in response to a high-level input signal.

Specifically, when the input signal is at a high level, the first transmission gate 1757A is turned off, and the second transmission gate 1757B is turned on and outputs a boost signal BOOST with a level of Vhigh. Also, when the input signal is at a low level, the second transmission gate 1757B is turned off, and the first transmission gate 1757A is turned on and outputs a boost signal BOOST with a level of Vlow.

Figure 35:
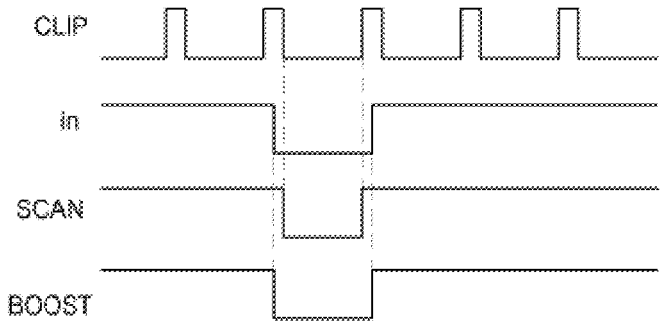
FIG. 35 shows a timing diagram illustrating the operation of the waveform shaping unit shown in FIG. 34.

FIG. 35 shows a timing diagram illustrating the operation of the waveform shaping unit shown in FIG. 34.

FIG. 35 illustrates the waveforms of a scan signal SCAN and a boost signal BOOST that result from an impulse signal CLIP and an input signal in into the waveform shaping unit shown in FIG. 34.

The input signal in is an output signal ODD[1,2, . . . ,n] of the odd-number signal generator 1710 or an output signal EVEN[1,2, . . . ,n] of the even-number signal generator 1730 from FIG. 33. The output signal of the odd-number signal generator 1710 can be equivalent to the odd-number scan signal as described in the third or fourth embodiments, and the output signal of the even-number signal generator 1730 can be equivalent to the even-number scan signal as described in the third or fourth embodiments.

When the impulse signal CLIP and the input signal in are input to an input terminal of the NOR gate 1751A of the waveform shaping unit, the scan signal forming path 1751 performs an OR operation on the two input signals. Thus, a low-level period of the scan signal SCAN is shortened to less than a low-level period of the input signal in.

Also, the boost signal BOOST, which is formed via the boost signal forming path 1753, has the same waveform as the input signal in. However, when the first transmission gate 1757A is turned on in a low-level period of the input signal in, the boost signal BOOST has a level of Vlow. Also, when the second transmission gate 1757B is turned on in a high-level period of the input signal in, the boost signal BOOST has a level of Vhigh.

Figure 36A:
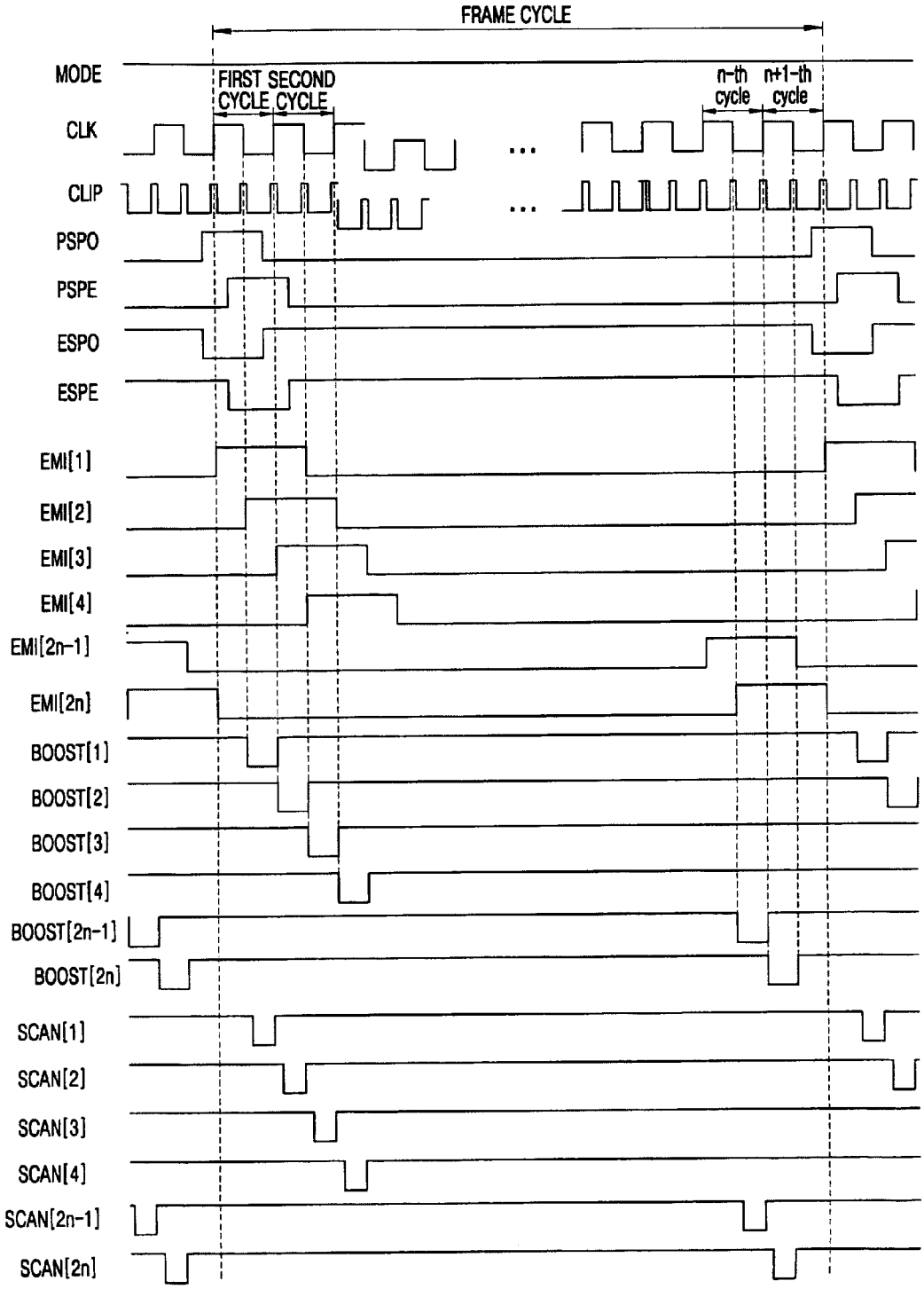
FIG. 36A shows a timing diagram illustrating progressive scanning operation of the scan driver shown in FIG. 28 according to the sixth exemplary embodiment of the present invention.

FIG. 36A shows a timing diagram illustrating progressive scanning operation of the scan driver shown in FIG. 28 according to the sixth exemplary embodiment of the present invention.

Figure 36B:
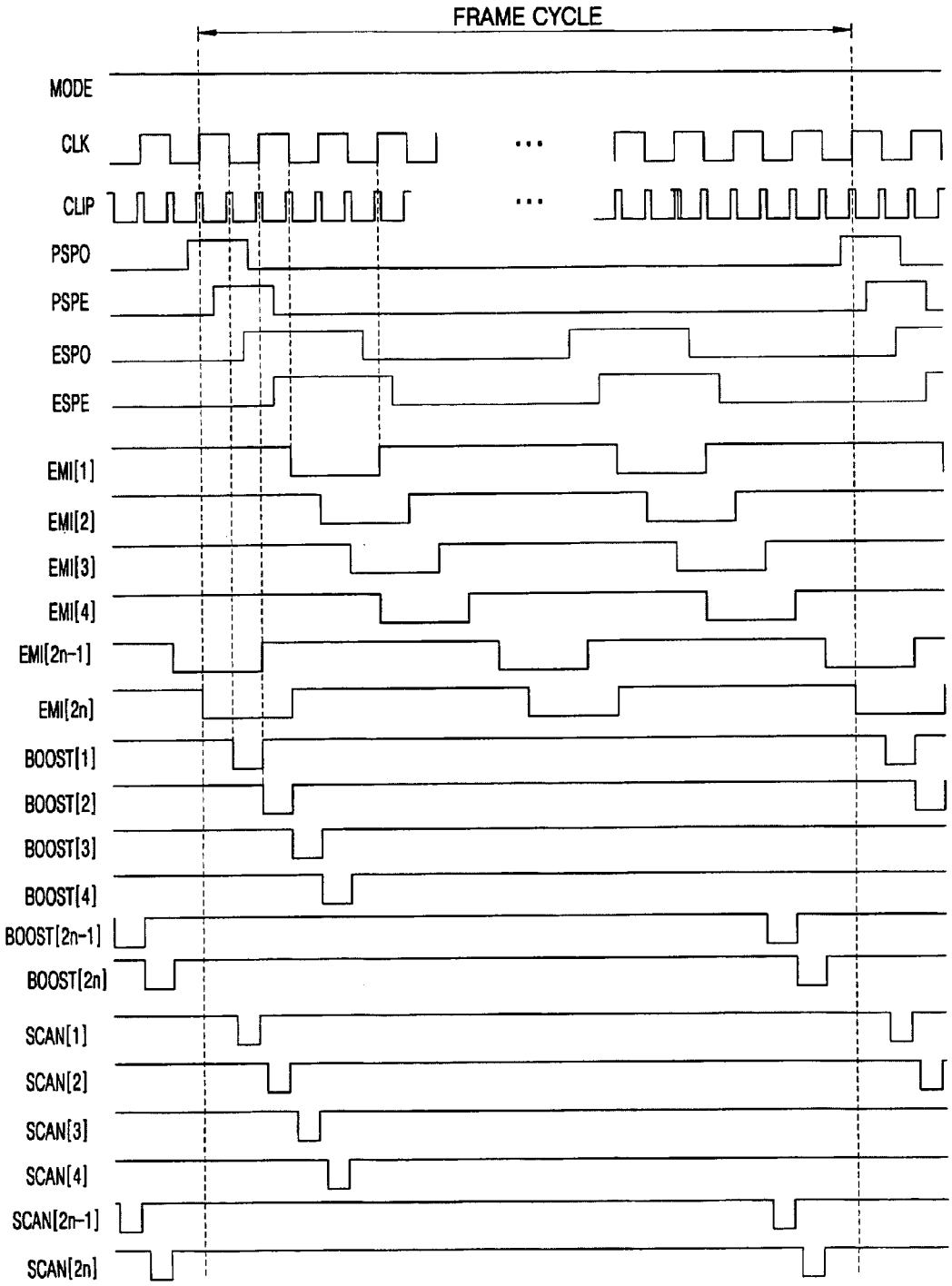
FIG. 36B shows a timing diagram illustrating progressive scanning operation of the scan driver shown in FIG. 28, where each row emits light twice during a single frame, according to the sixth exemplary embodiment of the present invention.

FIG. 36B shows a timing diagram illustrating progressive scanning operation of the scan driver shown in FIG. 28, where each row emits light twice during a single frame, according to the sixth exemplary embodiment of the present invention.

Hereinafter, the progressive scanning of the organic light emitting display of the present embodiment will be described with reference to FIG. 28, FIG. 30, FIG. 33, and FIG. 36A.

The emission driver 1600 receives a mode selection signal MODE, a clock signal CLK, an odd-number emission start pulse ESPO, and an even-number emission start pulse ESPE and generates emission control signals EMI[1,2, . . . ,2*n*−1, 2*n*] based on the input signals.

First, the odd-number emission start pulse ESPO is input to a first odd-number emission control unit ECUO1. The first odd-number emission control unit ECUO1 samples the odd-number emission start pulse ESPO at a low level on a rising edge of a first cycle of a clock signal CLK. The first odd-number emission control unit ECUO1 outputs a first emission control signal EMI[1] in response to the mode selection signal MODE being at a high level. As described above, the first emission control signal EMI[1] is at a high level through the duration of the first cycle and the high period of the second cycle of the clock signal CLK.

Directly after the first cycle of the clock signal CLK starts, the even-number emission start pulse ESPE is input to a first even-number emission control unit ECUE1. The first even-number emission control unit ECUE1 samples the even-number emission start pulse ESPE at a low level on a falling edge of the first cycle of the clock signal CLK. The first even-number emission control unit ECUE1 outputs a second emission control signal EMI[2] in response to the mode selection signal MODE being at a high level. The second emission control signal EMI[2] is at a high level from the falling edge of the first cycle to the end of the second cycle of the clock signal CLK. Also, the second emission control signal EMI[2] is delayed by ½ a clock cycle after the first emission control signal EMI[1].

The output signal of the flip-flop of the first odd-number emission control unit ECUO1 is input to a second odd-number emission control unit ECUO2. Thus, the second odd-number emission control unit ECUO1 outputs a third emission control signal EMI[3] that is delayed by one clock cycle after the first emission control signal EMI[1].

Also, the output signal of the flip-flop of the first even-number emission control unit ECUE1 is input to a second even-number emission control unit ECUE2. Thus, the second even-number emission control unit ECUO1 outputs a fourth emission control signal EMI[4] that is delayed by one clock cycle after the second emission control signal EMI[2].

The above-described process is sequentially performed until a 2*n*−1-th emission control signal EMI[2*n*−1] and a 2*n*-th emission control signal EMI[2*n*] are generated.

Also, the program driver 1700 receives a mode selection signal MODE, a clock signal CLK, an odd-number start pulse PSPO, an even-number start pulse PSPE, a high power supply Vhigh, a low power supply Vlow, and an impulse signal CLIP, and generates scan signals SCAN[1,2, . . . ,2*n*−1, 2*n*] and boost signals BOOST[1,2, . . . ,2*n*−1,2*n*] based on the input signals.

First, the odd-number start pulse PSPO is input to a first odd-number scan unit SCUO1. The first odd-number scan unit SCUO1 samples the odd-number start pulse PSPO at a high level on a rising edge of a first cycle of the clock signal CLK and performs a logical operation on the sampled signal. Thus, the first odd-number scan unit SCUO2 outputs a first odd-number signal ODD[1] with a low level in a low-level period of the first cycle of the clock signal CLK in response to the mode selection signal being at a high level.

The first waveform shaping unit PSU1 receives the first odd-number signal ODD[1] and outputs a first scan signal SCAN[1] through an OR operation of the first odd-number signal ODD[1] and the impulse signal CLIP. Also, the first waveform shaping unit PSU1 generates a first boost signal BOOST[1], which has the same logic as the first odd-number signal ODD[1] but has a high level of Vhigh and a low level of Vlow.

Directly after the first cycle of the clock signal CLK starts, the even-number start pulse PSPE is input to a first even-number scan unit SCUE1. The first even-number scan unit SCUE1 samples the even-number start pulse PSPE at a low level on a falling edge of the first cycle of the clock signal CLK and performs a logical operation on the sampled signal. Thus, the first even-number scan unit SCUE1 outputs a first even-number signal EVEN[1] with a low level in a high-level period of a second cycle of the clock signal CLK in response to the mode selection signal MODE being at a high level.

The second waveform shaping unit PSU2 receives the first even-number signal EVEN[1] and outputs a second scan signal SCAN[2] through an OR operation of the first even-number signal EVEN[1] and the impulse signal CLIP. Also, the second waveform shaping unit PSU2 generates a second boost signal BOOST[2], which has the same logic as the first even-number signal EVEN[1] but has a high level of Vhigh and a low level of Vlow.

Also, the second odd-number scan unit SCUO2 receives the output signal of the flip-flop of the first odd-number scan unit SCUO1 and outputs a second odd-number signal ODD [2] that is synchronized with the clock signal CLK. There is a phase difference of one clock cycle between the second odd-number signal ODD[2] and the first odd-number signal ODD [1]. A third waveform shaping unit PSU3 receives the second odd-number signal ODD[2] and outputs a third scan signal SCAN[3] and then outputs a third boost signal BOOST[3].

Also, the second even-number scan unit SCUE2 receives the output signal of the flip-flop of the first even-number scan unit SCUE1 and outputs a second even-number signal EVEN [2] that is synchronized with the clock signal CLK. There is a phase difference of one clock cycle between the second even-number signal EVEN[2] and the first even-number signal EVEN[1]. A fourth waveform shaping unit PSU4 receives the second even-number signal EVEN[2] and outputs a fourth scan signal SCAN[4] and then outputs a fourth boost signal BOOST[4].

The above-described process is sequentially performed until a 2*n*−1-th scan signal SCAN[2*n*−1] and a 2*n*-th scan signal SCAN[2*n*] are generated.

In the above-described process, it can be seen that scan signals SCAN[1,2, . . . ,2*n*], boost signals BOOST[1, 2, . . . ,2*n*], and emission control signals EMI[1,2, . . . ,2*n*] are sequentially generated for each ½ a clock cycle.

As shown in FIG. 36B, pixels arranged in one scan line of the organic light emitting display do not sequentially emit light for a frame cycle but separately emit light for two times. Thus, the timing diagram of FIG. 36B is the same as that of FIG. 36A except for the waveforms of emission start pulses ESPO and ESPE and emission control signals EMI[1, 2, . . . ,2*n*]. Accordingly, a description of the operations of the emission driver 1600 will be presented, but a description of the operations of the program driver 1700 will be omitted here.

First, the odd-number emission start pulse ESPO is input to a first odd-number emission control unit ECUO1. The odd-number emission start pulse ESPO makes a transition to a high level in a low-level period of a first cycle of a clock signal CLK and has a predetermined duty cycle. In this case, the duty cycle of the odd-number emission start pulse ESPO does not exceed ½ a frame cycle.

The first odd-number emission control unit ECUO1 samples an odd-number emission start pulse ESPO with a high level on a rising edge of a second cycle of the clock signal CLK and performs a NAND operation on the sampled signal and an output signal of a flip-flop. Thus, the first emission control signal EMI[1] is at a low level from a point in time at which the output signal of the flip-flop makes a transition to a high level to a point in time at which the flip-flop samples the odd-number start pulse ESPO at a low level.

The above-described odd-number emission start pulse ESPO is repetitively input also for the other ½ a frame cycle. That is, the odd-number emission start pulse ESPO is input with a frequency that is twice as high as a frame frequency, so that the odd-number emission control signals EMI[1, 3, . . . ,2*n*−1] also have a frequency that is twice as high as the frame frequency. However there is a phase difference of one clock cycle between two proximate odd-number emission control signals.

The above-described process is applied to an even-number emission control unit. There may be a phase difference of ½ a clock cycle between the even-number emission start pulse ESPE and the odd-number emission start pulse ESPO. Accordingly, the second emission control signal EMI[2] is delayed by ½ a clock cycle after the first emission control signal EMI[1].

Therefore, the emission control signals EMI[1,2, . . . ,2*n*] are sequentially output for the first half of the frame cycle, and output is repeated for the second half of the frame cycle. Since a certain pixel starts to emit light in response to an emission control signal, as shown in FIG. 36B, one pixel can perform an emission operation twice per frame cycle. Also, the number of times a pixel emits light for each frame cycle depends on the frequencies of an odd-number emission start pulse and an even-number emission start pulse. Therefore, the number of emission operations can be controlled by controlling the frequency of the odd-number and even-number emission start pulses applied per frame cycle.

Figure 37:
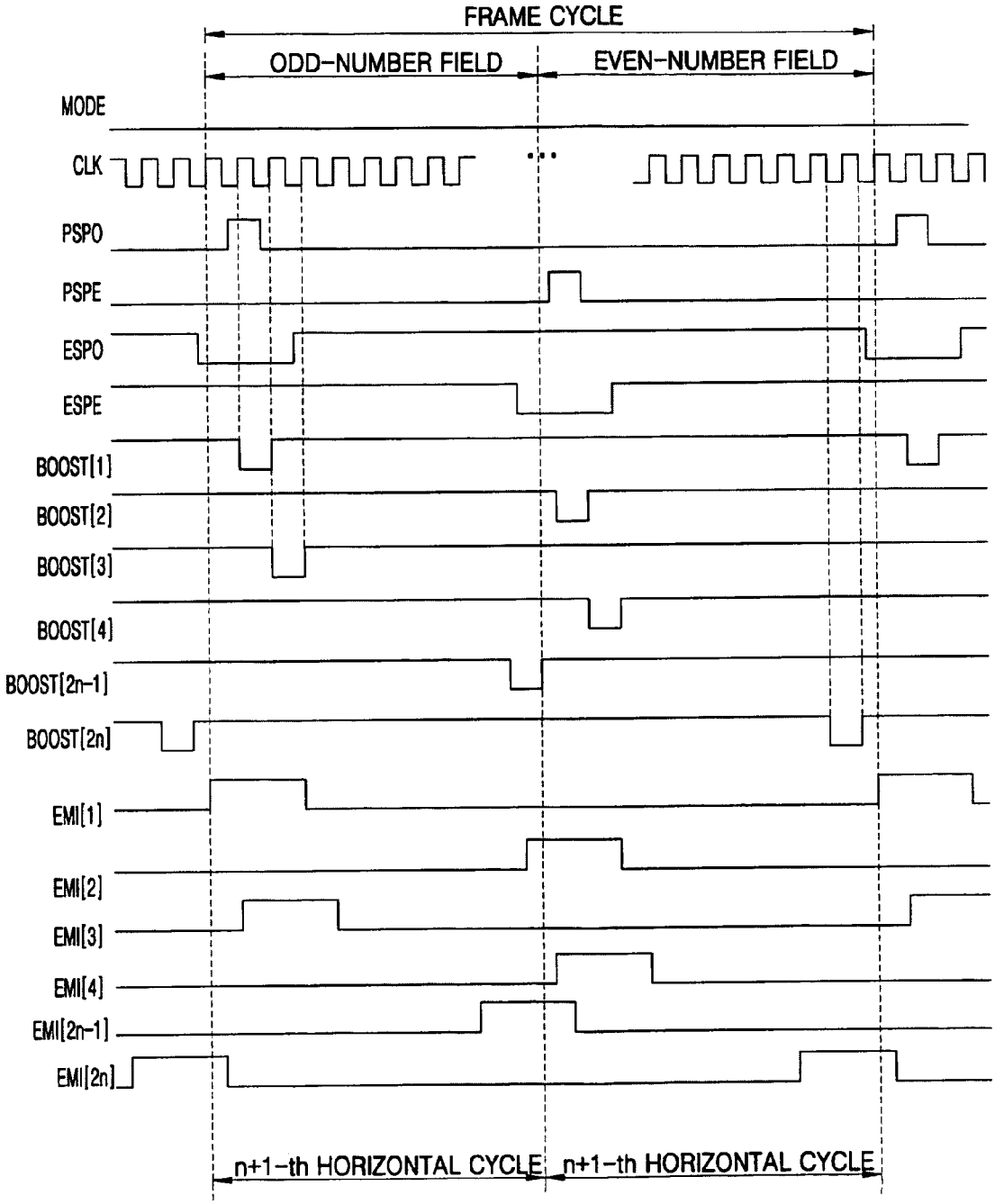
FIG. 37 shows a timing diagram illustrating interlaced scanning of the organic light emitting display according to the sixth exemplary embodiment of the present invention.

FIG. 37 shows a timing diagram illustrating interlaced scanning of the organic light emitting display according to the sixth exemplary embodiment of the present invention.

In the interlaced scanning, a frame is divided into an odd-number field period and an even-number field period. In the odd-number field period, an odd-number start pulse PSPO is input and odd-number boost signals and odd-number scan signals are sequentially output, and an odd-number emission start pulse ESPO is input and odd-number emission control signals are sequentially output. Also, in the even-number field period, an even-number start pulse PSPE is input and even-number boost signals and even-number scan signals are sequentially output, and an even-number emission start pulse ESPE is input and even-number emission control signals are sequentially output.

Hereinafter, the interlaced scanning of the organic light emitting display of the present embodiment will be described with FIG. 28, FIG. 30, FIG. 33, and FIG. 37.

In the odd-number field period, the emission driver 1600 receives a mode selection signal MODE, a clock signal CLK, and the odd-number emission start pulse ESPO and generates odd-number emission control signals EMI[1,3, . . . ,2*n*−1] based on the input signals.

First, the odd-number emission start pulse ESPO is input to a first odd-number emission control unit ECUO1. The first odd-number emission control unit ECUO1 samples the odd-number emission start pulse ESPO at a low level on a rising edge of a first cycle of the clock signal CLK. The first odd-number emission control unit ECUO1 outputs a first emission control signal EMI[1]. The first emission control signal EMI [1] is at a high level from a point in time at which a low-level input signal starts to be sampled to a point in time at which an input signal, which returns to a high level, starts to be sampled.

An output signal of a flip-flop of the first odd-number emission control unit ECUO1 is input to a second odd-number emission control unit ECUO2. Thus, the second odd-number emission control unit ECUO2 outputs a third emission control signal EMI[3] that is delayed by one clock cycle after the first emission control signal EMI[1].

In the above-described process, odd-numbered emission control signals EMI[1,3, . . . ,2*n*−1] are sequentially generated in the odd-number field period.

Also, the program driver 1700 receives the mode selection signal MODE, the clock signal CLK, the odd-number start pulse PSPO, Vhigh, Vlow, and an impulse signal CLIP, and generates odd-number scan signals SCAN[1,3, . . . ,2*n*−1] and odd-number boost signals BOOST[1,3, . . . ,2*n*−1] based on the input signals.

First, the odd-number start pulse PSPO is input to the first odd-number scan unit SCUO1. The first odd-number scan unit SCUO1 samples the odd-number start pulse PSPO at a high level on a rising edge of a second cycle of the clock signal CLK. Thus, the first odd-number scan unit SCUO1 outputs a first odd-number signal ODD[1] at a low level for the second cycle of the clock signal CLK.

A first waveform shaping unit PSU1 receives the first odd-number signal ODD[1] and outputs a first scan signal SCAN [1] through an OR operation of the first odd-number signal ODD[1] and the impulse signal CLIP. Also, the first waveform shaping unit PSU1 has the same logic as the first odd-number signal ODD[1] but generates a first boost signal BOOST[1] with a high level of Vhigh and a low level of Vlow.

Also, a second odd-number scan unit SCUO2 receives the output signal of the flip-flop of the first odd-number scan unit SCUO1 and outputs a second odd-number signal ODD[2] that is synchronized with the clock signal CLK. There is a phase difference of one clock cycle between the second odd-number signal ODD[2] and the first odd-number signal ODD [1]. A third waveform shaping unit PSU3 receives the second odd-number signal ODD[2] and outputs a third scan signal SCAN[3] and then outputs a third boost signal BOOST[3].

The above-described process is sequentially performed until a 2*n*−1-th scan signal SCAN[2*n*−1] and a 2*n*−1-th boost signal BOOST[2*n*−1] are generated.

In the above-described process, odd-number scan signals SCAN[1,3, . . . ,2*n*−1], odd-number boost signals BOOST[1, 3, . . . 2*n*−1], and odd-number emission control signals EMI [1,3, . . . ,2*n*−1] are sequentially generated in the odd-number field period for one cycle of the clock signal CLK.

After the odd-number field period, the even-number field period starts. In the even-number field period, the emission driver 1600 receives a mode selection signal MODE, a clock signal CLK, and an even-number start pulse ESPE and generates even-number emission control signals EMI[2, 4, . . . ,2*n*] based on the input signals.

First, the even-number emission start pulse ESPE is input to a first even-number emission control unit ECUE1. The first even-number emission control unit ECUE1 samples the even-number emission start pulse ESPE at a low level on a falling edge of an n+1-th cycle of the clock signal CLK. The first even-number emission control unit ECUE1 outputs a second emission control signal EMI[2]. The second emission control signal EMI[2] is at a high level from a point in time at which a low-level input signal starts to be sampled to a point in time at which an input signal, which returns at a high level, starts to be sampled.

An output signal of a flip-flop of the first even-number emission control unit ECUE1 is input to a second even-number emission control unit ECUE2. Thus, the second even-number emission control unit ECUE2 outputs a fourth emission control signal EMI[4] that is delayed by one clock cycle after the second emission control signal EMI[2].

In the above-described process, even-number emission control signals EMI[2,4, . . . ,2*n*] are sequentially generated in the even-number field period.

Also, in the even-number field period, the program driver 1700 receives the mode selection signal MODE, the clock signal CLK, the even-number start pulse PSPE, Vhigh, Vlow, and the impulse signal CLIP and generates even-number scan signals SCAN[2,4, . . . ,2*n*] and even-number boost signals BOOST[2,4, . . . ,2*n*] based on the input signals.

First, the even-number start pulse ESPE is input to a first even-number scan unit SCUE1. The first even-number scan unit SCUE1 samples the even-number start pulse PSPE at a high level and inverts the sampled signal on a falling edge of an n+2-th cycle of the clock signal CLK. Thus, the first even-number scan unit SCUE1 outputs a first even-number signal EVEN[1] being at a low level during a low-level period of an n+2-th cycle of the clock signal CLK and during a high-level period of an n+3-th cycle thereof in response to the mode selection signal MODE being at a low level.

A second waveform shaping unit PSU2 receives the first even-number signal EVEN[1] and outputs a second scan signal SCAN[2] through an OR operation of the first even-number signal EVEN[1] and the impulse signal CLIP. Also, the second waveform shaping unit PSU2 has the same logic as the first even-number signal EVEN[1] but generates a second boost signal BOOST[2] with a high level of Vhigh and a low level of Vlow.

Also, a second even-number scan unit SCUE2 receives an output signal of a flip-flop of the first even-number scan unit SCUE1 and outputs a second even-number signal EVEN[2] that is synchronized with the clock signal CLK. There is a phase difference of one clock cycle between the second even-number signal EVEN[2] and the first even-number signal EVEN[1]. A fourth waveform shaping unit PSU4 receives the second even-number signal EVEN[2] and outputs a fourth scan signal SCAN[4] and then outputs a fourth boost signal BOOST[4].

The above-described is sequentially performed until a 2*n*-th scan signal SCAN[2*n*] and a 2*n*-th boost signal BOOST [2*n*] are generated. Accordingly, even-number scan signals SCAN[2,4, . . . ,2*n*], even-number boost signals BOOST[2, 4, . . . ,2*n*], and even-number emission control signals EMI [2,4, . . . ,2*n*] are sequentially generated in the even-number field period for one cycle of the clock signal CLK.

Also, as shown in FIG. 36B, a pixel that is selected by each scan signal can perform an emission operation twice or more in one frame cycle by increasing the frequencies of the odd-number emission start pulse ESPO and the even-number emission start pulse ESPE to at least twice as high as a frame frequency.

As described above, according to the first, second, third, fourth, and fifth embodiments of the present invention, progressive scanning and interlaced scanning can be selectively carried out using only one scan driver. Also, according to the sixth embodiment of the present invention, the organic light emitting display can selectively perform progressive scanning and interlaced scanning.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A scan driver for selectively performing progressive scanning and interlaced scanning, comprising:

a first signal generator to receive a first start pulse, the first signal generator comprising a plurality of first scan units to generate a plurality of first signals in response to a mode selection signal; and a second signal generator to receive a second start pulse, the second signal generator comprising a plurality of second scan units to generate a plurality of second signals in response to the mode selection signal, wherein the first signals are generated in a first portion of a frame cycle and the second signals are generated in a second portion of the frame cycle when the mode selection signal is at a first level, and the first signals are generated alternately with the second signals when the mode selection signal is at a second level.

2. The scan driver of claim 1, wherein the first level is a low level, and the second level is a high level.

3. The scan driver of claim 1, wherein the first signals are first scan signals synchronized with a clock signal, and the second signals are second scan signals synchronized with the clock signal.

4. The scan driver of claim 3, wherein the first scan units are coupled in series with each other.

5. The scan driver of claim 4, wherein a first scan unit samples the first start pulse on a rising edge of the clock signal.

6. The scan driver of claim 5, wherein the first scan unit comprises:

a first flip-flop to sample an input signal and to generate a first output signal and a second output signal; and a first scan signal former to receive the first output signal, the second output signal, and the mode selection signal, and to generate a first scan signal in response to the first output signal, the second output signal, and the mode selection signal.

7. The scan driver of claim 6, wherein the first flip-flop comprises:

a first latch to sample the input signal during a high-level period of the clock signal, to store the sampled signal during a low-level period of the clock signal, and to generate the first output signal; and a second latch to sample the first output signal during the low-level period of the clock signal, to store the sampled output signal of the first latch during the high-level period of the clock signal, and to generate the second output signal.

8. The scan driver of claim 7, wherein the first scan signal former inverts the first output signal or performs an AND operation on an inverted first output signal and the second output signal.

9. The scan driver of claim 7, wherein the first scan signal former inverts the first output signal or performs an AND operation on the first output signal and the second output signal.

10. The scan driver of claim 7, wherein the first latch comprises:

a first sampler to sample the input signal during the high-level period of the clock signal; and a first holder to store the first output signal during the low-level period of the clock signal.

11. The scan driver of claim 10, wherein the second latch comprises:

a second sampler to sample the first output signal during the low-level period of the clock signal; and a second holder to store the second output signal during the high-level period of the clock signal.

12. The scan driver of claim 6, wherein the first scan signal former comprises:

a first NAND gate to perform a NAND operation on the second output signal and the mode selection signal; and a second NAND gate to perform a NAND operation on an output signal of the first NAND gate and the first output signal and to generate the first scan signal.

13. The scan driver of claim 7, wherein the first scan signal former comprises:

a first inverter, coupled between the second latch and a first NAND gate, to invert the second output signal;

a first NAND gate to perform a NAND operation on the inverted second output signal and the mode selection signal; and a second NAND gate to perform a NAND operation on an output signal of the first NAND gate and the first output signal and to generate the first scan signal.

14. The scan driver of claim 11, wherein the first scan signal former comprises:

a first NAND gate to perform a NAND operation on an output signal from the second sampler and the mode selection signal; and a second NAND gate to perform a NAND operation on an output signal of the first NAND gate and the first output signal and to generate the first scan signal.

15. The scan driver of claim 5, wherein the second scan units are coupled in series with each other, and a second scan unit of the plurality of second scan units samples the second start pulse on a falling edge of the clock signal.

16. The scan driver of claim 15, wherein the second scan unit comprises:

a second flip-flop to sample an input signal and to generate a third output signal and a fourth output signal; and a second scan signal former to receive the third output signal, the fourth output signal, and the mode selection signal, and to generate a second scan signal in response to the third output signal, the fourth output signal, and the mode selection signal.

17. The scan driver of claim 16, wherein the second flip-flop comprises:

a third latch to sample the input signal during a low-level period of the clock signal, to store the sampled signal during a high-level period of the clock signal, and to generate the third output signal; and a fourth latch to sample the third output signal during the high-level period of the clock signal, to store the sampled output signal of the third latch during the low-level period of the clock signal, and to generate the fourth output signal.

18. The scan driver of claim 17, wherein the second scan signal former inverts the third output signal or performs an AND operation on an inverted third output signal and the fourth output signal.

19. The scan driver of claim 17, wherein the first scan signal former inverts the third output signal or performs an AND operation on the third output signal and the fourth output signal.

20. The scan driver of claim 17, wherein the third latch comprises:

a third sampler to sample the input signal during the low-level period of the clock signal; and a third holder to store the third output signal during the high-level period of the clock signal.

21. The scan driver of claim 20, wherein the fourth latch comprises:

a fourth sampler to sample the third output signal during the high-level period of the clock signal; and a fourth holder to store the fourth output signal during the low-level period of the clock signal.

22. The scan driver of claim 16, wherein the second scan signal former comprises:

a third NAND gate to perform a NAND operation on the fourth output signal and the mode selection signal; and a fourth NAND gate to perform a NAND operation on an output signal of the third NAND gate and the third output signal and to generate the second scan signal.

23. The scan driver of claim 17, wherein the second scan signal former comprises:

a second inverter, coupled between the fourth latch and a third NAND gate, to invert the fourth output signal;

a third NAND gate to perform a NAND operation on the inverted fourth output signal and the mode selection signal; and a fourth NAND gate to perform a NAND operation on an output signal of the third NAND gate and the third output signal and to generate the second scan signal.

24. The scan driver of claim 21, wherein the second scan signal former comprises:

a third NAND gate to perform a NAND operation on an output signal from the fourth sampler and the mode selection signal; and a fourth NAND gate to perform a NAND operation on an output signal of the third NAND gate and the third output signal and to generate the second scan signal.

25. The scan driver of claim 1, further comprising:

a scan and/or emission control signal former to receive an impulse signal and an input signal from the first signal generator or the second signal generator, to generate a scan signal through an OR operation, and to invert the input signal to generate an emission control signal.

26. The scan driver of claim 25, wherein the input signal comprises a first signal of the plurality of first signals or a second signal of the plurality of second signals.

27. The scan driver of claim 26, wherein the scan and/or emission control signal former comprises:

a scan signal forming path to perform an OR operation on the impulse signal and the input signal to form the scan signal; and an emission control signal forming path to invert the input signal to form the emission control signal.

28. The scan driver of claim 26, wherein the scan signal forming path comprises:

a NOR gate to receive the impulse signal and the input signal; and an odd number of inverters coupled in series to an output terminal of the NOR gate.

* * * * *